US011001956B2

(12) United States Patent
Cho et al.

(10) Patent No.: US 11,001,956 B2
(45) Date of Patent: May 11, 2021

(54) WASHING MACHINE AND METHOD FOR CONTROLLING THE SAME

(71) Applicant: Samsung Electronics Co., Ltd., Suwon-si (KR)

(72) Inventors: Sung-Jin Cho, Seongnam-si (KR); Do-Yeon Kim, Yongin-si (KR); Suk Bae Kim, Suwon-si (KR); Ji Eun Jun, Suwon-si (KR); Woong Choi, Suwon-si (KR); Su Hwan Ji, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 318 days.

(21) Appl. No.: 15/850,540

(22) Filed: Dec. 21, 2017

(65) Prior Publication Data

US 2018/0291548 A1 Oct. 11, 2018

(30) Foreign Application Priority Data

Apr. 11, 2017 (KR) ..... 10-2017-0046880
Aug. 28, 2017 (KR) ..... 10-2017-0108457

(51) Int. Cl.

| | |
|---|---|
| ***D06F 37/30*** | (2020.01) |
| ***D06F 37/20*** | (2006.01) |
| ***D06F 37/36*** | (2006.01) |
| ***D06F 33/02*** | (2006.01) |
| ***D06F 29/00*** | (2006.01) |
| ***D06F 33/00*** | (2020.01) |

(52) U.S. Cl.
CPC ..... *D06F 37/304* (2013.01); *D06F 33/00* (2013.01); *D06F 37/36* (2013.01); *D06F 29/00* (2013.01); *D06F 37/203* (2013.01); *D06F 2202/065* (2013.01)

(58) Field of Classification Search
CPC ..... D06F 37/36; D06F 37/304; D06F 33/00; D06F 29/00; D06F 37/203; D06F 2202/065
See application file for complete search history.

(56) References Cited

U.S. PATENT DOCUMENTS

2008/0022465 A1 1/2008 Jun et al.
2010/0269266 A1* 10/2010 Lee ..... D06F 33/00 8/159
2010/0275381 A1 11/2010 Ko et al.
(Continued)

FOREIGN PATENT DOCUMENTS

JP 2016-129534 A 7/2016
KR 1997-0075090 A 12/1997
(Continued)

*Primary Examiner* — Benjamin L Osterhout
(74) *Attorney, Agent, or Firm* — Jefferson IP Law, LLP

(57) ABSTRACT

A washing machine and a method for controlling the same are provided. The washing machine includes a first rotary tub, a first driver configured to rotate the first rotary tub, a second rotary tub, a second driver configured to rotate the second rotary tub, and at least one processor configured to control the first driver and the second driver in a manner that the first rotary tub and the second rotary tub rotate. If a rotation speed of the first rotary tub is equal to or higher than a first reference speed, the at least one processor controls the second driver such that a rotation speed of the second rotary tub increases to a target speed and then decreases.

20 Claims, 40 Drawing Sheets

(56) References Cited

U.S. PATENT DOCUMENTS

| | | | | |
|---|---|---|---|---|
| 2016/0010263 | A1 | 1/2016 | Kim | |
| 2016/0215432 | A1* | 7/2016 | Kim | D06F 33/00 |
| 2017/0356115 | A1* | 12/2017 | Choi | D06F 37/266 |

FOREIGN PATENT DOCUMENTS

| | | | |
|---|---|---|---|
| KR | 10-0144209 | B1 | 7/1998 |
| KR | 2003-0044492 | A | 6/2003 |
| KR | 10-2012-0044572 | A | 5/2012 |
| KR | 10-2014-0118132 | A | 10/2014 |

* cited by examiner

WASHING MACHINE AND METHOD FOR CONTROLLING THE SAME

CROSS-REFERENCE TO RELATED APPLICATION(S)

This application claims the benefit under 35 U.S.C. § 119(a) of a Korean patent application filed on Apr. 11, 2017 in the Korean Intellectual Property Office and assigned Serial number 10-2017-0046880 and Korean patent application filed on Aug. 28, 2017 in the Korean Intellectual Property Office and assigned Serial number 10-2017-0108457, the entire disclosure of each which is hereby incorporated by reference.

TECHNICAL FIELD

The present disclosure relates to a washing machine and a method for controlling the same.

BACKGROUND

A washing machine is an electronic appliance that washes laundry, such as clothing, bedding, towels, fabrics, and the like. The washing machine may include one or more washing tubs configured to store laundry and wash water therein, and may wash laundry by rotation of the washing tub.

The washing tub of the washing machine may include a rotary pulsator installed at a bottom surface thereof, or may include a rotary rod having wings installed at the center thereof, such that the washing machine may wash laundry by rotating the pulsator or the rotary rod.

The washing machine provided with the pulsator may wash laundry stored in the washing tub using eddy currents produced by rotating the pulsator disposed at the bottom surface of the washing tub at a high speed. The washing machine may agitate laundry by periodically rotating the pulsator in different directions within the range of a predetermined angle, such that the laundry may be washed.

The washing machine may include a laundry inlet (or opening) provided at a front thereof, and may include a drum that rotates while being tilted at a predetermined angle with respect to a line perpendicular to the ground. In this case, laundry may be washed using a head of water obtained by rotation of the drum.

The washing machine may perform a washing process using various methods as described above. Upon completion of the washing process, the washing machine may wash laundry by further performing at least one of a rinsing process and a dehydration process in order of precedence.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a washing machine having a plurality of washing tubs, which reduces or removes excessive vibration caused by simultaneous operation of the plurality of washing tubs, and a method for controlling the same.

Another aspect of the present disclosure is to provide a washing machine for solving unbalance caused by eccentricity of laundry when the laundry is washed using one or more washing tubs, and a method for controlling the same.

Additional aspects of the disclosure will be set forth in part in the description which follows and, in part, will be obvious from the description, or may be learned by practice of the disclosure.

In accordance with an aspect of the present disclosure, a washing machine is provided. The washing machine includes a first rotary tub, a first driver configured to rotate the first rotary tub, a second rotary tub, a second driver configured to rotate the second rotary tub, and at least one processor configured to control the first driver and the second driver in a manner that the first rotary tub and the second rotary tub rotate, wherein the at least one processor, if a rotation speed of the first rotary tub is equal to or higher than a first reference speed, controls the second driver such that a rotation speed of the second rotary tub increases to a target speed and then decreases.

If the rotation speed of the first rotary tub is equal to or higher than the first reference speed and if the rotation speed of the second rotary tub is equal to or higher than the target speed, the at least one processor may control the second driver in a manner that the rotation speed of the second rotary tub decreases.

The at least one processor may shut off power applied to the second driver when the rotation speed of the second rotary tub reaches the target speed.

The rotation speed of the first rotary tub and the rotation speed of the second rotary tub may include a rotation speed to be generated in a dehydration process.

One of the first rotary tub and the second rotary tub may rotate about a vertical axis, and the other one of the first rotary tub and the second rotary tub may rotate about a horizontal axis.

In accordance with another aspect of the present disclosure, a washing machine is provided. The washing machine includes a first rotary tub, a first driver configured to rotate the first rotary tub, a second rotary tub, a second driver configured to rotate the second rotary tub, and at least one processor configured to control the first driver and the second driver in a manner that the first rotary tub and the second rotary tub rotate, wherein the at least one processor controls the first driver and the second driver in a manner that, according to a rotation speed of one of the first rotary tub or the second rotary tub, a rotation speed of the other one of the first rotary tub or the second rotary tub is adjusted.

If the second rotary tub is kept at a predetermined rotation speed and if the rotation speed of the first rotary tub is less than a third reference speed, the at least one processor may control the second driver in a manner that the rotation speed of the second rotary tub is higher than the predetermined rotation speed. If the second rotary tub is kept at a predetermined rotation speed and if the rotation speed of the first rotary tub is higher than the third reference speed, the at least one processor may control the second driver in a manner that the rotation speed of the second rotary tub is kept at the predetermined rotation speed.

If the rotation speed of the second rotary tub increases, the at least one processor may control the second driver in a manner that an increased rotation speed of the second rotary tub is maintained for a predetermined time.

In accordance with another aspect of the present disclosure, a method for controlling a washing machine is provided. The method includes measuring a rotation speed of a first rotary tub, comparing a rotation speed of the first rotary tub with a first reference speed, and if the rotation speed of the first rotary tub is equal to or higher than the first reference speed, controlling the second driver in a manner that a rotation speed of the second rotary tub increases to a target speed and then decreases.

If the rotation speed of the first rotary tub is equal to or higher than the first reference speed and if the rotation speed of the second rotary tub is equal to or higher than the target speed, the method may further include controlling the second driver in a manner that the rotation speed of the second rotary tub decreases.

The controlling the second driver in a manner that the rotation speed of the second rotary tub increases to the target speed and then decreases may include: if the rotation speed of the second rotary tub reaches the target speed, shutting off power applied to the second driver.

The rotation speed of the first rotary tub and the rotation speed of the second rotary tub may include a rotation speed to be generated in a dehydration process.

One of the first rotary tub or the second rotary tub may rotate about a vertical axis, and the other one of the first rotary tub or the second rotary tub may rotate about a horizontal axis.

In accordance with another aspect of the present disclosure, a washing machine is provided. The washing machine includes a first rotary tub, a first driver configured to rotate the first rotary tub, a second rotary tub installed adjacent to the first rotary tub, a second driver configured to rotate the second rotary tub, an operation sensing portion configured to detect operation of at least one of the second rotary tub or the second driver, and at least one processor configured to determine whether unbalance occurs in the second rotary tub on the basis of the detection result, and when the unbalance occurs in the second rotary tub in a washing process or a dehydration process, configured to increase an amount of wash water stored in the second rotary tub or to change operation of the second driver.

The operation sensing portion may include at least one of: a rotary-tub operation sensing portion configured to detect vibration of the second rotary tub, or a driver operation sensing portion configured to detect at least one of a rotation speed of the second driver, a voltage applied to the second driver, or a current applied to the second driver.

The at least one processor may change the operation of the second driver by reducing a target rotation speed of the driver, by reducing an operation rate of the driver, by changing at least one of rotation acceleration or rotation deceleration of the driver, or by reducing at least one of an operation period or a stopped period of the driver.

After the at least one processor increases the amount of wash water stored in the second rotary tub or changes the operation of the second driver, if a predetermined time has elapsed, the at least one processor may reduce the amount of wash water stored in the rotary tub or controls the driver to re-execute a legacy operation.

After unbalance occurs in the second rotary tub several times, the at least one processor may increase the amount of wash water stored in the second rotary tub or may change an operation profile of the second driver.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
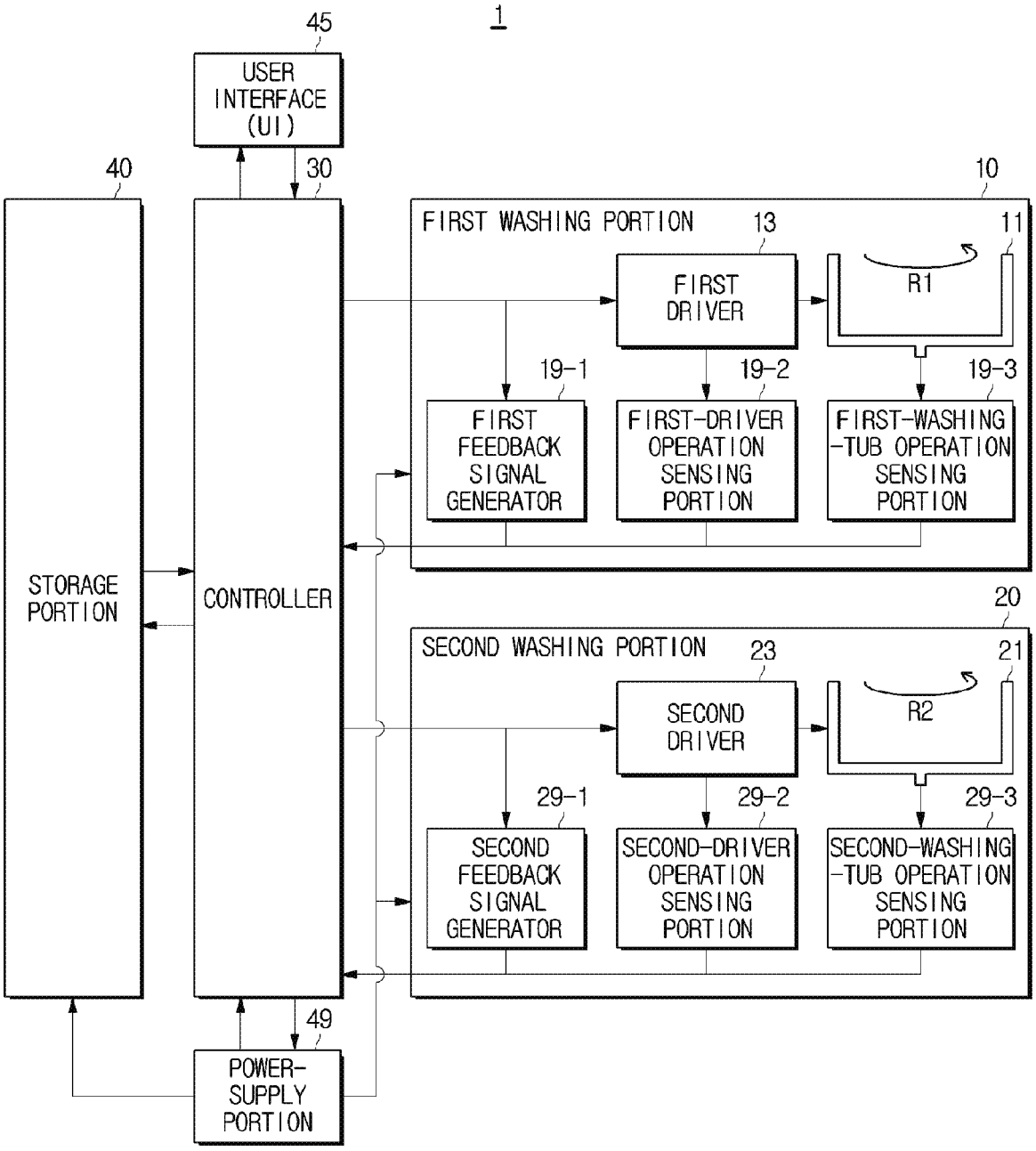
FIG. 1 is a block diagram illustrating a washing machine according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Throughout the specification of the present disclosure, terms "... part", "... module", "... member", "... block", and the like mean an element capable of being implemented by hardware, software, or a combination thereof. As used in the specification and appended claims, the term "... parts", "... modules", "... members", or "... blocks" may be implemented by a single constituent element, or the term "... part", "... module", "... member", or "... block" may include a plurality of constituent elements.

Throughout the specification of the present disclosure, if it is assumed that a certain part is connected (or coupled) to another part, the term "connection or coupling" means that the certain part is directly connected (or coupled) to another part and/or is indirectly connected (or coupled) to another part. Here, direct connection may refer to physical connection, and indirect connection may refer to electrical connection.

Throughout the specification of the present disclosure, if it is assumed that a certain part includes a certain component, the term "comprising or including" means that a corresponding component may further include other components unless context clearly indicates otherwise.

In description of the present disclosure, the terms "first" and "second" may be used to describe various components, but the components are not limited by the terms. These terms may be used to distinguish one component from another component.

Various embodiments of a washing machine including a first washing portion and a second washing portion according to the present disclosure will hereinafter be described with reference to FIGS. 1, 2, 3, 4, 5, 6, 7, 8, 9, and 10.

FIG. 1 is a block diagram illustrating a washing machine according to an embodiment of the present disclosure.

Referring to FIG. 1, the washing machine 1 according to an embodiment of the present disclosure may include a first washing portion 10 to wash laundry, and a second washing portion 20 that washes laundry and is operable with the first washing portion 10 at the same time or at different times.

The first washing portion 10 may be provided to perform at least one of a washing process, a rinsing process, and a dehydration process. The second washing portion 20 may be provided to perform at least one of a washing process, a rinsing process, and a dehydration process. In this case, processes operable by the first washing portion 10 may be identical to processes operable by the second washing portion 20. Alternatively, some of the processes operable by the first washing portion 10 may be identical to some of the processes operable by the second washing portion 20, and some other processes operable by the first washing portion 10 may be different from some other processes operable by the second washing portion 20. In addition, processes operable by the first washing portion 10 may also be different from processes operable by the second washing portion 20.

Processes to be respectively performed by the first washing portion 10 and the second washing portion 20 may be identical to or different from each other. For example, when the first washing portion 10 performs a dehydration process, the second washing portion 20 may perform another process different from the dehydration process, for example, a washing process or a rinsing process. Alternatively, the second washing portion 20 may also perform the dehydration as in the first washing portion 10.

The first washing portion 10 and the second washing portion 20 may start a predetermined process at the same time or at different times. For example, the first washing portion 10 and the second washing portion 20 may simultaneously start the dehydration process, or the dehydration process of the first washing portion 10 and the dehydration process of the second washing portion 20 may be almost simultaneously started. In another example, one of the first washing portion 10 and the second washing portion 20 may first start the dehydration process, and the other washing portion may then start the dehydration process after lapse of a predetermined time from the dehydration start time of the first-driven washing portion as necessary.

Upon completion of one (e.g., a washing process) of the processes, at least one of the first washing portion 10 and the second washing portion 20 may sequentially perform other processes, for example, a dehydration process. In this case, at least one of the first washing portion 10 and the second washing portion 20 may be provided to automatically or manually perform other processes.

In addition, when the first washing portion 10 and the second washing portion 20 start the same process (e.g., a washing process) at the same time or at almost the same time, the first washing portion 10 and the second washing portion 20 may end or finish the above-mentioned same process at the same time or at different times. When the first washing portion 10 and the second washing portion 20 end the above-mentioned same process at different times, one of the first washing portion 10 and the second washing portion 20 may start another process that is sequentially scheduled, for example, a dehydration process, prior to execution of still another process.

In accordance with an embodiment, the first washing portion 10 and the second washing portion 20 may be implemented using different schemes. For example, the first washing portion 10 may be implemented as a drum-type washing machine, and the second washing portion 20 may be implemented as an eddy-current type washing machine or an agitation-type washing machine. In another example, the first washing portion 10 may be implemented as an eddy-current type washing machine or an agitation-type washing machine, and the second washing portion 20 may be implemented as a drum-type washing machine.

In another embodiment, the first washing portion 10 and the second washing portion 20 may also be implemented using homogeneous schemes. For example, both the first washing portion 10 and the second washing portion 20 may also be implemented using one of the drum-type washing machine, the eddy-current type washing machine, and the agitation-type washing machine. For example, both the first washing portion 10 and the second washing portion 20 may also be provided to perform at least one of the washing, rising, and dehydration processes using a drum.

The above-mentioned implementation of the first washing portion 10 and the second washing portion 20 is only the scope or spirit of the present disclosure is not limited thereto, and various schemes may also be applied to the first washing portion 10 and the second washing portion 20 according to selection of a designer.

The first washing portion 10 and the second washing portion 20 may be implemented in various ways according to selection of the designer.

In accordance with an embodiment, the first washing portion 10 and the second washing portion 20 may be stacked in a vertical direction. In other words, one of the first washing portion 10 and the second washing portion 20 may be disposed on the other washing machine, such that the first washing portion 10 and the second washing portion 20 may be stacked vertically. In more detail, for example, the second washing portion 20 may be disposed at an upper end of the first washing portion 10. Of course, it should be noted that the first washing portion 10 may also be disposed at an upper end of the second washing portion 20 as necessary. In this case, the first washing portion 10 and the second washing portion 20 may be in contact with each other, or may be adjacent to each other. In addition, according to other embodiments, another device, for example, a drying machine or the like, may be disposed between the first washing portion 10 and the second washing portion 20 as necessary.

In accordance with another embodiment, the first washing portion 10 and the second washing portion 20 may be arranged parallel to each other. In other words, the second washing portion 20 may also be disposed at the right or left side of the first washing portion 10.

The first washing portion 10 and the second washing portion 20 may be integrated into one body such that it is impossible to separate the first washing portion 10 and the second washing portion 20 from each other. The first washing portion 10 and the second washing portion 20 may be implemented using different washing modules, and may then be coupled and assembled with each other as necessary. In the latter case, the first washing portion 10 and the second washing portion 20 may be detachably coupled to each other.

The first washing portion 10 and the second washing portion 20 may be operable at predetermined drive speeds R1 and R2, respectively. The first washing portion 10 may remain or change the changeable predetermined drive speed (hereinafter referred to as a first drive speed R1), and may perform at least one of the washing, rinsing, and dehydration processes. The second washing portion 20 may remain or change the changeable predetermined drive speed (hereinafter referred to as a second drive speed R2), and may perform at least one of the washing, rinsing, and dehydration processes.

At least one of the first drive speed R1 and the second drive speed D2 may be fixed within a specific time period, or may be changeable within a specific time period as necessary. The first drive speed R1 and the second drive speed R2 may be identical to or different from each other according to time points. If the first washing portion 10 and the second washing portion 20 perform the same process at the same time, the first drive speed R1 and the second drive speed R2 may be substantially identical to each other or may be changed in similar ways to each other.

As described later, the first drive speed R1 may include at least one of a rotation speed of a first washing tub 11, a rotation speed of a first pulsator (not shown) rotatably movable at a bottom surface of the first washing tub 11, a rotation speed of a first washing rod (not shown) formed in a rod shape within the first washing tub 11, and a rotation-shaft's rotation speed (hereinafter referred to as a rotation speed of a first driver 13) produced by a first driver 13. The second drive speed R2 may include at least one of a rotation speed of a second washing tub 21, a rotation speed of a second pulsator (not shown) rotatably movable at a bottom surface of the second washing tub 21, a rotation speed of a second washing rod (not shown) formed in a rod shape within the second washing tub 21, and/or a rotation-shaft's rotation speed (hereinafter referred to as a rotation speed of a second driver 23) produced by a second driver 23. Although the above-mentioned embodiment has disclosed one example including two washing portions 10 and 20 for convenience of description and better understanding of the present disclosure, the number of the washing portions 10 and 20 is not limited thereto. If necessary, it should be noted that the present disclosure may further include three or more washing portions. At least two of the three or four washing portions may be disposed vertically and/or may be disposed parallel to each other.

The respective washing portions 10 and 20 will hereinafter be described with reference to the attached drawings.

In accordance with an embodiment, the first washing portion 10 may include a first washing tub 11 in which laundry is introduced and washed, and a first driver 13 configured to supply necessary rotational force either to the first washing tub 11 or to various kinds of components installed in the first washing tub 11.

The first washing tub 11 may be formed in a substantially cylindrical shape, and may be provided to allow laundry to be introduced therein and washed.

The first washing tub 11 may be provided to be rotatable at a fixed rotation speed or a variable rotation speed with respect to a predetermined shaft. In this case, the first washing tub 11 may also be implemented using a drum rotatable with respect to a rotation shaft that faces in a lateral direction (e.g., a transverse direction), in a vertical direction (e.g., a longitudinal direction), or in an upper direction. In accordance with an embodiment, the first washing tub 11 may include a fixed tub (not shown) and a rotary tub (not shown). In response to rotation of the rotary tub, laundry stored in the first washing tub 11 may be washed.

And, a pulsator and/or rotary rod rotatable at a fixed or variable rotation speed may be installed in the first washing tub 11. By rotation of the pulsator and/or the rotary rod, laundry introduced in the first washing tub 11 may also be washed.

The first driver 13 may be provided to supply rotational force needed for the first washing tub 11. In this case, the first driver 13 may directly transmit rotational force to the rotary tub, the pulsator, the rotary rod, the drum, or the like, or may indirectly transmit rotational force to the rotary tub, the pulsator, the rotary rod, the drum, or the like using various devices such as a gear and the like.

The first driver 13 may be implemented using a first motor. The first motor may generate rotational force needed to rotate the rotary tub, pulsator, rotary rod, drum, or the like. In this case, the motor may be implemented as a predetermined motor, for example, an alternating current (AC) motor or a brushless direct current (BLDC) motor, generally used in washing machines.

The first driver 13 may operate to maintain or change a rotation speed under control of the controller 30. Therefore, rotational movement of the first washing tub 11 or constituent components (e.g., a rotary tub, a pulsator, a rotary rod, etc.) installed in the first washing tub 11 may be carried out under control of the controller 30. In accordance with structure types of the washing machine, the rotation speed of the first driver 13 may be identical to or different from that of the rotary tub, the pulsator, the rotary rod, the drum, or the like. In accordance with an embodiment, the first washing portion 10 may further include at least one of a first feedback signal generator 19-1 to generate a feedback signal to a control signal received from the controller 30, a first-driver operation sensing portion 19-2 to detect a rotation speed of the first driver 13, and a first-washing-tub operation sensing portion 19-3 to detect an internal operation of the first washing tub 11.

The first feedback signal generator 19-1 may detect and measure a control signal generated from the controller 30, and may generate a feedback signal corresponding to the control signal generated from the controller 30. In this case, the control signal from the controller 30 may include information regarding a rotation speed of the first driver 13. The first feedback signal generator 19-1 may generate a feedback signal in the same manner as in the control signal, or may generate a feedback signal by amplifying the control signal or by performing predefined filtering of the control signal. The feedback signal generated by the first feedback signal generator 19-1 may be transmitted to the controller 30. The controller 30 may determine a rotation speed designated for the first driver 13 on the basis of the feedback signal, and may thus determine a first drive speed of the first washing portion 10.

The first-driver operation sensing portion 19-2 may detect a rotation speed of the first driver 13, may convert the detection result into an electrical signal, and may transmit the resultant electrical signal to the controller 30. The first-driver operation sensing portion 19-2 may be implemented using a rotation speed sensor. The rotation speed sensor may include a tachometer, an encoder, a toothed-wheel sensor, etc. The tachometer may include, for example, an electrical tachometer and/or a photoelectric tachometer. The encoder may include, for example, an optical incremental encoder, an optical absolute encoder, a magnetic encoder, and/or a resolver. The first-driver operation sensing portion 19-2 may be implemented using various sensors capable of detecting a rotation speed of the first driver 13.

The first-washing-tub operation sensing portion 19-3 may detect a rotation speed of the first washing tub 11, and may output an electrical signal corresponding to the detection result to the controller 30. The first-washing-tub operation sensing portion 19-3 may be implemented using a predetermined rotation speed sensor in the same manner as in the first-driver operation sensing portion 19-2. The rotation speed sensor may include, for example, a tachometer, an encoder, a toothed-wheel sensor, etc.

In accordance with an embodiment, the first washing portion 10 may include one of the first feedback signal generator 19-1, the first-driver operation sensing portion 19-2, and the first-washing-tub operation sensing portion 19-3, or may include at least two of the first feedback signal generator 19-1, the first-driver operation sensing portion 19-2, and the first-washing-tub operation sensing portion 19-3.

The controller 30 may properly acquire information (e.g., the first drive speed R1) related to the operation of the first washing portion 10 using at least one of the first feedback signal generator 19-1, the first-driver operation sensing portion 19-2, and the first-washing-tub operation sensing portion 19-3.

In accordance with an embodiment, the second washing portion 20 may include the second washing tub 21 in which laundry is introduced and washed, and a second driver 23 configured to supply necessary rotational force either to the second washing tub 21 or to various kinds of components installed in the second washing tub 21.

The second washing tub 21 may be formed in a substantially cylindrical shape that is substantially identical to or different from the first washing tub 11, and may be provided to receive and wash laundry.

The second washing tub 21 may be provided to be rotatable at a fixed rotation speed or a variable rotation speed with respect to a predetermined shaft. In this case, the second washing tub 21 may also be implemented using a drum rotatable with respect to a rotation shaft that faces in a lateral direction (e.g., a transverse direction), in a vertical direction (e.g., a longitudinal direction), or in an upper direction.

In accordance with an embodiment, the second washing tub 21 may include a fixed tub (not shown) and a rotary tub (not shown). In response to rotation of the rotary tub, laundry stored in the second washing tub 21 may be washed.

In accordance with an embodiment, a pulsator may be installed in the second washing tub 21, or the rotary rod may be installed in the second washing tub 21. By rotation of the pulsator and/or the rotary rod, laundry introduced to the second washing tub 21 may be washed.

The second driver 23 may be provided to supply power needed for the second washing tub 21. In detail, the second driver 23 may directly or indirectly transmit rotational force to the rotary tub, the pulsator, the rotary rod, the drum, or the like.

The second driver 23 may be implemented using a second motor in the same manner as in the first driver 13. The second motor of the second driver 23 may be implemented using a motor generally used in washing machines.

The second driver 23 may operate to maintain or change a rotation speed under control of the controller 30. Therefore, operation of the second washing tub 21 may be controlled by the second driver 23. In this case, the rotation speed of the second driver 23 may be identical to or different from that of the rotary tub, the pulsator, the rotary rod, or the drum.

In accordance with an embodiment, the second washing portion 20 may include a second feedback signal generator 29-1 to generate a feedback signal to a control signal received from the controller 30, a second-driver operation sensing portion 29-2 to detect a rotation speed of the second driver 23, and a second-driver operation sensing portion 29-3 to detect an internal operation of the second washing tub 21.

The controller 30 may acquire information (e.g., the second drive speed R2) related to the operation of the second washing portion 20 using at least one of the second feedback signal generator 29-1, the second-driver operation sensing portion 29-2, and the second-washing-tub operation sensing portion 29-3.

The second feedback signal generator 29-1, the second-driver operation sensing portion 29-2, and the second-washing-tub operation sensing portion 29-3 may be substantially identical to the first feedback signal generator 19-1, the first-driver operation sensing portion 19-2, and the first-washing-tub operation sensing portion 19-3 of the first washing portion 10, respectively, and as such a detailed description thereof will herein be omitted for convenience of description.

In accordance with an embodiment, the second washing portion 20 may include one of the second feedback signal generator 29-1, the second-driver operation sensing portion 29-2, and the second-washing-tub operation sensing portion 29-3, or may include at least two of the second feedback signal generator 29-1, the second-driver operation sensing portion 29-2, and the second-washing-tub operation sensing portion 29-3.

In order to detect or measure the respective drive speeds (i.e., the first drive speed R1 and the second drive speed R2), the first washing portion 10 and the second washing portion 20 may be implemented either using homogeneous signal generators or sensors or using heterogeneous signal generators or sensors. For example, the first washing portion 10 may include the first-driver operation sensing portion 19-2 to detect the operation of the first driver 13, and the second washing portion 20 may include the second-driver operation sensing portion 29-2 to detect the operation of the second driver 23 in the same manner as in the first washing portion 10. In another example, the first washing portion 10 may include the first-driver operation sensing portion 19-2 to detect the operation of the first driver 13, and the second washing portion 20 may include the second feedback signal generator 29-1 to generate a feedback signal to the control signal generated from the controller 30 in a different way from the first washing portion 10.

The controller 30 may perform a variety of operations related to the washing machine 1, and may control the washing machine 1 or overall operation of constituent components of the washing machine 1. The controller 30 may include at least one processor implemented by at least one or two semiconductor chips or associated constituent components. The at least one processor may be implemented using a central processing unit (CPU), a micro controller unit (MCU), a microprocessor (Micom), an application processor (AP), an electronic control unit (ECU), and/or other electronic devices capable of processing a variety of operations and generating various control signals.

The controller 30 may perform predetermined operation, processing, and control operation by driving an application (referred to as a program or application (App)) stored in a storage portion 40, or may also perform predetermined operation, processing, and control operation using a predefined application. Here, the application may be pre-written by a designer and then stored in the storage portion 40, or may be acquired or updated through an electronic software distribution (ESD) network that is accessible by the washing machine 1 over a wired or wireless communication network.

In accordance with an embodiment, the controller 30 may generate at least one of a control signal of the first driver 13 and a control signal of the second driver 23, may transmit the generated control signal to at least one of the first driver 13 and the second driver 23, and may thus control at least one of the first driver 13 and the second driver 23. In accordance with an embodiment, the controller 30 may transmit a control signal for controlling at least one of the first driver 13 and the second driver 23 to at least one switch (not shown) for connecting at least one of the first driver 13 and the second driver 23 to a power-supply portion 49, such that at least one switch may electrically connect the power-supply portion 49 to at least one of the first driver 13 and the second driver 23, or may sever electrical connection between the power-supply portion 49 and at least one of the first driver 13 and the second driver 23, thereby controlling at least one of the first driver 13 and the second driver 23.

By the above-mentioned scheme, at least one of the first washing portion 10 corresponding to the first driver 13 and the second washing portion 20 corresponding to the second driver 23 may operate under control of the controller 30.

In other words, at least one of the first washing portion 10 and the second washing portion 20 may perform at least one of a washing process, a rinsing process, and a dehydration process upon receiving a control signal from the controller 30. The controller 30 may transmit the above-mentioned control signal to at least one of the first driver 13 and the second driver 23 through a circuit, a conductive wire, and/or a wireless communication network.

The controller 30 may receive information (i.e., the first drive speed R1 of the first washing portion 10) related to the operation of the first washing portion 10 from at least one of the first feedback signal generator 19-1, the first-driver operation sensing portion 19-2, and the first-washing-tub operation sensing portion 19-3, and may also receive information (i.e., the second drive speed R2 of the second washing portion 20) related to the operation of the second washing portion 20 from at least one of the second feedback signal generator 29-1, the second-driver operation sensing portion 29-2, and the second-washing-tub operation sensing portion 29-3. The controller 30 may receive the above-mentioned information through a circuit, a conductive wire, and/or a wireless communication network.

In accordance with an embodiment, the controller 30 may generate a control signal of the second washing portion 20 on the basis of information related to the operation of the first washing portion 10, or may generate a control signal of the first washing portion 10 on the basis of information related to the operation of the second washing portion 20. In detail, the controller 30 may control maintenance or adjustment of the second drive speed R2 of the second washing portion 20 on the basis of the first drive speed R1 of the first washing portion 10, or may control maintenance or adjustment of the first drive speed R1 of the first washing portion 10 on the basis of the second drive speed R2 of the second washing portion 20. A detailed description thereof will hereinafter be given.

The storage portion 40 may store a program or information needed to operate the controller 30 therein. In detail, the storage portion 40 may store applications related to operation, processing, and control action of the controller 30, may store various kinds of information needed for the above-mentioned operation, processing, and control action, or may store various kinds of information acquired by the operation processing result or the control result. For example, the storage portion 40 may store a first target speed, a second target speed, and first to seventh reference speeds as electrical signal formats or various other available formats.

The storage portion 40 may be implemented using magnetic disk storage media, such as a hard disk or a floppy disk, may be implemented using optical media, such as a magnetic tape, a compact disk (CD) or a digital versatile disc (DVD), may be implemented using magneto-optical media such as a floptical disk, or may be implemented using semiconductor storage devices, such as a read only memory (ROM), a random access memory (RAM), a secure digital (SD) card, a flash memory, and a solid state drive (SSD).

A user interface (UI) 45 may receive various kinds of commands or information related to the washing machine 1 from a user, and may visually or audibly provide various kinds of information related to the washing machine 1. For example, the UI 45 may receive a command for starting operation of the first washing portion 10, a command for starting operation of the second washing portion 20, a command for starting a predetermined process (e.g., a dehydration process) executable by the first washing portion 10, or a command for starting a predetermined process (e.g., a dehydration process) executable by the second washing portion 20. The UI 45 may independently display a current operation state of the first washing portion 10 or a current operation state of the second washing portion 20, or may audibly output the current operation state of the first washing portion 10 or the current operation state of the second washing portion 20.

The power-supply portion 49 may supply necessary power to constituent components of the washing machine 1. The power-supply portion 49 may be a commercial power source, or may be implemented using at least one battery embedded in the washing machine 1.

A method for allowing the first washing portion 10 or the second washing portion 20 to sequentially perform a washing process, a rinsing process, and a dehydration process will hereinafter be described with reference to FIG. 2.

Figure 2:
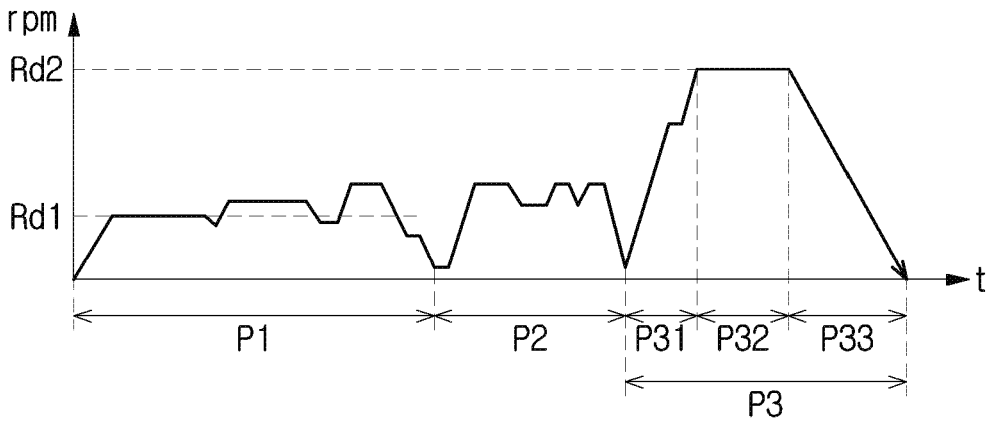
FIG. 2 is a graph illustrating an example of change in a drive speed of a first washing portion or a second washing portion in washing and dehydration processes of the washing machine according to an embodiment of the present disclosure.

FIG. 2 is a graph illustrating an example of change in a drive speed of the first washing portion or the second washing portion in the washing and dehydration processes of the washing machine. In FIG. 2, an X axis may denote a time, and a Y axis may denote a rotation speed, for example, revolutions per minute (RPM).

Referring to FIG. 2, the first washing portion 10 or the second washing portion 20 may sequentially perform a washing process P1, a rinsing process P2, and a dehydration process P3 according to a control signal of the controller 30.

In more detail, when the user inputs an operation start command of the first washing portion 10 or the second washing portion 20 by manipulating the UI 45, the first washing portion 10 or the second washing portion 20 may start operation and then perform the washing process P1. In this case, the first washing portion 10 or the second washing portion 20 may be controlled in a manner that the first drive speed or the second drive speed is changed according to a predefined pattern, is identical to a predetermined speed (Rd1), or closely approximates the predetermined speed (Rd1).

Upon completion of the washing process P1, the first washing portion 10 or the second washing portion 20 may sequentially perform the rinsing process P2. The rinsing process P2 may be omitted as necessary.

Upon completion of the rinsing process P2, the first washing portion 10 or the second washing portion 20 may sequentially perform the dehydration process P3. During the dehydration process P3, the first drive speed of the first washing portion 10 or the second drive speed of the second washing portion 20 may abruptly increase (P31), may increase to a drive speed Rd2 needed for dehydration, and may be kept at the drive speed Rd2 (P32). Upon completion of the dehydration process P3, the first drive speed or the second drive speed may be reduced and arrive at zero '0' (P33).

If the above-mentioned processes P1 to P3 are carried out, an average rpm RM2 in the dehydration process P3 may be generally higher than an average rpm RM1 in the washing process P1. In other words, during the dehydration process P3, the first washing tub 11, the pulsator, the rotary rod, etc.

of the first washing portion 10, or the second washing tub 21, the pulsator, the rotary tub, etc. of the second washing portion 20 may rotate at a higher speed than in the washing process P1. As a result, overall vibration of the washing machine 1 may occur according to situations. Specifically, when the first washing portion 10 and the second washing portion 20 simultaneously perform the dehydration process P3, both the first washing portion 10 and the second washing portion 20 operate at a high drive speed, such that vibration of the washing machine 1 is greatly increased, resulting in greater inconvenience of use.

In order to prevent such vibration, the controller 30 may control the drive speed of at least one of the first washing portion 10 and the second washing portion 20 on the basis of the drive speed of the other washing portion 10 or 20.

A method for allowing the controller 30 to control the washing machine 1 will hereinafter be described with reference to FIGS. 3 to 10. For convenience of description and better understanding of the present disclosure, a method for controlling the washing machine 1 on the basis of the situation in which the first washing portion 10 and the second washing portion 20 simultaneously perform the dehydration process will hereinafter be described with reference to the attached drawings. However, the scope or spirit of the present disclosure is not limited thereto, and the control method to be described later may also be applied to other situations in which vibration may occur according to operations of the first washing portion 10 and the second washing portion 20. For example, in a first case in which the first washing portion 10 performs the washing process or the rinsing process or the second washing portion 20 performs the dehydration process, or in a second case in which the first washing portion 10 performs the dehydration process or the second washing portion 20 performs the washing process or the rinsing process, the control method to be described later may be equally applied to the first case and the second case, or may be partially modified and then applied to the first case and the second case as necessary.

Figure 3:
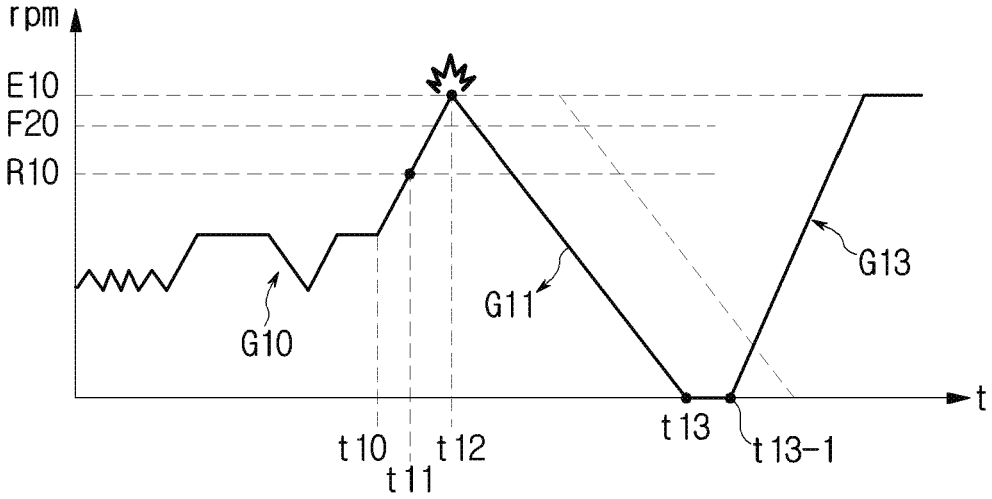
FIG. 3 is a conceptual diagram illustrating a method for controlling a rotation speed of a second washing tub according to an embodiment of the present disclosure.

FIG. 3 is a conceptual diagram illustrating a method for controlling a rotation speed of the second washing tub according to an embodiment of the present disclosure.

Figure 4:
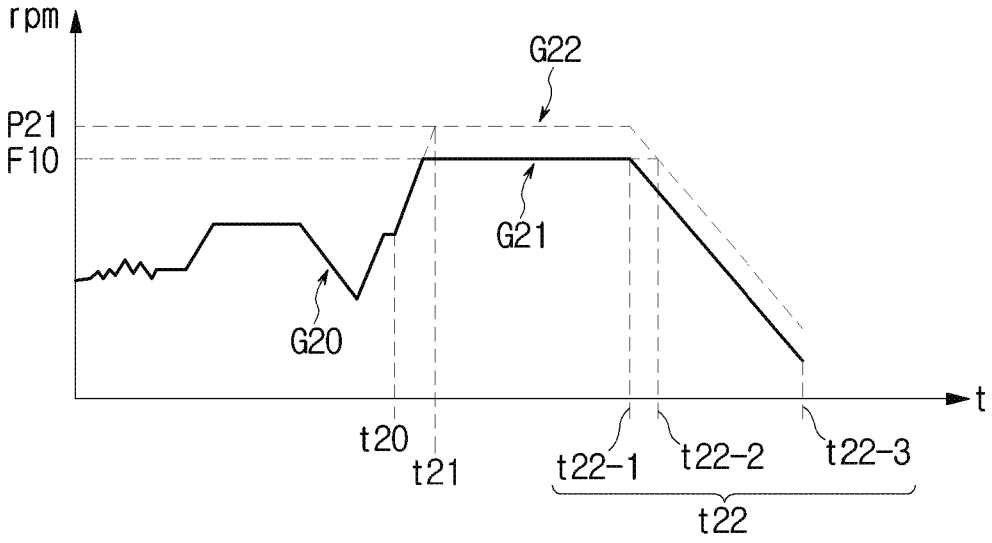
FIG. 4 is a graph illustrating an example of change in a rotation speed of a first washing tub according to an embodiment of the present disclosure.

FIG. 4 is a graph illustrating an example of change in a rotation speed of the first washing tub according to an embodiment of the present disclosure. In FIGS. 3 and 4, an X axis may denote a time, and a Y axis may denote a rotation speed, for example, RPM.

Referring to FIG. 3, after the second washing portion 20 performs the washing process at a variable or fixed second drive speed R2 having a predefined pattern (G10), the second washing portion 20 may perform the rinsing process under control of the controller 30 as necessary, and may start the dehydration process at a first dehydration start time t10.

If the dehydration process starts operation, the second drive speed R2 of the second washing portion 20 may gradually increase.

Referring to FIG. 4, the first washing portion 10 may lead or lag the operation start time of the second washing portion 20, or may start operation at the same time that the second washing portion 20 starts operation. The first washing portion 10 may perform the washing process at a variable or fixed first drive speed R1 having a predefined pattern (G20). Thereafter, the first washing portion may start the dehydration processes at a second dehydration start time t20 (G21 and G22). Here, the second dehydration start time t20 may be identical to or different from the first dehydration start time t10. In the latter case, the second dehydration start time t20 may lead or lag the first dehydration start time t20 as necessary.

At one time point (t11 of FIG. 3 and t21 of FIG. 4) in a time section in which the second drive speed R2 of the second washing portion 20 increases, the first drive speed R1 of the first washing portion 10 may be identical to a predefined first reference speed F10 (G21), or may be higher than the first reference speed F10 (G22). The first reference speed F10 may be arbitrarily defined by a designer or user. The first reference speed F10 may be defined by, for example, an arbitrary value that is equal to or higher than a half of the second reference speed F20. In detail, for example, although the first reference speed F10 may be set to 500 rpm or an approximate value thereto, the scope or spirit of the present disclosure is not limited thereto.

Upon receiving a signal from at least one of the first feedback signal generator 19-1, the first-driver operation sensing portion 19-2, and the first-washing-tub operation sensing portion 19-3, the controller 30 may determine whether the first drive speed R1 of the first washing portion 10 is identical to the first reference speed F10 (G21) or may be higher than the first reference speed F10 (G22).

When the first drive speed R1 of the first washing portion 10 is identical to the first reference speed F10 (G21) or is higher than the first reference speed F10 (G22), the controller 30 may compare the second drive speed R2 of the second washing portion 20 with the second reference speed F20. The second reference speed F20 may be arbitrarily defined according to selection of the designer or user. For example, the second reference speed F20 may also be defined as a maximum drive speed executable by the second washing portion 20 or an approximate value thereto. For example, although the second reference speed F20 may be set to 800 rpm or an approximate value thereto, the scope or spirit of the present disclosure is not limited thereto. The second reference speed F20 may be set not only to 800 rpm or an approximate value thereto, but also to an arbitrary value selectable by the designer or user.

If the first drive speed R10 at a specific time t11 or t21 is less than the second reference speed F20 as shown in FIG. 2, the controller 30 may increase the second drive speed R2 of the second washing portion 20 to a first target speed E10. In other words, until the second washing tub 21, the rotary tub, the pulsator, or the rotary rod of the second washing portion 20 rotates at the first target speed E10, a rotation speed of the second washing tub 21, the rotary tub, the pulsator, or the rotary rod may increase.

Upon receiving an electrical signal from at least one of the second feedback signal generator 29-1, the second-driver operation sensing portion 29-2, and the second-washing-tub operation sensing portion 29-3, the controller 30 may determine whether the second drive speed R2 reaches the first target speed E10.

Although the first target speed E10 is higher than the second reference speed F20 as shown in FIG. 2, the scope or spirit of the first target speed E10 is not limited thereto. In accordance with an embodiment, the first target speed E10 may be identical to the second reference speed F20 or may be less than the second reference speed F20. The first target speed E10 may be set to a maximum drive speed executable by the second washing portion 20 according to selection of the designer or user, or may be set to an approximate value less than the maximum drive speed. In accordance with an embodiment, the first target speed E10 may be set to 800 rpm or an approximate value thereto, the scope or spirit of the present disclosure is not limited thereto.

When the second drive speed R2 reaches the first target speed E10, the controller 30 may control the second driver 23 in a manner that the second drive speed R2 is gently or abruptly reduced. In this case, the second drive speed R2 may be reduced to zero '0' or an approximate value thereto (G11).

For example, when the second drive speed R2 reaches the first target speed E10, the controller 30 may shut off the power applied to the second driver 23 and/or may control a brake system (not shown) coupled to a rotation shaft of the second driver 23, such that the controller 30 may reduce the second drive speed R2.

As described above, the above-mentioned method for increasing the second drive speed R2 to the first target speed E10, and reducing the second drive speed R2 to zero '0' either as soon as the second drive speed R2 reaches the first target speed E10 or within a predetermined time from the time at which second drive speed R2 reaches the first target speed E10 may be referred to as a touch-spin scheme.

While the second washing portion 20 is controlled according to the touch-spin scheme, the first washing portion 10 may remain at the same speed as the first reference speed F10 or may continuously operate at a speed P21 higher than the first reference speed F10. As described above, since the second drive speed R2 of the second washing portion 20 reaches zero '0' by the touch-spin scheme at a time t13, only the first washing portion 10 may operate at a predetermined speed during a predetermined time. As a result, vibration encountered when the first washing portion 10 and the second washing portion simultaneously operate at a high drive speed may be removed or reduced.

In accordance with an embodiment, after completion of the dehydration process of the first washing portion 10 at a time t22, if the first drive speed R1 starts decreasing at a specific time t22-1 or t22-2, if the first drive speed R1 is currently decreasing, or if the first drive speed R1 reaches zero '0' or an approximate value thereto at a specific time t22-3 (G21 and G22), the second washing portion 20 starts operation under control of the controller 30, such that the second drive speed R2 may increase again (G13). An increase start time t13-1 of the second drive speed R2 may include deceleration start times t22-1 and t22-2 of the first drive speed R1, a specific time t22-3 at which the first drive speed R2 reaches zero '0' or an approximate value thereto, or an arbitrary time in the range t22 including the times t22-1, t22-2, and t22-3. Accordingly, the second washing portion 20 may perform a necessary dehydration process.

Figure 5:
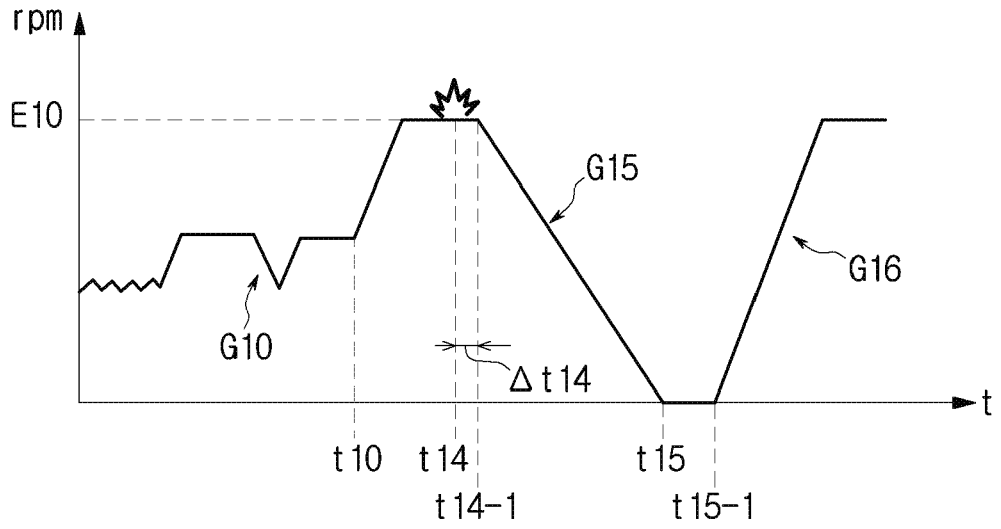
FIG. 5 is a graph illustrating an example of a method for controlling a rotation speed of a second washing tub according to an embodiment of the present disclosure.

FIG. 5 is a graph illustrating an example of a method for controlling a rotation speed of the second washing tub according to an embodiment of the present disclosure.

Figure 6:
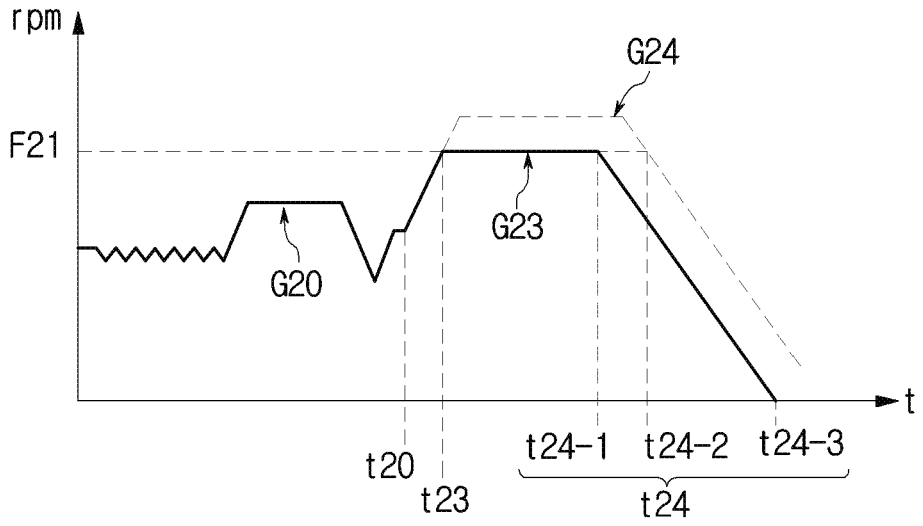
FIG. 6 is a graph illustrating an example of change in a rotation speed of a first washing tub according to an embodiment of the present disclosure.

FIG. 6 is a graph illustrating an example of change in a rotation speed of the first washing tub according to an embodiment of the present disclosure. In the same manner as described above, in FIGS. 5 and 6, an X axis may denote a time, and a Y axis may denote a rotation speed, for example, RPM.

Referring to FIG. 5, the second washing portion 20 may perform the washing process at a variable or fixed second drive speed R2 having a predefined pattern (G10). The second washing portion 20 may start the dehydration process at a first dehydration start time t10. If the dehydration process starts at the first dehydration start time t10, the second drive speed R2 may increase a predefined speed, for example, a first target speed E10, and the second washing portion 20 may remain the first target speed E10 or may operate at an approximate speed to the first target speed E10. Although the first target speed E10 is set to 800 rpm or an approximate value thereto as described above, the scope or spirit of the present disclosure is not limited thereto.

Referring to FIG. 6, the first washing portion 10 may also perform the washing process G20 along with the second washing portion 20. In this case, the washing process G20 of the first washing portion 10 may lead or lag a start time of the washing process G10 of the second washing portion 20, or may start at the same time that the washing process G10 of the second washing portion 20 starts operation. The first washing portion 10 may start the dehydration process G23 or G24 at a second dehydration start time t20. As described above, the second dehydration start time t20 may be identical to or different from the first dehydration start time t10.

Upon receiving an electrical signal from at least one of the first feedback signal generator 19-1, the first-driver operation sensing portion 19-2, and the first-washing-tub operation sensing portion 19-3, the controller 30 may decide the first drive speed R1. Upon receiving an electrical signal by at least one of the second feedback signal generator 29-1, the second-driver operation sensing portion 29-2, and the second-washing-tub operation sensing portion 29-3, the controller 30 may decide the second drive speed R2 of the second washing portion 20.

As can be seen from FIG. 6, the controller 30 may determine whether the first drive speed R1 of the first washing machine 10 is identical to a predefined third reference speed F21 (G23) or is higher than the third reference speed F21 (G24). In this case, the third reference speed F21 may be defined by the user or designer. For example, although the third reference speed F21 may be set to 500 rpm or an approximate value thereto, the scope or spirit of the present disclosure is not limited thereto, and the third reference speed F21 may be defined in various ways according to selection of the designer or user. The third reference speed F21 may also be set to a speed identical to the first reference speed F10.

At a specific time t23, if the first drive speed R1 is identical to the third reference speed F21 (G23) or is higher than the third reference speed F21 (G24), the controller 30 may compare the second drive speed R2 with a second reference speed F20.

If the second drive speed R2 is identical to the second reference speed F20 or is higher than the second reference speed F20, the controller 30 may control the second washing portion 20 to temporarily stop the dehydration process (G15). Stoppage of the dehydration process of the second washing portion 20 may be achieved by shutting off the power supplied to the first driver 13 of the second washing portion 20. Upon completion of the dehydration process, the second drive speed R2 may decrease (G15). Here, although the second reference speed F20 is set to 800 rpm or an approximate value thereto as described above, the scope or spirit of the present disclosure is not limited thereto. The second reference speed F20 may be set to a speed identical to the first target speed E10.

In accordance with an embodiment, the second drive speed R2 may be reduced from a specific time t14 identical to a time point t23 at which the first drive speed R1 of the first washing portion 10 is identical to a third reference speed F21 (G23) or is higher than the third reference speed F21, or may also be reduced from a time t14-1 after lapse of a predetermined time Δt14 from the specific time t14.

Accordingly, the second drive speed R2 of the second washing portion 20 is reduced (G15).

During stoppage of the operation of the second washing portion 20, the first washing portion 10 may continuously perform the dehydration process (G23 and G24). Therefore, vibration encountered when both the first washing portion and the second washing portion 20 perform the dehydration process may be removed or reduced. As shown in FIG. 6, the second washing portion 20 may finish or end the dehydration process at a specific time t24-3.

In accordance with an embodiment, the second washing portion 20 may start operation under control of the controller 30. In this case, the second washing portion 20 may start operation either at an deceleration start time t24-1 or t24-2 of the first drive speed R1, at a time t24-3 at which the first drive speed R1 reaches zero '0' or an approximate value thereto, or at an arbitrary time in the range t24 including the times t24-1, t24-2, and t24-3. Therefore, the second drive speed R2 may increase (G16), and the second washing portion 20 may perform the residual dehydration process.

Figure 7:
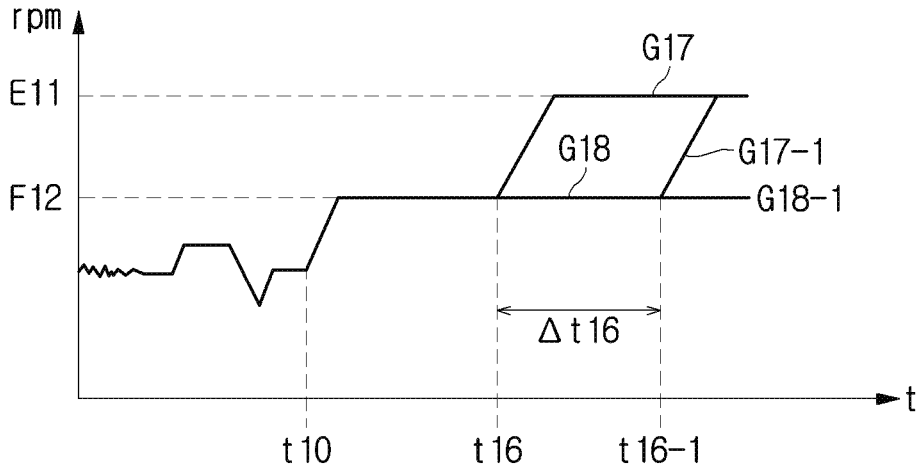
FIG. 7 is a graph illustrating an example of a method for controlling a rotation speed of a second washing tub according to an embodiment of the present disclosure.

FIG. 7 is a graph illustrating an example of a method for controlling a rotation speed of the second washing tub according to an embodiment of the present disclosure.

Figure 8:
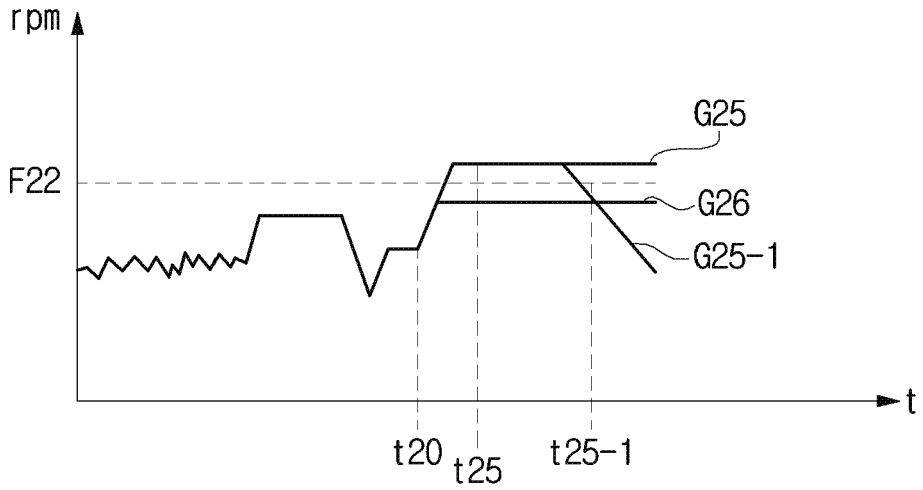
FIG. 8 is a graph illustrating an example of change in a rotation speed of a first washing tub according to an embodiment of the present disclosure.

FIG. 8 is a graph illustrating an example of change in a rotation speed of the first washing tub according to an embodiment of the present disclosure. In the same manner as described above, in FIGS. 7 and 8, an X axis may denote a time, and a Y axis may denote a rotation speed, for example, RPM.

Referring to FIGS. 7 and 8, the second washing portion 20 and the first washing portion 10 may perform the dehydration process at a first dehydration start time t10 and a second dehydration start time t20, respectively. As described above, the first dehydration start time t10 may be identical to or different from the second dehydration start time t20.

When the dehydration process starts operation, the second drive speed R2 of the second washing portion 20 may increase to a fourth reference speed F12, and may maintain the fourth reference speed F12. The fourth reference speed F12 may be arbitrarily defined by the designer or user. For example, the fourth reference speed F12 may be set to 500 rpm or an approximate value thereto. However, the scope or spirit of the present disclosure is not limited thereto, and the fourth reference speed F12 may be defined in various ways according to selection of the designer or user. The first drive speed R1 of the first washing portion 10 may also increase in response to beginning of the dehydration process.

After the second drive speed R2 is kept at the fourth reference speed F12, the controller 30 may decide the first drive speed R1 of the first washing portion 10 upon receiving an electrical signal from at least one of the first feedback signal generator 19-1, the first-driver operation sensing portion 19-2, and the first-washing-tub operation sensing portion 19-3.

Sequentially, the controller 30 may compare the first drive speed R1 with a predefined fifth reference speed F22. Here, the fifth reference speed F22 may be arbitrarily defined by the user or designer. For example, the fifth reference speed F22 may be set to 500 rpm or an approximate value thereto. However, the scope or spirit of the present disclosure is not limited thereto. In accordance with an embodiment, the fifth reference speed F22 may also be identical to the fourth reference speed F12.

As shown in FIG. 8, if the first drive speed R1 is equal to or less than the fifth reference speed F22 at a time t25 (G26), the second drive speed R2 may increase to a second target speed E11 or an approximate speed thereto (G17). Here, the second target speed E11 may be set to a maximum drive speed executable by the second washing portion 20 according to selection of the designer or user, or may also be set to a speed that is less than the maximum drive speed or an approximate speed thereto. For example, the second target speed E11 may be set to 800 rpm or an approximate speed thereto. However, the scope or spirit of the present disclosure is not limited thereto. The second target speed E11 may be identical to the first target speed E10.

In accordance with an embodiment, the controller 30 may control the first driver 13 in a manner that the second drive speed R2 maintains the second target speed E11 during a predefined maintenance time. Here, the predefined maintenance time may be arbitrarily defined by the user or designer, and may include, for example, 1 minute, 2 minutes, or other arbitrary times. The controller 30 may determine whether the predefined maintenance time elapses using a separate clock embedded in the washing machine.

After lapse of the predefined maintenance time, the controller 30 may control the second drive speed R2 to decrease. In this case, the controller 30 may also control the second driver 23 in a manner that the second drive speed R2 is set to the fourth reference speed F12 or an approximate value thereto.

As can be seen from FIG. 8, when the first drive speed R2 is higher than the fifth reference speed F22 at the time t25 (G25), the second washing portion 20 may be controlled to maintain the second drive speed R2 (G18).

After lapse of a predefined decision pending period Δt16 from a specific time at which the second drive speed R2 is kept at the fourth reference speed F12, the controller 30 may re-determine the first drive speed R1 of the first washing portion 10 on the basis of an electrical signal received from at least one of the first feedback signal generator 19-1, the first-driver operation sensing portion 19-2, and the first-washing-tub operation sensing portion 19-3. Here, the decision pending period Δt16 may be arbitrarily defined either by the user or designer or by the controller 30. The decision pending period Δt16 may include, for example, 3 seconds, 10 seconds, 1 minute, or other arbitrary times. The decision pending period Δt16 may be changeable or may be fixed.

In accordance with an embodiment, at an arbitrary time after the second drive speed R2 maintains the fourth reference speed F12, the controller 30 may also re-determine the first drive speed R1 of the first washing portion 10 on the basis of an electrical signal received from at least one of the first feedback signal generator 19-1, the first-driver operation sensing portion 19-2, and the first-washing-tub operation sensing portion 19-3.

The controller 30 may re-compare the newly-decided first drive speed R1 with the fifth reference speed F22. If the first drive speed R1 is still higher than the fifth reference speed F22 even at a time t16-1 or t25-1 where the decision pending period Δt16 elapses (G25), the second washing portion 20 may be controlled to maintain the second drive speed R2 (G18-1).

In contrast, as shown in FIG. 8, if the first drive speed R1 is equal to or higher than the fifth reference speed F22 at the time t16-1 or t25-1 (G25-1) where the decision pending period Δt16 elapses due to completion of the dehydration process or the like, the second drive speed R2 may increase to the second target speed E11 as shown in FIG. 7 (G17-1). As described above, the controller 30 may control the second washing portion 20 in a manner that the second drive speed R2 maintains the second target speed E11 during the predefined time period. After lapse of the predefined time period, the second drive speed R2 may be decreased. In this case, the second drive speed R2 may also be reduced to the fourth reference speed F12 or an approximate value thereto.

As described above, the controller 30 may periodically or arbitrarily perform decision of the first drive speed R1 and adjustment of the second drive speed R2 in response to the decided first drive speed R1, and may also continuously perform the above-mentioned decision and adjustment operations during the dehydration process.

As described above, the speed R2 of the second washing portion 20 may be controlled in response to the speed R1 of the first washing portion 10. In detail, when the first drive speed R1 is higher than a predetermined reference (i.e., the fifth reference speed), the controller 30 may control the second drive speed R2 to be relatively reduced. When the first drive speed R1 is less than the predetermined reference, the controller 30 may control the second drive speed R2 to be relatively increased. As a result, vibration caused by simultaneous operation of the first washing portion 10 and the second washing portion 20 may be relatively reduced.

Figure 9:
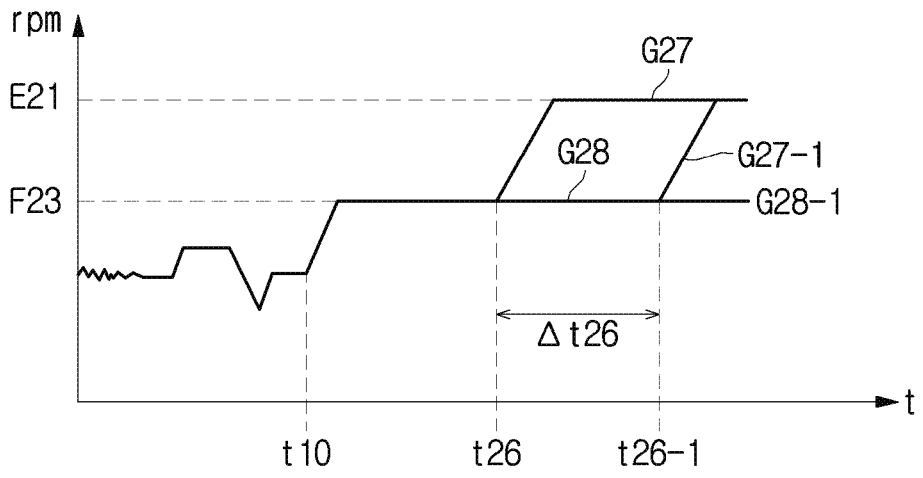
FIG. 9 is a graph illustrating an example of a method for controlling a rotation speed of a first washing tub according to an embodiment of the present disclosure.

FIG. 9 is a graph illustrating an example of a method for controlling a rotation speed of the first washing tub according to an embodiment of the present disclosure.

Figure 10:
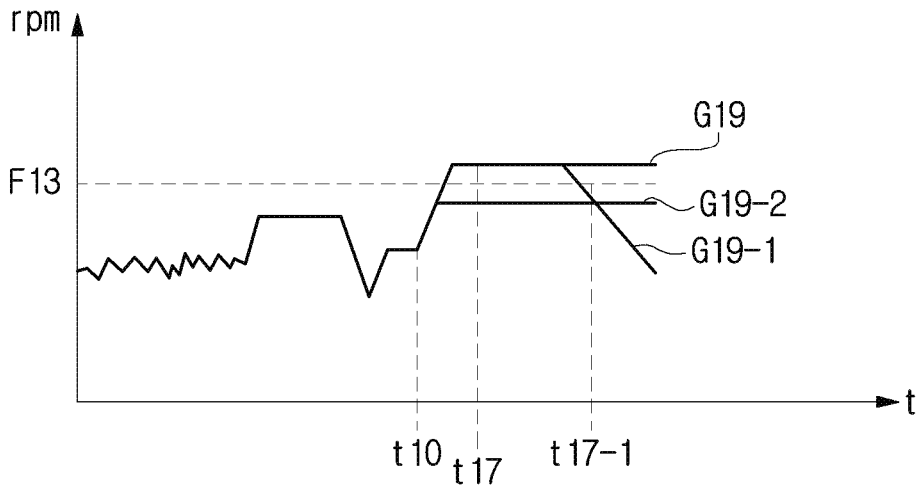
FIG. 10 is a graph illustrating an example of change in a rotation speed of a second washing tub according to an embodiment of the present disclosure.

FIG. 10 is a graph illustrating an example of change in a rotation speed of the second washing tub according to an embodiment of the present disclosure. In the same manner as described above, in FIGS. 9 and 10, an X axis may denote a time, and a Y axis may denote a rotation speed, for example, RPM.

The above-mentioned operations may also be applied to a method for adjusting the first drive speed R1 of the first washing portion 10 on the basis of the second drive speed R2 of the second washing portion 20.

Referring to FIGS. 9 and 10, the second washing portion 20 and the first washing portion 10 may perform the dehydration process at the dehydration start time t10 and another dehydration start time t20, respectively.

In accordance with an embodiment, when the dehydration process starts, the second drive speed R2 of the second washing portion 20 may increase according to a predetermined pattern according to beginning of the dehydration process as shown in FIG. 10, the first drive speed R1 of the first washing portion 10 may increase to a sixth reference speed F23 and be kept at the sixth reference speed F23 as shown in FIG. 9. The sixth reference speed F23 may be arbitrarily defined by the designer or user, and may be set to, for example, 500 rpm or an approximate value thereto. The sixth reference speed F23 may also be identical to the fourth reference speed F12 as necessary.

While the first drive speed R2 maintains the sixth reference speed F23, the controller 30 may determine the second drive speed R2 of the second washing portion 20 using an electrical signal received from at least one of the second feedback signal generator 29-1, the second-driver operation sensing portion 29-2, and the second-washing-tub operation sensing portion 29-3.

Sequentially, the controller 30 may compare the second drive speed R2 with the seventh reference speed F13.

As shown in FIG. 10, if the second drive speed R2 is identical to the seventh reference speed F13 or is less than the seventh reference speed F13 at a time t17 or t26 (G19-2), the controller 30 may control the first washing portion 10 in a manner that the first drive speed R1 increases to a third target speed E21 or an approximate value thereto (G27). In this case, the third target speed E21 may be arbitrarily defined according to selection of the designer or user. For example, the third target speed E21 may be set to a maximum drive speed executable by the first washing portion 10 according to selection of the designer or user, or may also be set to a speed that is less than the maximum drive speed or an approximate speed thereto. For example, although the third target speed E21 may be set to 800 rpm or an approximate value thereto, the scope or spirit of the present disclosure is not limited thereto. The third target speed E21 may also be identical to at least one of the first target speed E10 and the second target speed E11.

In accordance with an embodiment, the first drive speed R1 may be controlled to maintain the third target speed E21 during a predefined maintenance time. As described above, the predefined maintenance time may be arbitrarily defined by the user or designer, and may include, for example, 1 minute, 2 minutes, or other arbitrary times.

After lapse of the predefined maintenance time, the first drive speed R1 may be controlled to decrease in the same manner as described above. In this case, the first drive speed R1 may also be reduced to a sixth reference speed F23 or an approximate value thereto.

As can be seen from FIG. 10, if the second drive speed R2 is higher than a seventh reference speed F22 at the time t17 or t26 (G19), the first drive speed R1 of the first washing portion 10 may be controlled to maintain the seventh reference speed F23 (G28).

After lapse of a decision pending period Δt26 from a specific time at which the first drive speed R1 maintains the sixth reference speed F22, the controller 30 may re-determine the second drive speed R2 of the second washing portion 20 on the basis of an electrical signal received from at least one of the second feedback signal generator 29-1, the second-driver operation sensing portion 29-2, and the second-washing-tub operation sensing portion 29-3, and may re-compare the re-determined second drive speed R2 with the seventh reference speed F13. Here, the decision pending period Δt26 may be arbitrarily defined by the user or designer.

If the second drive speed R2 is higher than the seventh reference speed F13 at a time t17-1 or t26-1 where the decision pending period Δt26 elapses (G19) the first drive speed R1 of the first washing portion 10 may continuously maintain the seventh reference speed F23 (G28-1).

In contrast, if the second drive speed R2 is identical to the seventh reference speed F13 or is less than the seventh reference speed F13 at the time t17-1 or t26-1 where the decision pending period Δt26 elapses (G19-1), the first drive speed R1 may increase to the third target speed E21 (G27-1). In this case, the first drive speed R1 maintains the third target speed E21 during a predefined maintenance time. After lapse of the predefined maintenance time, the first drive speed R1 may be reduced to a predefined speed, for example, a seventh reference speed F23.

The above-mentioned operations may be periodically carried out or may be carried out at an arbitrary time. During the dehydration process, the above-mentioned operations may be continuously repeated.

In accordance with an embodiment, the controller 30 may be provided to selectively perform the control process of the second drive speed R2 as shown in FIGS. 7 and 8, or the control process of the first drive speed R1 as shown in FIGS. 9 and 10. In this case, the controller 30 may persistently monitor a change (or variation) in the first drive speed R1 and the second drive speed R2, and may decide which one of the first drive speed R1 and the second drive speed R2 first reaches a reference speed, such that the controller 30 may determine which one of the control process of the second drive speed R2 of FIGS. 7 and 8 and the control process of the first drive speed R1 of FIGS. 9 and 10 will be carried out on the basis of the decision result. For example, if the second drive speed R2 first reaches the fourth reference speed F12 at a time earlier than the first drive speed R1, the controller 30 may decide to adjust the second drive speed R2 on the basis of the first drive speed R1. In contrast, if the first drive speed R2 first reaches the sixth reference speed F23 at a time earlier than the second drive speed R2, the controller 30 may decide to adjust the first drive speed R1 on the basis of the second drive speed R2, and may control one of the first washing portion 10 and the second washing portion 20 according to the decision result.

A washing machine according to another embodiment of the present disclosure will hereinafter be described with reference to FIGS. 11 to 24.

Figure 11:
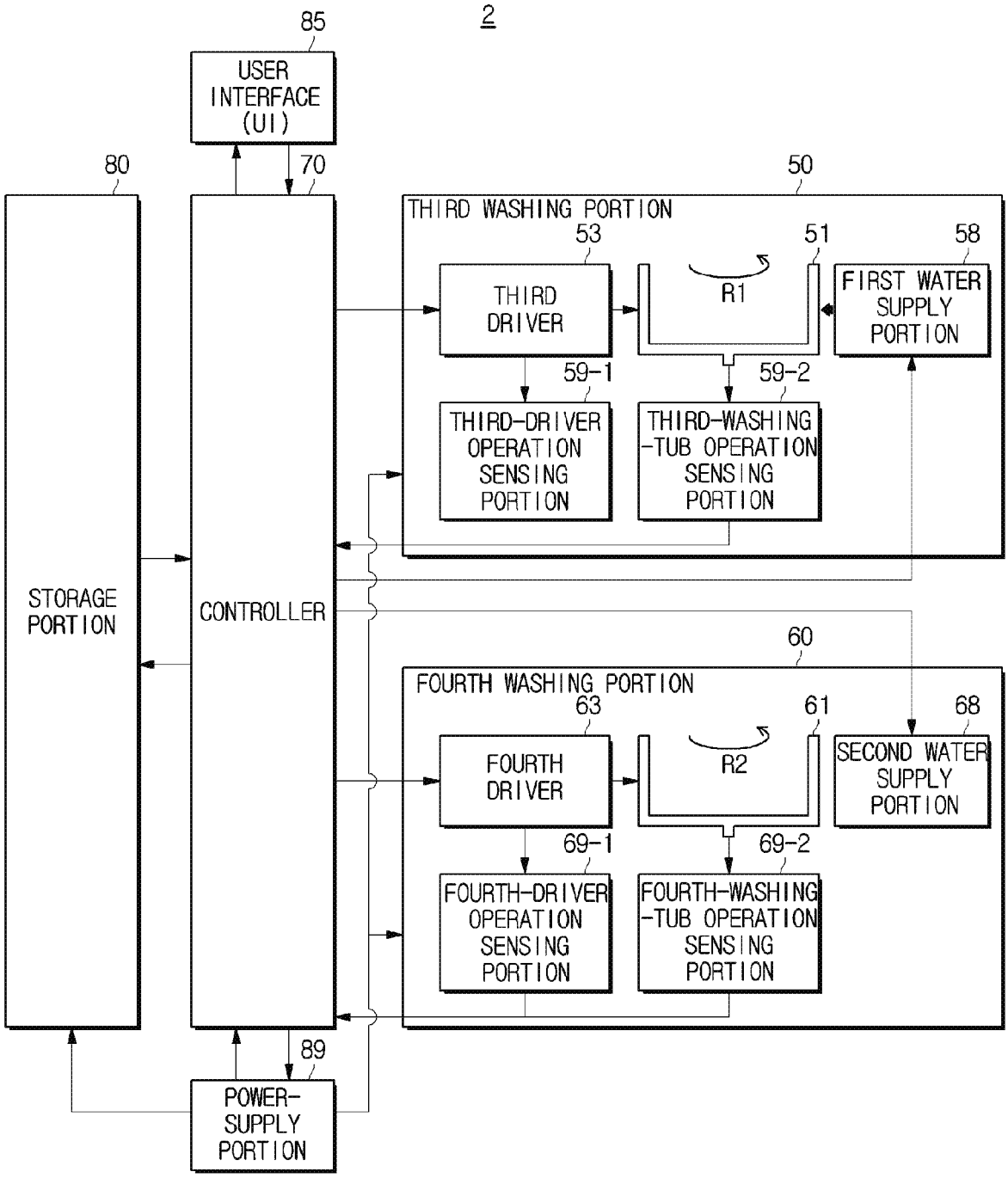
FIG. 11 is a block diagram illustrating a washing machine according to an embodiment of the present disclosure.

FIG. 11 is a block diagram illustrating a washing machine according to an embodiment of the present disclosure.

Referring to FIG. 11, a washing machine 2 may include a third washing portion 50 to wash laundry, and a fourth washing portion 60 to wash laundry. The third washing portion 50 and the fourth washing portion 60 may operate independently from each other, or may operate in a cooperative manner. The third washing portion 50 and the fourth washing portion 60 may operate at the same time or at different times.

As described above, the third washing portion 50 and the fourth washing portion 60 may be provided to perform at least one of a washing process, a rising process, and a dehydration process. All or some of the washing process, the rinsing process, and the dehydration process may be carried out according to selection of the designer or user. The respective processes may also be sequentially carried out as necessary.

The processes executable by the third washing portion 50 may be identical to or different from the processes executable by the fourth washing portion 60. Alternatively, some parts of the processes executable by the third washing portion 50 may be identical to or those of the fourth washing portion 60, and some other parts of the processes executable by the third washing portion 50 may be different from those of the fourth washing portion 60. At a specific time, processes executable by the third washing portion 50 may be identical to or different from processes executable by the fourth washing portion 60. Further, when the third washing portion 50 and the fourth washing portion 60 start the same process at substantially the same time, the third washing portion 50 and the fourth washing portion 60 may end the started process at the same time or at different times.

In accordance with an embodiment, as described above, the third washing portion 50 and the fourth washing portion 60 may be implemented using heterogeneous schemes or using homogeneous schemes.

Although each of the third washing portion 50 and the fourth washing portion 60 may be implemented using one of a drum-type washing machine, an eddy-current type washing machine, and an agitation-type washing machine, the scope or spirit of the present disclosure is not limited thereto, various schemes may be applied to the third washing portion 50 and the fourth washing portion according to selection of the designer.

The third washing portion 50 and the fourth washing portion 60 may be arranged in various ways. For example, the third washing portion 50 and the fourth washing portion 60 may be vertically arranged in a line in a manner that one of the third washing portion 50 and the fourth washing portion 60 is arranged in an upward direction of the other one, or may be arranged in parallel to each other. The third washing portion 50 and the fourth washing portion 60 may also be arranged in various ways considerable by the designer.

The third washing portion 50 and the fourth washing portion 60 may be integrated into one body such that it is impossible to disconnect the third washing portion 50 and the fourth washing portion 60 from each other. The third washing portion 50 and the fourth washing portion 60 may be manufactured independently from each other, and then coupled to each other or assembled with each other.

The third washing portion 50 may be operable at a third drive speed R1, and the fourth washing portion 60 may be operable at a fourth drive speed R2. In this case, each drive speed R1 or R2 may include at least one of a rotation speed of the washing tub 51 or 61, a rotation speed of a pulsator (not shown) rotatably installed at the bottom surface of the washing tub 51 or 61, a rotation speed of a rotary rod (not shown) installed in the washing tub 51 or 61 and formed in a rod shape, and a rotation speed generated by the driver 53 or 63.

As described above, although the washing machine 2 of FIG. 11 includes only two washing portions 50 and 60 for convenience of description and better understanding of the present disclosure, the scope or spirit of the present disclosure is not limited thereto, the number of washing portions 50 and 60 may be only one or at least three according to selection of the designer.

In accordance with an embodiment, the third washing portion 50 may include a third washing tub 51 in which laundry is introduced and washed, and a third driver 53 configured to supply necessary rotational force either to the third washing tub 51 or to various kinds of components installed in the third washing tub 51. The fourth washing portion 60 may include a fourth washing tub 61 in which laundry is introduced and washed, and a fourth driver 63 configured to supply necessary rotational force either to the fourth washing tub 61 or to various kinds of components installed in the fourth washing tub 61. The third driver 53 and the fourth driver 63 may be implemented using a predetermined motor in the same manner as in the first driver 13 and the second driver 23.

Detailed structures and operations of the third washing tub 51, the fourth washing tub 61, the third driver 53, and the fourth driver 63 shown in FIG. 11 may be substantially identical to those of the first washing tub 11, the second washing tub 21, the first driver 13, and the second driver 23 shown in FIG. 1, and as such a detailed description thereof will herein be omitted for convenience of description.

The third washing portion 50 may further include at least one of a third-driver operation sensing portion 59-1 to acquire information related to the operation of the third driver 53, and a third-washing-tub operation sensing portion 59-2 to detect an internal operation of the third washing tub 51. The third washing portion 50 may further include a first water supply portion 58 to supply wash water and/or rinse water to the third washing tub 51.

Likewise, the fourth washing portion 60 may further include at least one of a fourth-driver operation sensing portion 69-1 to acquire information related to the operation of the fourth driver 63, and a fourth-washing-tub operation sensing portion 69-2 to detect an internal operation of the fourth washing tub 61. The fourth washing portion 60 may further include a second water supply portion 68 to supply wash water and/or rinse water to the fourth washing tub 61.

The third-driver operation sensing portion 59-1 may detect the operation of the third driver 53, may output the detection result as an electrical signal, and may output the electrical signal to the controller 70.

In accordance with an embodiment, the third-driver operation sensing portion 59-1 may include at least one of a rotation speed sensor to detect a rotation speed of the third driver 53, a voltage measurement device to measure the magnitude of voltage applied to the third driver 53, and a current measurement device to measure the magnitude of current applied to the third driver 53.

The rotation speed sensor may include a tachometer, an encoder, a toothed-wheel sensor, etc. The rotation speed sensor may detect a rotation speed of the drive shaft (e.g., 241 of FIG. 27) of the third driver 53, and may output the detection result.

The voltage measurement device may be implemented either using a voltage measurement circuit designed to measure a direct current (DC) or AC voltage or using an electronic component such as a voltmeter. The voltage measurement device may be installed in a circuit or conductive line for electrically interconnecting the power-supply portion 89 and the third driver 53, may output an electrical signal corresponding to the magnitude of voltage applied to the third driver 53, and may output the electrical signal to the controller 70. In accordance with an embodiment, the voltage measurement device may measure a voltage of a feedback signal corresponding to the electrical signal applied to the third driver 53, and may measure the magnitude of voltage applied to the third driver 53. In accordance with an embodiment, the voltage measurement device may also be provided to measure a voltage applied to a DC link circuit.

The current measurement device may be implemented either using a predetermined current measurement circuit designed to measure the magnitude of a DC or AC current or using an electronic component such as an amperemeter. The current measurement device may be installed in a circuit or conductive line for electrically interconnecting the power-supply portion 89 and the third driver 53, and may measure the current applied to the third driver 53. The measurement result may be configured as an electrical signal and then applied to the controller 70. In accordance with an embodiment, the current measurement device may measure a feedback current corresponding to the current applied to the third driver 53 such that it may be possible to measure the current applied to the third driver 53.

The fourth-driver operation sensing portion 69-1 may detect the operation of the fourth driver 63, may output the detection result as an electrical signal, and may output the electrical signal to the controller 70. In the same manner as in the third-driver operation sensing portion 59-1, in accordance with an embodiment, the fourth-driver operation sensing portion 69-1 may include at least one of a rotation speed sensor to detect a rotation speed of the fourth driver 63, a voltage measurement device to measure the magnitude of voltage applied to the fourth driver 63, and a current measurement device to measure the magnitude of current applied to the fourth driver 63.

At least one of the third-driver operation sensing portion 59-1 and the fourth-driver operation sensing portion 69-1 may be omitted as necessary. In other words, the washing machine may include only the third-driver operation sensing portion 59-1 or may include only the fourth-driver operation sensing portion 69-1.

The third-washing-tub operation sensing portion 59-2 may detect vibration of the third washing tub 51. In detail, when vibration occurs in the third washing tub 51 during rotation or agitation operation of the third washing tub 51, the third-washing-tub operation sensing portion 59-2 may detect the vibration, may output the detection result as an electrical signal, and may output the electrical signal to the controller 70.

The third-washing-tub operation sensing portion 59-2 may include, for example, a micro electro mechanical system (MEMS) sensor. The MEMS sensor may be implemented using a piezoresistive scheme or using a capacitive scheme. The third-washing-tub operation sensing portion 59-2 may also be implemented using a vibration sensor based on a piezoelectric acceleration scheme or using a vibration sensor based on a cantilever vibration scheme. A variety of vibration sensors considerable by the designer may be applied to the third-washing-tub operation sensing portion 59-2.

Figure 12:
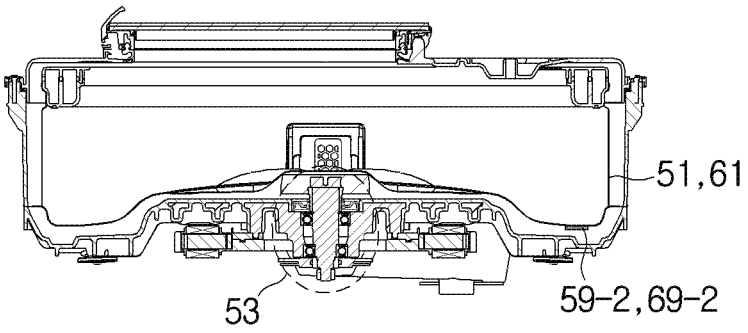
FIG. 12 is a view illustrating an example of a sensing portion mounted to a washing tub according to an embodiment of the present disclosure.

FIG. 12 is a view illustrating an example of a sensing portion mounted to a washing tub according to an embodiment of the present disclosure.

Figure 16:
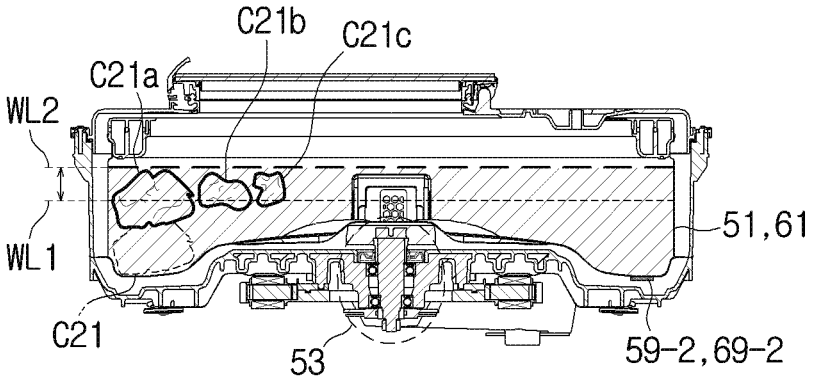
FIG. 16 is a second diagram illustrating an example of a method for changing a water level of wash water stored in a washing tub according to an embodiment of the present disclosure.

Referring to FIG. 12, a third-washing-tub operation sensing portion 59-2 may be in contact with a third washing tub 51 or may be adjacent to the third washing tub 51. In this case, the third-washing-tub operation sensing portion 59-2 may be installed, for example, at a side surface or bottom surface of the third washing tub 51. The third-washing-tub operation sensing portion 59-2 may be installed at an inner surface of the third washing tub 51 having a washing space therein, or may be installed at an outer surface of the third washing tub 51 as shown in FIG. 16. In accordance with an embodiment, the third-washing-tub operation sensing portion 59-2 may be spaced apart from the third driver 53 by a predetermined distance either at a boundary of the third washing tub 51 or at a peripheral region of the boundary, such that the third-washing-tub operation sensing portion 59-2 may not detect vibration directly received from the third driver 53 due to operation of the third driver 53 or may detect a relatively smaller number of vibrations and at the same time more properly detect vertical vibrations of the third washing tub 51.

The fourth-washing-tub operation sensing portion 69-2 may detect vibration of the fourth washing tub 61. In detail, the fourth-washing-tub operation sensing portion 69-2 may detect vibration generated by the fourth washing tub 61 during rotation or agitation of the fourth washing tub 61, may output the detection result as an electrical signal, and may output the electrical signal to the controller 70.

In the same manner as in the third-washing-tub operation sensing portion 59-2, the fourth-washing-tub operation sensing portion 69-2 may include a MEMS sensor, a vibration sensor based on a piezoelectric acceleration scheme, or a vibration sensor based on a cantilever vibration scheme. As shown in FIG. 12, the fourth-washing-tub operation sensing portion 69-2 may be in contact with the fourth washing tub 61 or may be located adjacent to the fourth washing tub 61. For example, the fourth-washing-tub operation sensing portion 69-2 may be installed in an inner direction or an outer direction of either a side surface or a bottom surface of the third washing tub 51.

The third-washing-tub operation sensing portion 59-2 and the fourth-washing-tub operation sensing portion 69-2 may be implemented using homogeneous vibration detection sensors or heterogeneous vibration detection sensors.

In accordance with an embodiment, one of the third-washing-tub operation sensing portion 59-2 and the fourth-washing-tub operation sensing portion 69-2 may be omitted as necessary.

Upon receiving a control signal from the controller 70, the first water supply portion 58 may supply wash water and/or rinse water to a washing space provided in the third washing tub 51. Upon receiving a control signal from the controller 70, the second water supply portion 68 may be provided to supply a necessary amount of wash water and/or rinse water to the washing space provided in the fourth washing tub 61.

For example, the water supply portion 58 or 68 may include a pipe connected to an external water source, a storage space to temporarily or non-temporarily store water supplied from the water source, a pump to pump the water stored in the storage space to the washing tub 51 or 61, a pipe to connect the storage space to the washing tub 51 or 61 in a manner that wash water may flow through the pipe, and a valve formed in the pipe so as to supply wash water to the washing tub 51 or 61 or to prevent wash water from being supplied to the wash tub 51 or 61. Some parts of the above-mentioned constituent components may be omitted by the designer. The water supply portion 58 or 68 may further include not only the above-mentioned components but also various other components as necessary.

In accordance with an embodiment, the washing machine 2 may include a water supply portion 58 in the washing tub 51, and may include a water supply portion 68 in the washing tub 61. In this case, the water supply portion 58 may supply wash water to the washing tub 51, and the water supply portion 68 may supply wash water to the washing tub 61.

In accordance with another embodiment, the washing machine 2 may include a single water supply portion (not shown) capable of selectively supplying wash water to the washing tub 51 or 61. In this case, a component, such as a valve, is installed in a pipe that is disposed between the wash water supply portion and each washing tub 51 or 61 so as to allow wash water to flow therethrough, such that the wash water may be supplied to at least one washing tub 51 and 61.

The controller 70 may be provided to perform various processes needed to operate the washing machine 2 as well as to control operations of various components installed in the washing machine 2. The controller 70 may include at least one processor implemented by at least one or two semiconductor chips and associated components. The at least one processor may be implemented using a CPU, a MCU, a Micom, an AP, an ECU, and/or other electronic devices capable of processing a variety of operations and generating various control signals.

The controller 70 may also perform predefined operation, processing, and control operation by driving an application (called 'App') stored in a storage portion 80. Here, the application may be pre-written by the designer and then stored in the storage portion 80, or may be acquired or updated through an ESD network that is accessible by the washing machine 2 over a wired or wireless communication network.

The controller 70 may acquire information regarding the presence or absence of vibration in the third washing tub 51 from at least one of the third-driver operation sensing portion 59-1 and the third-washing-tub operation sensing portion 59-2, or may acquire information regarding the presence or absence of vibration in the fourth washing tub 61 from at least one of the fourth-driver operation sensing portion 69-1 and the fourth-washing-tub operation sensing portion 69-2.

The controller 70 may generate at least one of a control signal of the third driver 53 and a control signal of the fourth driver 63, and may transmit the generated control signal to the corresponding component, i.e., at least one of the third driver 53 and the fourth driver 63. Therefore, at least one of the third driver 53 and the fourth driver 63 may operate by a control signal of the controller 70. Therefore, at least one of the third washing portion 50 and the fourth washing portion 60 may perform at least one of the washing process, the rinsing process, and the dehydration process upon receiving a control signal from the controller 70.

The controller 70 may transmit and/or receive data or control signals to and from the aforementioned components through a circuit, a conductive line, or a wireless communication network.

The controller 70 may decide the presence or absence of vibration on the basis of an electrical signal received from the driver operation sensing portion 59-1 or 69-1 and/or the washing-tub operation sensing portion 59-2 or 69-2, such that the controller 70 may decide the presence or absence of unbalance in the washing tub 51 or 61 as described later, and may control the third driver 53 and/or the fourth driver 63 on the basis of the decision result. A detailed description thereof will be given later.

The storage portion 80 may be provided to store programs or information needed to operate the controller 70. In detail, the storage portion 80 may store an application related to operation, processing, and control operation, various kinds of information needed for the aforementioned operation, processing, and control operation, or various kinds of information acquired from the aforementioned operation, processing or control operation. For example, the storage portion 80 may store a reference value indicating the number of detected vibrations to be described later.

The storage portion 80 may be implemented using a magnetic disk storage medium, a magnetic tape, an optical recording medium, a magneto-optical recording medium, a semiconductor storage medium, or the like.

A UI 85 may receive various commands or information related to the washing machine 2 from a user, and may visually or audibly provide the user with various kinds of information related to the washing machine 2. For example, the UI 85 may receive various commands related to operations of the third washing portion 50 and/or the fourth washing portion 60, and may visually and/or audibly output the information related to the third washing portion 50 and/or the fourth washing portion 60.

A power-supply portion 89 may supply necessary power to respective components of the washing machine 2, for example, the third driver 53 or the fourth driver 63. The power-supply portion 89 may include a commercial power source and/or at least one battery embedded in the washing machine 2.

Figure 13:
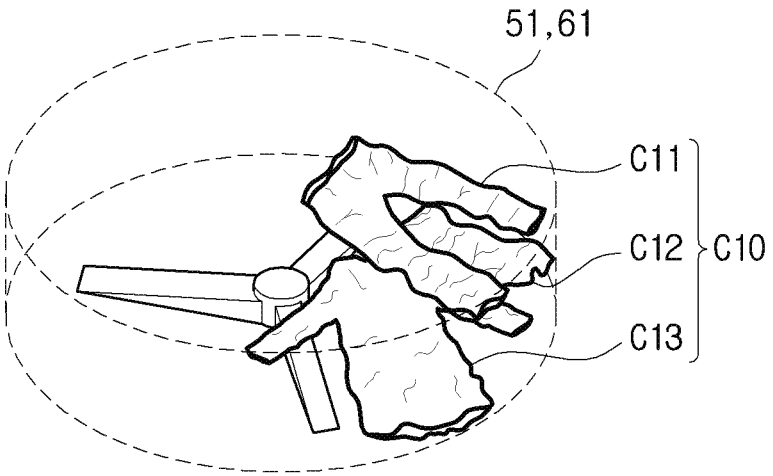
FIG. 13 is a view illustrating a situation in which an unbalance occurs in a washing tub according to an embodiment of the present disclosure.

FIG. 13 is a view illustrating a situation in which unbalance occurs in a washing tub according to an embodiment of the present disclosure.

Referring to FIG. 13, the third washing tub 51 and a fourth washing tub 61 may be rotatably movable by a third driver 53 and a fourth driver 63, respectively, such that laundry introduced into the third washing tub 51 and laundry introduced into the fourth washing tub 61 may be washed, rinsed, and/or dehydrated by the third washing tub 51 and the fourth washing tub 61, respectively. While the third washing tub 51 or the fourth washing tub 61 performs the washing or rinsing process, laundry C10 (C11, C12, and C13) introduced into the third washing tub 51 or the fourth washing tub 61 may be movable in the third washing tub 51 or the fourth washing tub 61. In detail, while the third washing tub 51 or the fourth washing tub 61 performs rotation or agitation action, a water current may occur in wash water or rinse water stored in the third washing tub 51 or the fourth washing tub 61, and laundry C10 (C11, C12, and C13) moves by the water current and collides with each other. As a result, the laundry C10 (C11, C12, and C13) may be washed. However, the laundry C10 (C11, C12, and C13) moving in the washing tub may be entangled or lumped for various reasons, such that a considerably large amount of laundry C10 (C11, C12, and C13) may be concentrated at a specific zone or position as shown in FIG. 13. As described above, when laundry C10 (C11, C12, and C13) is concentrated at a specific zone or position, unbalance may occur in the washing tub. The unbalance may cause excessive vibration of the third washing tub 51 or the fourth washing tub 61 in which laundry C10 (C11, C12, and C13) is introduced, resulting in occurrence of noise and damage of internal components. If such unbalance continuously occurs, efficiency of the washing process, the rinsing process, and/or the dehydration process may be deteriorated.

This unbalance may be detected by the driver operation sensing portion 59-1 or 69-1 and/or the washing-tub operation sensing portion 59-2 or 69-2. The controller 70 may determine the presence or absence of unbalance in the washing tub on the basis of the detection result, and may control the washing machine 2 such that unbalance is removed from the washing machine 2.

In accordance with an embodiment, the controller 70 may determine the presence or absence of unbalance on the basis of not only a rotation speed of the driver 53 or 63 detected by the driver operation sensing portion 59-1 or 69-1, but also the magnitude of voltage or current applied to the driver 53 or 63.

Figure 14:
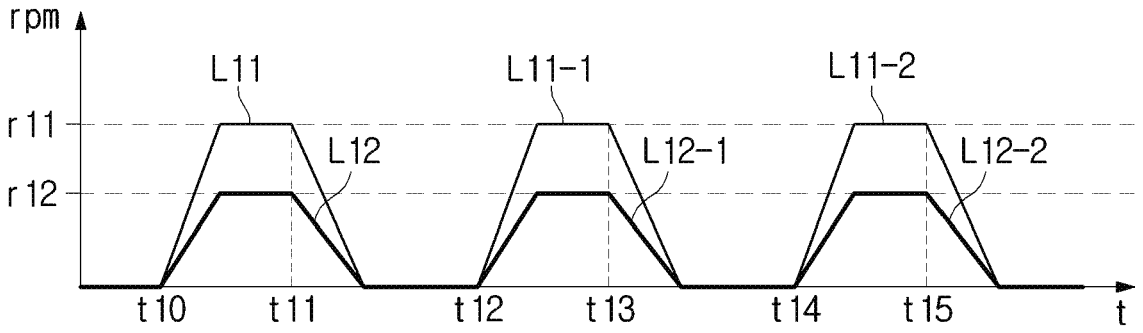
FIG. 14 is a graph illustrating an example of change in a rotation speed of a driver when unbalance occurs in a washing tub according to an embodiment of the present disclosure.

FIG. 14 is a graph illustrating an example of change in a rotation speed of the driver when unbalance occurs in the washing tub according to an embodiment of the present disclosure.

Referring to FIG. 14, under a general situation, a rotation speed of the driver 53 or 63 may increase to a target rotation speed R11, may be kept at the target rotation speed R11 during a predetermined time (t10 to t11, t12 to t13, and t14 to t15), may be reduced to zero '0' or an approximate value thereto, and may then be kept at zero '0' or an approximate value thereto during a predetermined time (t11 to t12, and t13 to t14), such that the aforementioned operations are repeatedly carried out (L11, L11-1, and L11-2).

If an unbalance occurs in the washing tub 51 or 61 as shown in FIG. 13, load applied to the driver 53 or 63 by the concentrated laundry C10 (C11, C12, and C13) unavoidably increases. As a result, although the same voltage or current is applied to the driver 53 or 63, a rotation speed of the driver 53 or 63 may increase only to a rotation speed R12 relatively lower than the target rotation speed R11 (L12, L12-1, and L12-3). In other words, a rotation speed of the driver 53 or 63 may be relatively lower than an expected speed.

The controller 70 may determine the presence or absence of unbalance in the washing tub 51 or 61 using the aforementioned fact that the rotation speed of the driver 53 or 63 is relatively deteriorated by occurrence of such unbalance.

For example, if the third-driver operation sensing portion 59-1 corresponding to the third driver 53 includes a rotation speed sensor, the controller 70 may compare the rotation speed of the third driver 53, that is received from the third-driver operation sensing portion 59-1, with a predefined reference rotation speed (e.g., a target rotation speed R11). For example, the predefined reference rotation speed may refer to a target rotation speed R11, an approximate rotation speed thereto, or a rotation speed that is theoretically or experimentally/empirically defined by the designer to determine the presence or absence of unbalance. If the rotation speed of the third driver 53 is equal to the reference rotation speed and/or is less than the reference rotation speed, the controller 70 may determine the presence of unbalance in the third washing tub 51 corresponding to the third driver 53. In contrast, if the rotation speed of the third driver 53 is higher than the reference rotation speed, the controller 70 may determine the absence of unbalance in the third washing tub 51 corresponding to the third driver 53.

Likewise, if the fourth-driver operation sensing portion 69-1 corresponding to the fourth driver 63 is implemented as a rotation speed sensor, the controller 70 may compare the rotation speed of the fourth driver 63, that is received from the fourth-driver operation sensing portion 69-1, with a predefined reference rotation speed, and may determine the presence or absence of unbalance in a fourth washing tub 61 corresponding to the fourth driver 63 according to the result of comparison.

In accordance with another embodiment, if the third-driver operation sensing portion 59-1 includes a voltage measurement device, the controller 70 may determine the presence or absence of unbalance on the basis of the measured voltage received from the third-driver operation sensing portion 59-1. In detail, if unbalance occurs in the third washing tub 51, load applied to a motor unavoidably increases, such that a voltage applied to the motor may relatively increase. Therefore, the controller 70 may compare the voltage measured by the voltage measured by the third-driver operation sensing portion 59-1 with a reference voltage. If the measured voltage is higher than a reference voltage, the controller 70 may determine the presence or absence of unbalance in the third tub 51. In contrast, if the measured voltage is less than the reference voltage, the controller 70 may determine the absence of unbalance in the third washing tub 51.

Likewise, if the fourth-driver operation sensing portion 69-1 includes a voltage measurement device, the controller 70 may compare a measured voltage received from the fourth-driver operation sensing portion 69-1 with a reference voltage, and may determine the presence or absence of unbalance in a fourth washing tub 61 according to the result of comparison.

In accordance with another embodiment, if the third-driver operation sensing portion 59-1 includes a current measurement device, the controller 70 may determine the presence or absence of unbalance on the basis of a measured current received from the third-driver operation sensing portion 59-1. In the same manner as in the above voltage measurement case, if unbalance occurs in the third washing tub 51, a current applied to a motor may relatively increase, such that the controller 70 may determine the presence or absence of unbalance on the basis of the resultant current. For example, the controller 70 may compare the current measured by the third-driver operation sensing portion 59-1 with a reference current, and may determine the presence of unbalance in the third washing tub 51 when the measured current is higher than the reference current. In contrast, if the measured current is not higher than the reference current, the controller 70 may determine the absence of unbalance in the third washing tub 51.

Likewise, if the fourth-driver operation sensing portion 69-1 includes a current measurement device, the controller 70 may compare the measured current received from the fourth-driver operation sensing portion 69-1 with a reference current, and may determine the presence or absence of unbalance in the fourth washing tub 61.

In accordance with another embodiment, the controller 70 may determine the presence or absence of unbalance in the washing tub 51 or 61 using vibration of the washing tub 51 or 61, that are detected by the washing-tub operation sensing portion 59-2 or 69-2. If unbalance occurs in the washing machine as shown in FIG. 13, the number of vibrations of the washing tub 51 or 61 is increased more than in a general case. The controller 70 may determine the presence or absence of unbalance on the basis of the increased number of vibrations of the washing tub 51 or 61.

For example, the controller 70 may determine whether the magnitude of vibration (e.g., the number of vibrations) detected by the washing-tub operation sensing portion 59-2 or 69-2 is higher than the magnitude of predefined reference vibration (e.g., a reference number of vibrations). Here, the reference vibration may be theoretically or empirically/experimentally defined. In this case, the controller 70 may compare the magnitude of vibration received from the third-washing-tub operation sensing portion 59-2 with the magnitude of reference vibration so as to determine the presence or absence of unbalance in the third washing tub 51 according to the result of comparison, and/or may compare the magnitude of vibration received from the fourth-washing-tub operation sensing portion 69-2 with the magnitude of reference vibration so as to determine the presence or absence of unbalance in the fourth washing tub 61. The operation for deciding the presence or absence of unbalance in the third washing tub 51 and the operation for deciding the presence or absence of unbalance in the fourth washing tub 61 may be carried out independently from each other. If it is determined that the detected vibration magnitude is identical to and/or higher than the reference vibration magnitude, the controller 70 may determine the presence or absence of unbalance in response to the determination result. In other words, if the detected vibration magnitude is less than the predefined reference vibration magnitude, the controller 70 may determine the absence of unbalance in the washing tub 51 or 61. Here, the predefined reference vibration may be experimentally defined in various ways. The predefined reference vibration may also be defined in different ways according to the washing-tub operation sensing portions 59-2 and 69-2.

Furthermore, in accordance with an embodiment, the controller 70 may also determine the presence or absence of unbalance not only using the result of first comparison in which the vibration magnitude detected by the washing-tub operation sensing portion 59-2 or 69-2 is compared with a predefined reference vibration, but also using the result of second comparison in which the detected rotation speed of the driver 53 or 63 is compared with a predefined reference rotation speed. In this case, according to selection of the designer, the controller 70 may also be designed to determine the presence or absence of unbalance by further using the magnitude of voltage applied to the driver 53 or 63 and/or the magnitude of current applied to the driver 53 or 63, instead of using the rotation speed of the driver 53 or 63.

If the presence of unbalance is decided as described above, the controller 70 may change an operation scheme (hereinafter referred to as a first operation profile) that has already been carried out by the washing portion 50 or 60 having unbalance to another predefined operation scheme (hereinafter referred to as a second operation profile). For example, the controller 70 may control the water supply portion 58 or 68 in a manner that additional wash water is supplied to the washing tub 51 or 61 having unbalance, or may change an operation pattern of either the washing tub 51 or 61 having unbalance or the driver 53 or 63 such that the washing portion 50 or 60 having unbalance may operate using the second operation profile.

A detailed example of the second operation profile will hereinafter be described in detail.

Figure 15:
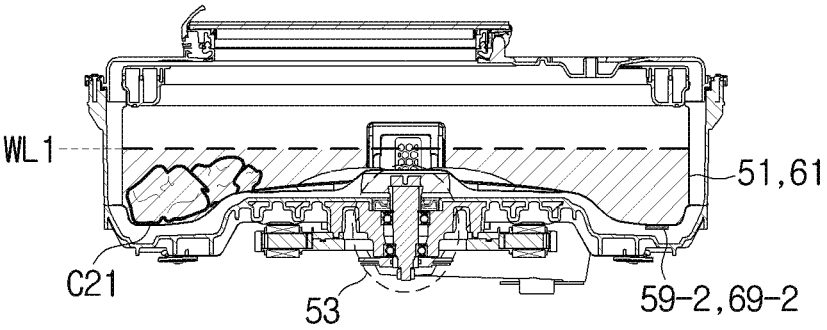
FIG. 15 is a first diagram illustrating an example of a method for changing a water level of wash water stored in a washing tub according to an embodiment of the present disclosure.

FIG. 15 is a first diagram illustrating an example of a method for changing a water level of wash water stored in a washing tub according to an embodiment of the present disclosure.

FIG. 16 is a second diagram illustrating an example of a method for changing a water level of wash water stored in a washing tub according to an embodiment of the present disclosure.

Referring to FIGS. 15 and 16, the second operation profile may include relatively increasing a water level WL1 or WL2 of the washing tub 51 or 61.

In detail, when at least one of the washing portions 50 and 60 operates using the first operation profile, the controller 70 may control at least one of the water supply portions 58 and 68 in a manner that wash water having a predetermined water level WL1 (hereinafter referred to as a first water level) is supplied to the at least one of the washing tubs 51 and 61. After laundry C21 is concentrated at one zone of the washing tub 51 or 61 as shown in FIG. 15 and unbalance occurs in the washing tub 51 or 61, if a water level WL2 (hereinafter referred to as a second water level) relatively increases as shown in FIG. 16, the laundry C21 may move in response to the increasing wash water and the distance between a plurality of laundries C21*a*, C21*b*, and C21*c* may relatively increase. Accordingly, cohesive force among the laundries C21*a*, C21*b*, and C21*c* may be reduced and unbalance of the washing tub may be removed.

Therefore, when the presence of unbalance in the washing tub 51 or 61 is decided, the controller 70 may control the washing portion 50 or 60 to operate using the second operation profile such that a first water level WL1 of the washing tub is relatively increased and then changed to a second water level WL2, resulting in removal of unbalance generated in the washing tub 51 or 61. The second water level WL2 may include a water level that is considered proper, by the designer, to remove unbalance generated in the washing tub 51 or 61. The second water level WL2 may include a full water level.

Figure 17:
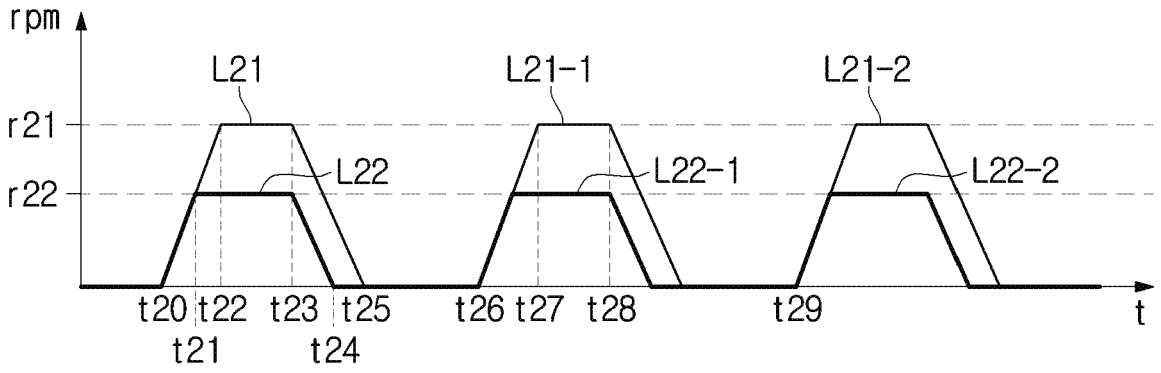
FIG. 17 is a view illustrating a first example of change in a rotation speed of a driver according to an embodiment of the present disclosure.

FIG. 17 is a view illustrating a third example of change in a rotation speed of the driver according to an embodiment of the present disclosure.

The second operation profile may include a change in target rotation speed of the washing tub 51 or 61 having unbalance or a change in target rotation speed of the driver 53 or 63 corresponding to the washing tub 51 or 61.

Referring to FIG. 17, if the first operation profile operates at a predefined target rotation speed R21 (hereinafter referred to as a first target rotation speed) (L21, L21-1, and L21-2), the second operation profile controls a target rotation speed R22 (hereinafter referred to as a second target rotation speed) to be lower than the first target rotation speed R21 such that the washing tubs 51 and 61 or the drivers 53 and 63 may operate at the second target rotation speed R22 (L22, L22-1, and L22-2).

In more detail, the rotation speed of the washing tubs 51 and 61 or the rotation speed of the drivers 53 and 63 may increase to the second target rotation speed R22 (t20 to t21, t26 to t27, and a period since t29). If the rotation speed increases at the same acceleration, the rotation speed of the washing tubs 51 and 61 or the rotation speed of the drivers 53 and 63 may more rapidly reach the second target rotation speed R22 than the first target rotation speed R21 at times t21 and t22. After the washing tubs 51 and 61 or the drivers 53 and 63 rotate at a constant speed until reaching a predetermined time t23 or t28, the washing tubs 51 and 61 or the drivers 53 and 63 are decelerated to zero '0' or an approximate value thereto at times t23 and t24. If deceleration of the washing tub or the driver is started at the same time t23 as in the case L21 based on the first target rotation speed R21, the rotation speed of the washing tub or the driver may more rapidly reach zero '0' or an approximate value thereto at times t24 and t25 in the other case L22 based on the second target rotation speed R22. The above operation for increasing the rotation speed to the second target rotation speed R22 or the above operation for reducing the rotation speed to zero '0' or an approximate value thereto may be repeated for each predefined time section t26 to t26 (L22, L22-1, and L22-2). Centrifugal force is proportional to a square of angular speed. If the second target rotation speed R2 is relatively less than the first target rotation speed R21, centrifugal force may be relatively reduced. As a result, entanglement of laundry C10 (C11, C12, and C13) is removed such that unbalance may also be removed.

Figure 18:
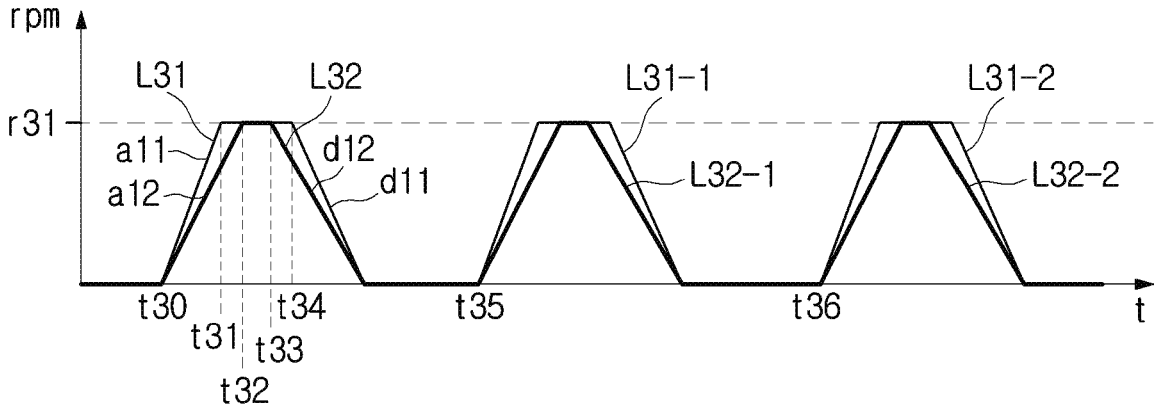
FIG. 18 is a view illustrating a second example of change in a rotation speed of a driver according to an embodiment of the present disclosure.

FIG. 18 is a view illustrating a fourth example of change in a rotation speed of a driver according to an embodiment of the present disclosure.

In accordance with an embodiment, the second operation profile may include changing rotation acceleration and/or rotation deceleration of the washing tubs 51 and 61 having unbalance or the drivers 53 and 63 corresponding to the washing tubs 51 and 61.

Referring to FIG. 18, for example, the first operation profile may include increasing the rotation speed of the washing tubs 51 and 61 or the rotation speed of the drivers 53 and 63 to a target rotation speed R31 according to a predefined rotation acceleration a11 (hereinafter referred to as a first rotation acceleration), and/or reducing the rotation speed of the washing tubs 51 and 61 or the rotation speed of the drivers 53 and 63 to zero '0' or an approximate value thereto according to a predefined rotation deceleration d11 (hereinafter referred to as a first rotation deceleration).

In this case, the second operation profile may include increasing the rotation speed of the washing tubs 51 and 61 or the rotation speed of the drivers 53 and 63 to a target rotation speed R31 according to a rotation acceleration a12 (hereinafter referred to as a second rotation acceleration) relatively less than the first rotation speed a11, and/or reducing the rotation speed of the washing tubs 51 and 61 or the rotation speed of the drivers 53 and 63 to zero '0' or an approximate value thereto according to a rotation deceleration d12 (hereinafter referred to as a second rotation deceleration) relatively higher than the first rotation deceleration d11 (L31, L31-1, and L31-2). Here, the relatively high rotation deceleration d12 may refer to a rotation deceleration having a relatively low absolute value.

In detail, in one case in which the washing machine operates based on the second operation profile, the rotation speed of the washing tubs 51 and 61 or the rotation speed of the drivers 53 and 63 may increase to a target rotation speed R31 at times t30 to t32 more slowly than in the other case in which the washing machine operates based on the first operation profile at times t30 to t31. The washing tubs 51 and 61 or the drivers 53 and 63 may rotate at a constant speed for a predetermined time section t32 to t33. Thereafter, the rotation speed of the washing tubs 51 and 61 or the rotation speed of the drivers 53 and 63 may be reduced to zero '0' or an approximate value thereto at a time t33 more slowly than in the case in which the washing machine operates based on the first operation profile at a time t34. Even in the case in which the washing machine operates based on the second operation profile, the above operation for increasing the rotation speed to the target rotation speed R31 or the above operation for reducing the rotation speed to zero '0' or an approximate value thereto may be repeated ((L32, L32-1, L32-2). Centrifugal force is proportional to angular speed (or angular velocity). Thus, if acceleration is reduced or deceleration is increased, centrifugal force may be reduced, such that unbalance caused by entanglement of laundry C10 (C11, C12, and C13) may be removed.

Although FIG. 18 illustrates a method for changing both rotation acceleration and rotation deceleration for convenience of description and better understanding of the present disclosure, the second operation profile may include only changing rotation acceleration according to selection of the designer (i.e., a first rotation deceleration is identical to a second rotation deceleration), or may also include only changing rotation deceleration according to selection of the designer (i.e., a first rotation acceleration is identical to a second rotation acceleration).

Figure 19:
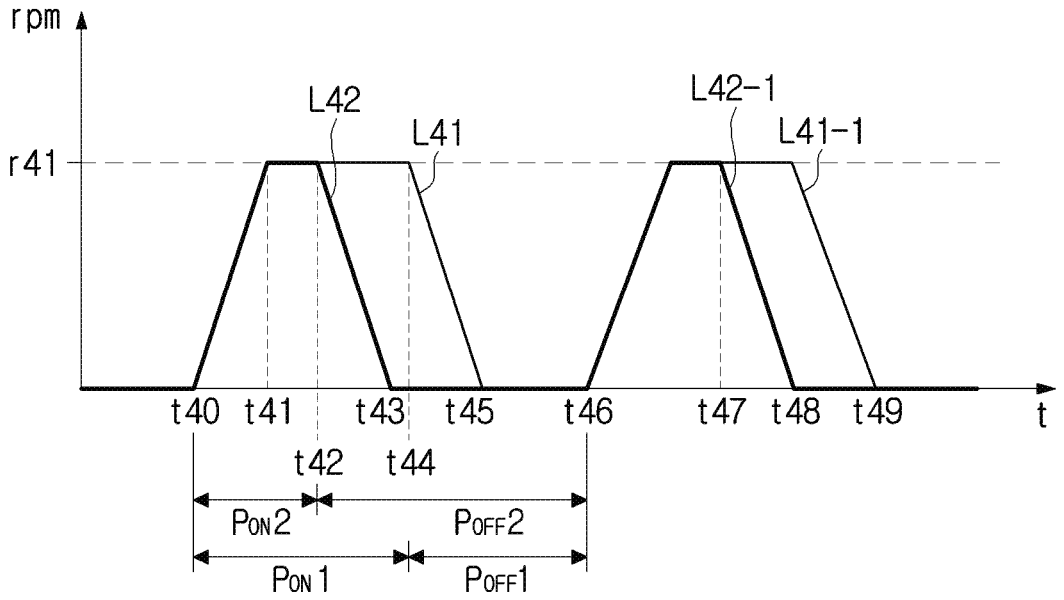
FIG. 19 is a graph illustrating an example of change in an operation rate of a driver according to an embodiment of the present disclosure.

FIG. 19 is a graph illustrating an example of change in an operation rate of the driver according to an embodiment of the present disclosure.

The second operation profile may include changing an operation rate of the washing tubs 51 and 61 having unbalance or an operation rate of the drivers 53 and 63 corresponding to the washing tubs 51 and 61.

The operation rate may refer to a ratio of a total operation time to an active operation time of each driver 53 or 63. Referring to FIG. 19, the operation rate may be defined as a specific value Pon1/(Pon1+Poff1) or Pon2/(Pon2+Poff2) obtained when the active operation period Pon1 or Pon2 is divided by a total operation period Pon1+Poff1 or Pon2+Poff2.

Referring to FIG. 19, the second operation profile may include allowing each driver 53 or 63 to operate at a relatively lower operation rate Pon2/(Pon2+Poff2) than the operation rate Pon1/(Pon1+Poff1) of the first operation profile. In other words, in the case in which the washing machine operates based on the first operation profile, increase and maintenance of the rotation speed may be achieved during a relatively long time (t40 to t44 and t46 to t48) (L41 and L41-1). In the other case in which the washing machine operates based on the second operation profile, increase and maintenance of the rotation speed may be achieved in a relatively short time (t40 to t42 and t46 to t47) (L42 and L42-1). In this case, the target rotation speed based on the first operation profile and the target rotation speed based on the second operation profile (R41) may be identical to each other (R41) or may be different from each other. When the washing machine operates based on the first operation profile, reduction and maintenance (i.e., a substantially stopped state) of the rotation speed may be achieved in a relatively short time (t44 to r46 and t48 to t49) (L41 and L41-1). In contrast, when the washing machine operates based on the second operation profile, reduction and maintenance of the rotation speed may be achieved during a relatively long time (t42 to t46 and t47 and t49) (L42 and L42-1).

As described above, although the operation rate is reduced to a relatively lower value, less centrifugal force may be applied to laundry C10 (C11, C12, and C13), entanglement of the laundry C10 (C11, C12, and C13) may be removed such that unbalance of the washing tub 51 or 61 may also be removed.

Figure 20:
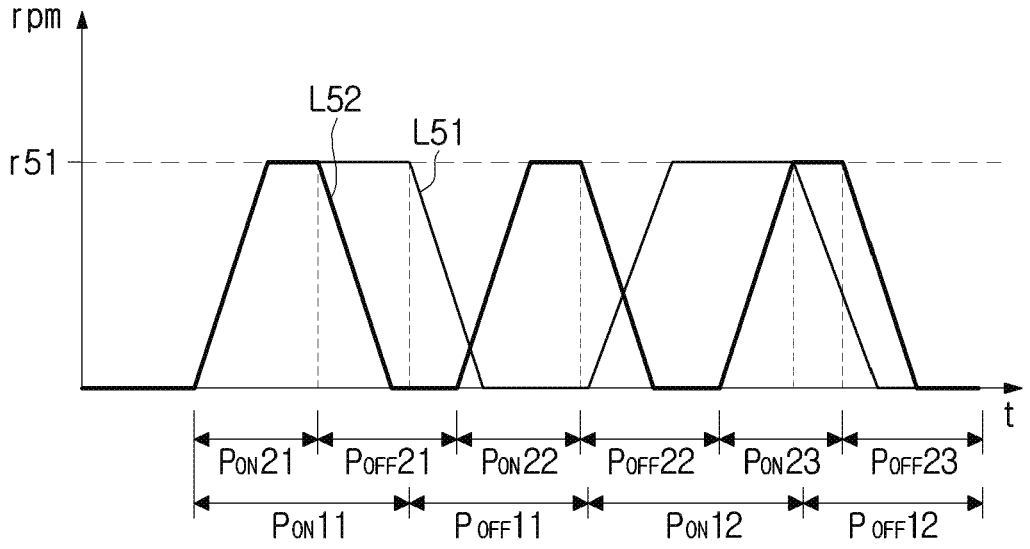
FIG. 20 is a conceptual diagram illustrating an example of a method for changing an operation start time and an operation end time of a driver according to an embodiment of the present disclosure.

FIG. 20 is a conceptual diagram illustrating an example of a method for changing an operation start time and an operation end time of the driver according to an embodiment of the present disclosure.

If necessary, the second operation profile may include changing an operation period (i.e., ON period) and/or a stoppage period (i.e., OFF time) of the washing tub 51 or 61 having unbalance or an operation period (i.e., ON period) and/or a stoppage period (i.e., OFF time) of the driver 53 or 63 corresponding to the washing tub 51 or 61.

Referring to FIG. 20, for example, the first operation profile may include a predefined operation period Pon11 or Pon12 (hereinafter referred to as a first operation period), and/or a predefined stoppage period Poff11 or Poff12 (hereinafter referred to as a first stoppage period) (L51). During the first stoppage period Pon11 or Pon12, the driver 53 or 63 may actively operate (i.e., the driver 53 or 63 may be accelerated and maintained at a high rotation speed R51). During the first stoppage period Poff11 or Poff12, the driver 53 or 63 may stop operation (i.e., the driver 53 or 63 may be decelerated and maintained at a low rotation speed, for example, zero '0' or an approximate value thereto).

An ON period Pon21, Pon22, or Pon23 (hereinafter referred to as a second operation period) may be relatively shorter than the first operation period Pon11 or Pon12 of the first operation profile, and/or an OFF period Poff21, Poff22, or Poff23 (hereinafter referred to as a second stoppage period) of the second operation profile may be relatively shorter than the first stoppage period Poff11 or Poff12 of the first operation profile (L52). In other words, when the washing machine operates based on the second operation profile, the driver 53 or 63 may actively operate during a relatively short period Pon21, Pon22, or Pon23, or may stop operation during a relatively short period Poff21, Poff22, or Poff23. As described above, when the driver 53 or 63 operates based on the second operation period and/or the second stoppage period, starting and stopping of the driver 53 or 63 may be more frequently repeated than in the case in which the washing machine operates based on the first operation profile, such that the laundry C10 (C11, C12, and C13) may be relatively less tangled. As a result, entanglement of the laundry C10 (C11, C12, and C13) may be removed such that unbalance of the washing tub 51 or 61 may also be removed.

FIGS. 14, 15, 16, 17, 18, 19, and 20 illustrate various embodiments of the operations capable of being contained in the second operation profile. According to selection of the designer, the second operation profile may independently include only one of the various embodiments, may include only some of the various embodiments, or may include all of the various embodiments. For example, the second operation profile may include not only increasing a water level of wash water stored in the washing tub, and reducing a water level of wash water stored in the washing tub. Further, the second operation profile may also include at least one of various combinations of the above-mentioned embodiments considerable by the designer.

Various embodiments of the present disclosure in which, when unbalance occurs in the washing tub while the washing machine 2 operates based on the first operation profile, the operation profile is changed to another so that the washing machine 2 is controlled based on the second operation profile, will hereinafter be described with reference to the attached drawings.

Figure 21:
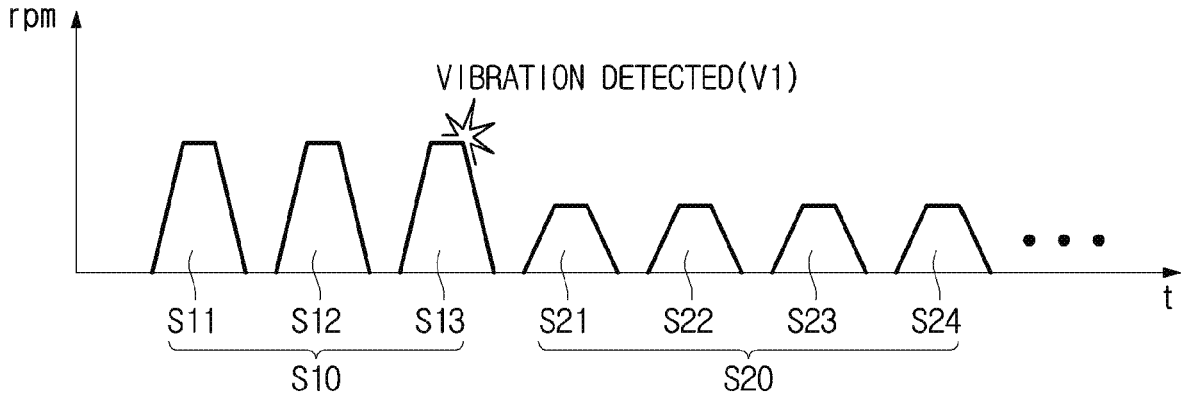
FIG. 21 is a view illustrating a first example of a method for controlling rotation of a washing tub when unbalance occurs in the washing tub according to an embodiment of the present disclosure.

FIG. 21 is a view illustrating a first example of a method for controlling rotation of the washing tub when unbalance occurs in the washing tub according to an embodiment of the present disclosure.

Referring to FIG. 21, at least one of a third washing portion 50 and a fourth washing portion 60 may operate based on a first operation profile S10. The first operation profile S10 may include at least one operation pattern S11, S12, and S13. The at least one operation pattern S11, S12, and S13 may be arbitrarily defined by the designer. For example, the at least one operation pattern S11, S12, and S13 may include increasing a rotation speed at least once, maintaining the rotation speed at least once, and/or reducing the rotation speed at least once.

By the aforementioned method for detecting vibration of the washing tub 51 or 61, if unbalance occurs in at least one of the third washing tub 51 of the third washing portion 50 and the fourth washing tub 61 of the fourth washing portion 60 (V1), the controller 70 may change the first operation profile S10 to the second operation profile S20. The second operation profile S20 may include at least one operation pattern S21 to S24. Here, each operation pattern S21, S22, S23, or S24 may be defined by changing at least one operation pattern S11, S12, and S13 of the first operation profile S10 on the basis of at least one of changing of the water level, changing of the second target rotation speed, changing of the operation rate, changing of the rotation acceleration, changing of the rotation deceleration, and changing of the operation period and/or the stoppage period. In this case, when the first operation profile of at least one of the third washing portion 50 and the fourth washing portion 60 is changed to a second operation profile, the controller 70 may continuously control at least one of the third washing portion 50 and the fourth washing portion 60 on the basis of the changed second operation profile until the washing process, the rinsing process, and/or the dehydration process are ended.

Figure 22:
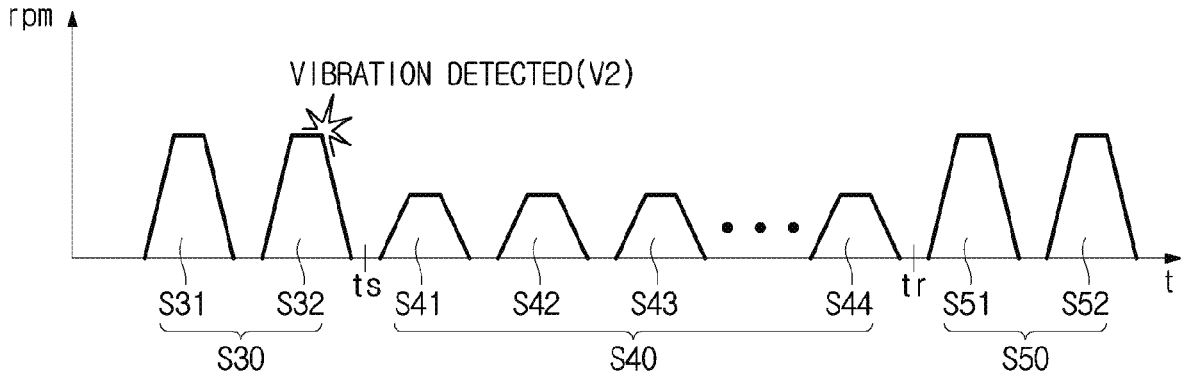
FIG. 22 is a view illustrating a second example of a method for controlling rotation of a washing tub when unbalance occurs in the washing tub according to an embodiment of the present disclosure.

FIG. 22 is a view illustrating a second example of a method for controlling rotation of the washing tub when unbalance occurs in the washing tub according to an embodiment of the present disclosure.

Referring to FIG. 22, while at least one of the third washing portion 50 and the fourth washing portion 60 of the washing machine 2 operates based on the first operation profile S30, the controller 70 may determine the presence or absence of unbalance in at least one of the third washing tub 51 of the third washing portion 50 and the fourth washing tub 61 of the fourth washing portion 60 using a vibration detection method such as the aforementioned method for detecting vibration of the washing tub 51 or 61 (V2). In this case, the controller 70 may change a first operation profile S30 to a second operation profile S40 at a predetermined time or at a time (ts) at which a predefined time elapses from the predetermined time. In the same manner as described above, the first operation profile S30 may include at least one predefined operation pattern S31 and S32. The second operation profile S40 may include at least one operation pattern S41 to S44 defined based on at least one of changing of the water level, changing of the second target rotation speed, changing of the operation rate, changing of the rotation acceleration, changing of the rotation deceleration, and changing of the operation period and/or the stoppage period.

After the first operation profile S30 is changed to the second operation profile S40, if at least one of the third washing portion 50 and the fourth washing portion 60 is controlled according to the second operation profile S40, and if a predefined reference period (ts~tr) finally elapses, the controller 70 may stop the control process based on the second operation profile S40, and may then control at least one of the third washing portion 50 and the fourth washing portion 60 on the basis of a new operation profile S50. Here, the predefined reference period (ts~tr) may include a specific period in which unbalance is considerably or sufficiently removed by the operation based on the second operation profile S40. The specific period in which unbalance is considerably or sufficiently removed may be theoretically or empirically/experimentally decided, and may be decided in various ways according to a method for defining the second operation profile S40. In accordance with an embodiment, the new operation profile S50 may include the first operation profile S30. In accordance with an embodiment, the new operation profile S50 may include at least one predefined operation pattern S51 and S52.

If the washing machine 2 is controlled as described above, at least one of the third washing portion 50 and the fourth washing portion 60 is not controlled according to the second operation profile although unbalance is removed from the washing machine 2, efficiency of the washing process, the rinsing process and/or the dehydration process may be improved.

Figure 23:
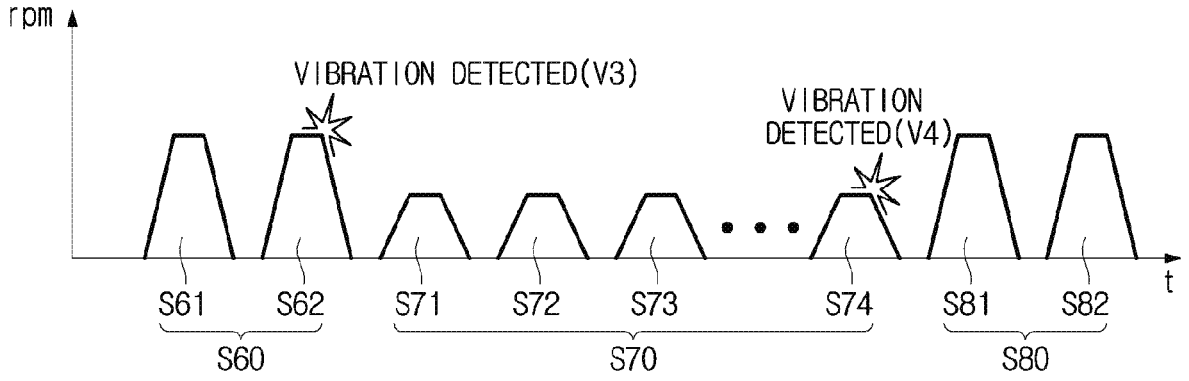
FIG. 23 is a view illustrating a third example of a method for controlling rotation of a washing tub when unbalance occurs in the washing tub according to an embodiment of the present disclosure.

FIG. 23 is a view illustrating a third example of a method for controlling rotation of the washing tub when unbalance occurs in the washing tub according to an embodiment of the present disclosure.

Referring to FIG. 23, the controller 70 may control at least one of the third washing portion 50 and the fourth washing portion 60 according to a first operation profile S60. If unbalance occurs in at least one of the third washing tub 51 of the third washing portion 50 and the fourth washing tub 61 of the fourth washing portion 60 because vibration of the washing tub 51 or 61 is detected (V3), the controller 70 may change the first operation profile S60 to a second operation profile S70. As described above, the first operation profile S60 may include at least one predefined operation pattern S61 and S62, and may include at least one operation pattern S71 to S74 defined based on at least one of changing of the water level, changing of the second target rotation speed, changing of the operation rate, changing of the rotation acceleration, changing of the rotation deceleration, and changing of the operation period and/or the stoppage period. Although the first operation profile S60 is changed to the second operation profile S70, the controller 70 may continuously receive signals from at least one of the third-driver operation sensing portion 59-1, the third-washing-tub operation sensing portion 59-2, the fourth-driver operation sensing portion 69-1, and the fourth-washing-tub operation sensing portion 69-2.

If the controller 70 determines that unbalance generated in at least one of the third washing tub 51 and the fourth washing tub 61 is removed on the basis of the signals received from at least one of the third-driver operation sensing portion 59-1, the third-washing-tub operation sensing portion 59-2, the fourth-driver operation sensing portion 69-1, and the fourth-washing-tub operation sensing portion 69-2, the controller 70 may stop the control process based on the second operation profile S70, and may then control at least one of the third washing portion 50 and the fourth washing portion 60 on the basis of a new operation profile S80. In the same manner as described above, the new operation profile S80 may also include the existing first operation profile S60. In accordance with an embodiment, the new operation profile S80 may include at least one predefined operation pattern S81 and S82.

In this case, upon completion of removal of unbalance, the controller 70 may control at least one of the third washing portion 50 and the fourth washing portion 60 using a relatively more efficient operation profile instead of using the second operation profile, such that efficiency of the washing process, the rinsing process and/or the dehydration process may be further improved.

Figure 24:
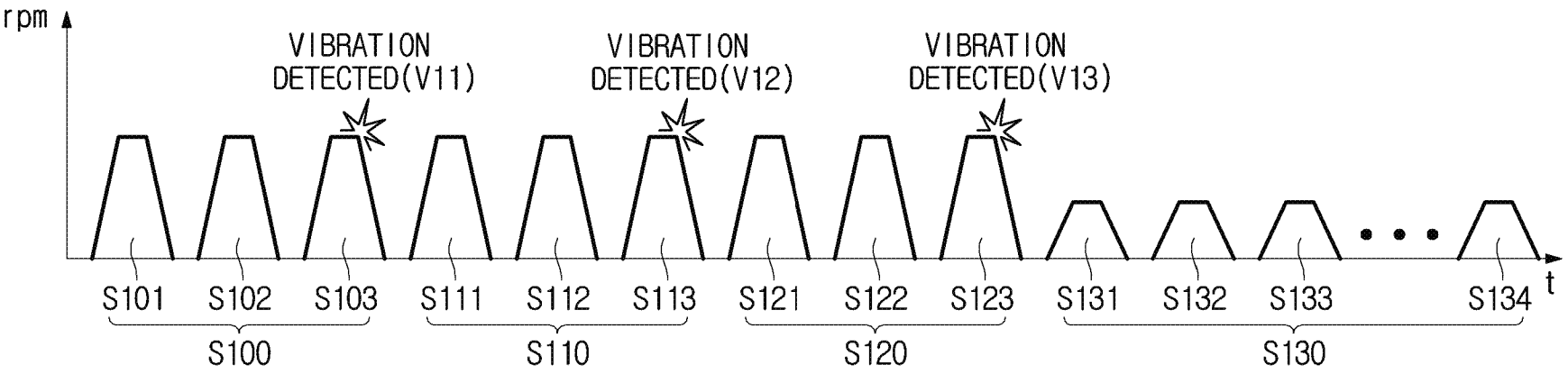
FIG. 24 is a view illustrating a fourth example of a method for controlling rotation of a washing tub when unbalance occurs in the washing tub according to an embodiment of the present disclosure.

FIG. 24 is a view illustrating a fourth example of a method for controlling rotation of the washing tub when unbalance occurs in the washing tub according to an embodiment of the present disclosure.

Referring to FIG. 24, if the controller 70 determines that unbalance is generated in the washing tub 51 or 61 several times (V11, V12, and V13), the controller 70 may change a first operation profile S100, S110, or S120 to a second operation profile S130.

In detail, at least one washing tub 51 and 61 may operate using the first operation profile S110. In the same manner as described above, the first operation profile S110 may include at least one pattern S101 to S103.

Vibration of at least one washing tub 51 and 61 is detected by the third-washing-tub operation sensing portion 59-2 and the fourth-washing-tub operation sensing portion 69-2, a target rotation speed of at least one driver 53 and 63 corresponding to at least one washing tub 51 and 61 is less than a requested target rotation speed, a current applied to at least one driver 53 and 63 is measured as a relatively high current value, and/or a voltage applied to at least one driver 53 and 63 or a DC link circuit is measured as a relatively high voltage value (V11). In this case, the controller 70 may determine (or count) the presence or absence of unbalance without directly retrieving the second operation profile in a different way from the above-mentioned example, and may continuously control the washing machine based on the first operation profiles S110 and S120 in the same manner as in the situation prior to detection or measurement of the washing tub 51 or 61. In accordance with an embodiment, the controller 70 may further use a count variable for counting the number of occurrence times of unbalance so as to count the presence or absence of unbalance. In this case, the first operation profile S110 may include at least one operation pattern S111 to S113, and the first operation profile S120 may include at least one operation pattern S121 to S123.

If the result of unbalance generated in the process for controlling at least one washing tub 51 and 61 based on the first operation profile S110 and S120 is received from at least one of the third-driver operation sensing portion 59-1, the fourth-driver operation sensing portion 60-1, the third-washing-tub operation sensing portion 59-2, and the fourth-washing-tub operation sensing portion 69-2, the controller 70 may continuously count the presence or absence of unbalance in response to the above reception result, and may determine whether the counted result is higher than a predefined value.

In more detail, for example, the controller 70 may add a value of 1 to a count variable, and may compare the resultant count variable to which the value of 1 is added with a count reference value. For example, although the count reference value is set to 3, the scope or spirit of the present disclosure is not limited thereto, and the count reference value may be arbitrarily defined by selection of the designer.

If the count variable is equal to or higher than the count reference value, the controller 70 may determine the presence of unbalance, may change the first operation profile S120 to the second operation profile S130, and may control at least one washing tub 51 and 61 according to the second operation profile S130. The second operation profile S130 may include at least one operation pattern S131 to S134 as described above. In contrast, if the count variable is less than the count reference value, the controller 70 determines that unbalance was not yet generated or determines that unbalance was not yet needed, such that the controller 70 controls at least one washing tub 51 and 61 according to the existing first operation profile S120.

In the case of using at least one washing tub 51 and 61 on the basis of the second operation profile S130, the controller 70 may control at least one washing tub 51 and 61 on the basis of the second operation profile S130 until the washing process, the rinsing process, and/or the dehydration process are/is ended as shown in FIG. 21. As shown in FIG. 22, the controller 70 may control at least one washing tub 51 and 61 on the basis of the second operation profile S130 until expiration of a predetermined time. As shown in FIG. 23, if the controller 70 receives a signal indicating no unbalance, the controller 70 may interrupt the control process based on the second operation profile S130, and may control at least one washing tub 51 and 61 based on a new operation profile.

Until information indicating that the number of generated unbalances is equal to or higher than a reference number of unbalances is received, the controller 70 may continuously control at least one washing tub 51 and 61 on the basis of the first operation profiles S100 to S120. As a result, when an error occurs in the operation sensing portion 59-1, 59-2, 69-1, or 69-2, when vibration occurs in the washing machine due to other reasons than unbalance, or when a rotation speed does not reach a target rotation speed, the controller 70 may prevent the washing machine 2 from being controlled by the second operation profile S130.

One example of a washing machine including a plurality of washing tubs to which the aforementioned embodiments are applicable will hereinafter be described with reference to FIGS. 25, 26, 27, 28, 29, 30, and 31.

Figure 25:
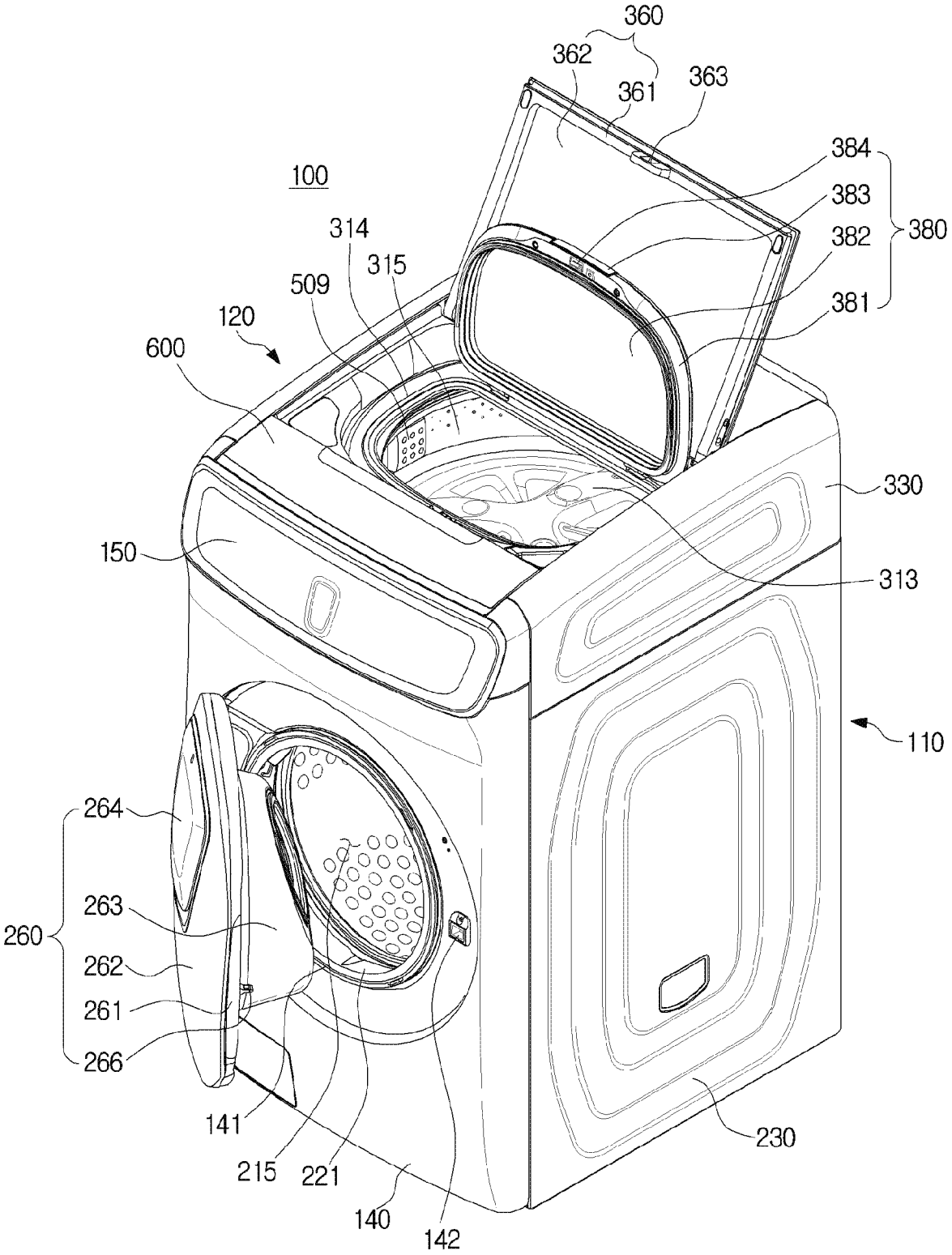
FIG. 25 is a perspective view illustrating a washing machine according to an embodiment of the present disclosure.

FIG. 25 is a perspective view illustrating a washing machine according to an embodiment of the present disclosure.

Figure 26:
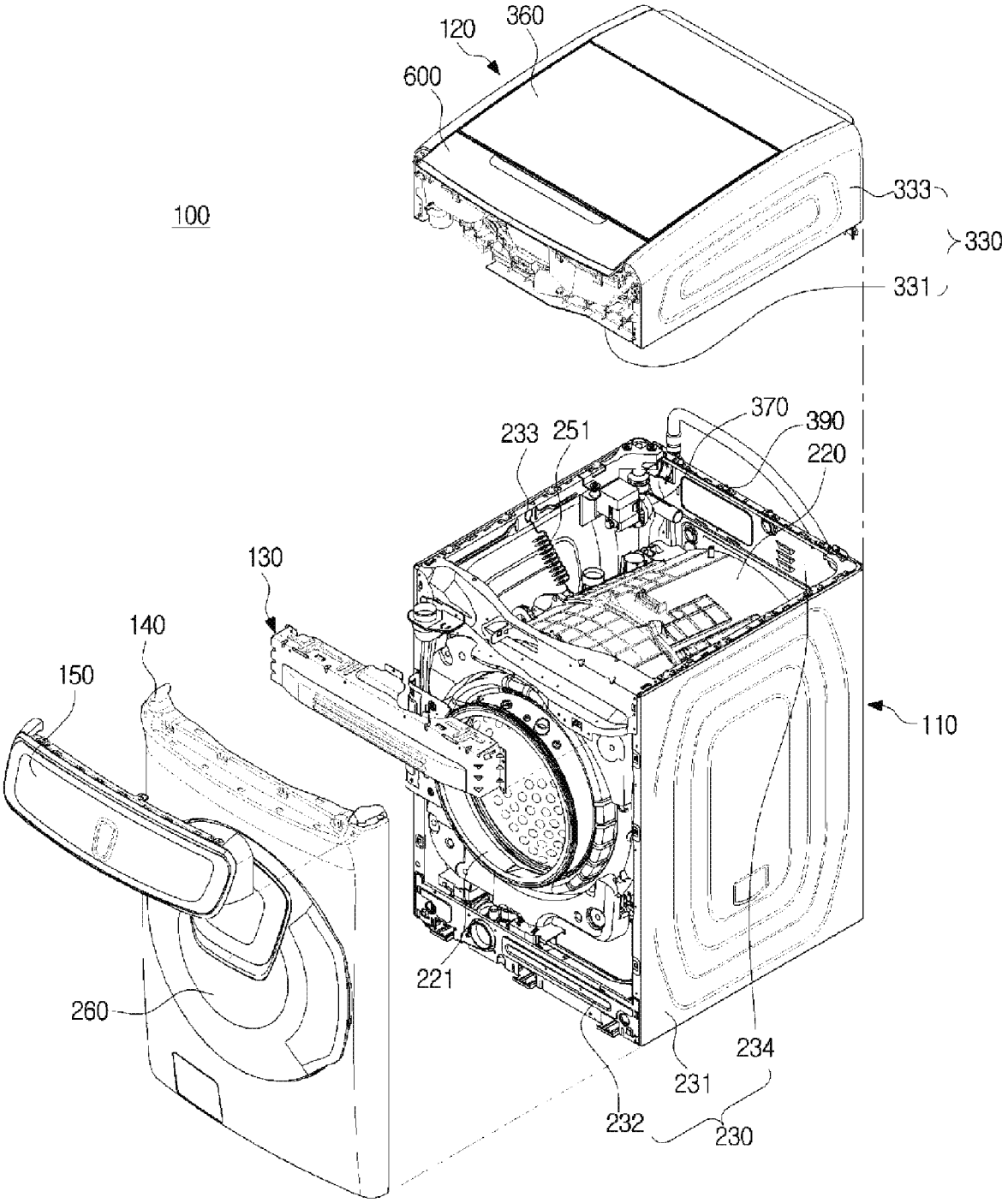
FIG. 26 is a view illustrating a first housing and a second housing of the washing machine according to an embodiment of the present disclosure.

FIG. 26 is a view illustrating a first housing and a second housing of the washing machine according to an embodiment of the present disclosure.

Figure 27:
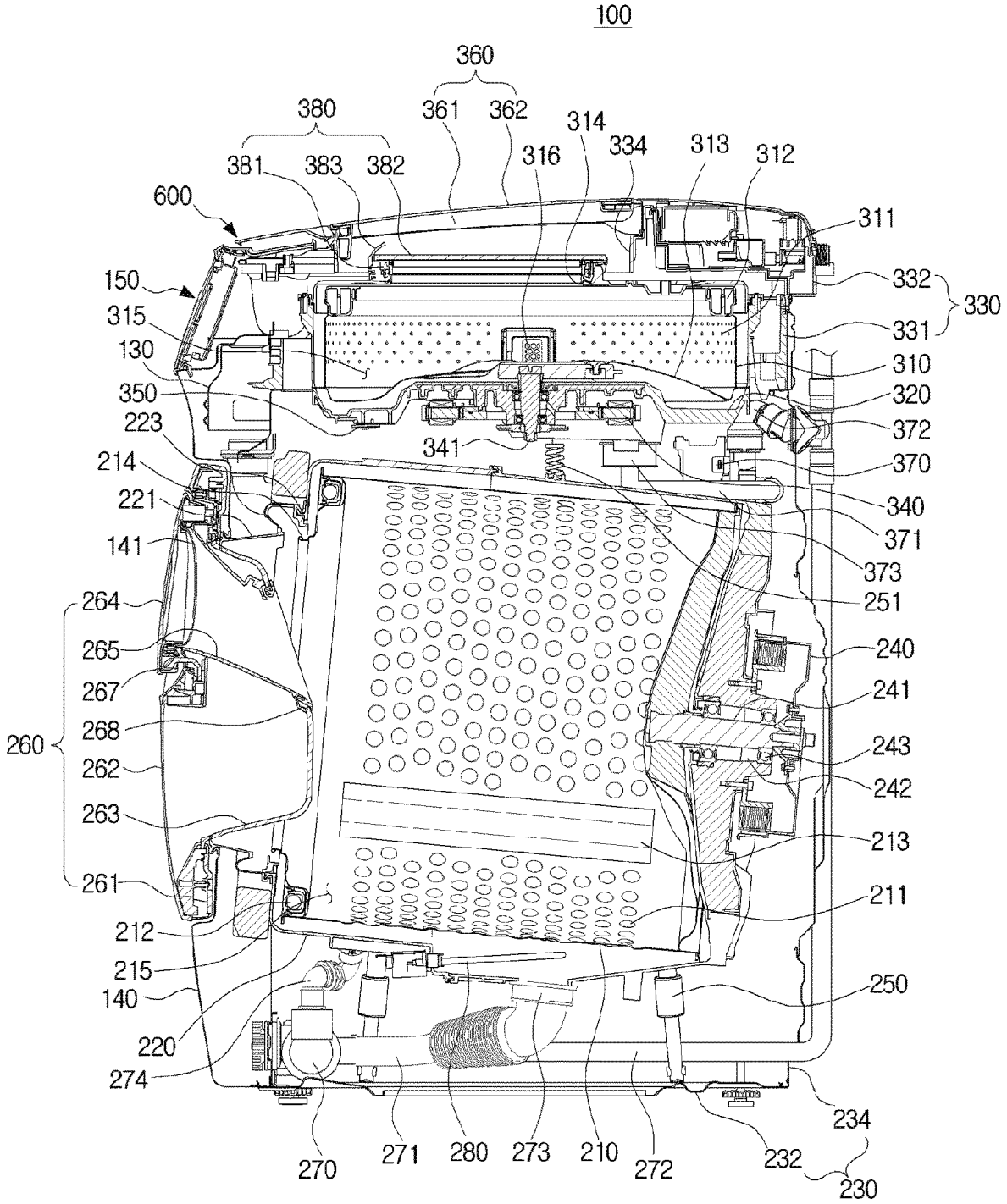
FIG. 27 is a side cross-sectional view illustrating the washing machine according to an embodiment of the present disclosure.

FIG. 27 is a side cross-sectional view illustrating the washing machine according to an embodiment of the present disclosure.

Referring to FIGS. 25, 26, and 27, the washing machine 100 may include a plurality of washing portions 110 and 120. For example, the washing machine 100 may include a first washing portion 110 having a first washing space 215 and a second washing portion 120 having a second washing space 315. Although FIGS. 25, 26, and 27 illustrate the washing machine 100 as including only two washing portions 110 and 120 for convenience of description and better understanding of the present disclosure, the scope or spirit of the present disclosure is not limited thereto, and the only one washing machine 100 may also include three or more washing portions according to selection of the designer.

The first washing portion 110 and the second washing portion 120 may be implemented by the washing portions configured to operate in the same way, or may be implemented by different washing portions configured to operate in different ways. For example, the first washing portion 110 may be implemented as a top loading washing machine in which a laundry inlet is provided at an upper part of the first washing space 215, and the second washing portion 120 may be implemented as a front loading washing machine in which a laundry inlet is provide at the front of the second washing space 315. However, the scope or spirit of the present disclosure is not limited thereto. In accordance with selection of the designer, the first washing portion 110 may be implemented as a front loading washing machine, the second washing portion 120 may be implemented as a top loading washing machine, or each of the first washing portion 110 and the second washing portion 120 may also be implemented as a front loading washing machine or a top loading washing machine as necessary.

The first washing portion 110 and the second washing portion may be disposed perpendicular to each other as shown in FIGS. 25, 26, and 27, or may be disposed parallel to each other.

In accordance with an embodiment, the first washing portion 110 and the second washing portion 120 may also be integrated into one body such that it is impossible to separate the first washing portion 110 from the second washing portion 120. In accordance with another embodiment, the first washing portion 110 and the second washing portion 120 may be detachably coupled to each other. In the latter case, the first washing portion 110 and the second washing portion 120 may be manufactured independently, and may also be coupled and assembled with each other by a designer, a manufacturer, a supplier, a consumer, or a user of another washing machine 100.

The first washing portion 110 may include a first washing tub 210 having a first washing space 215 therein. The first washing tub 210 may be formed in a cylindrical shape, at least a part of one surface of which is opened. In this case, the open surface of the first washing tub 210 is arranged to face forward. Therefore, an inlet (or an opening) 215 through which laundry is introduced into the first washing tub 210 may be provided at the front of the first washing tub 210. The aforementioned first washing tub 210 may be referred to as a drum, and a washing machine including the first washing tub 210 may be referred to as a drum washing machine.

In accordance with an embodiment, a plurality of first through-holes 211 through which wash water passes may be further formed at an outer circumferential surface of the first washing tub 210. A plurality of lifters 213 may be installed at an inner circumferential surface of the first washing tub 210 so that laundry may be raised or dropped during rotation of the first washing tub 210. A first balancer 212 may also be mounted to a front portion of the first washing tub 210 so that the first washing tub 210 stably rotates at a high speed.

The first washing portion 110 may include a first washing tub 210, and may further include a first tub 220 to store wash water to be used in a washing process or rinse water to be used in a rinsing process. The first tub 220 may be formed in a cylindrical shape, at least a part of one surface of which is opened. In this case, the open surface of the first tub 220 may be arranged to face in the same direction as the inlet 214. For example, the open surface of the first tub 220 may be arranged to face forward. Therefore, an inlet 223 through which laundry is introduced into the first tub 220 may be formed at a front of the first tub 220.

The first washing portion 110 may include a first housing 230 that includes the first washing tub 210 and the first tub 220. In accordance with an embodiment, the first housing 230 may be provided with an open upper part, and may include one pair of first side panels 231 forming a side surface of the first housing 230, a first back panel 234 forming a back surface of the first housing 230, and a bottom panel 232 forming a bottom surface of the first housing 230. In this case, the first side panels 231 and the first back panel 234 may be integrated into one body.

The first washing portion 110 may further include a spring 251 and a damper 250 to allow the first tub 220 to be supported by the first housing 230. The damper 250 may connect an outer surface of the first tub 220 to the bottom panel 232 such that the first tub 220 is supported by a lower portion of the first washing portion 110. The spring 251 may connect an outer surface of the first tub 220 to a spring coupling portion 233 provided at an upper portion of the side panel 231 such that the first tub 220 is supported by an upper portion of the first washing portion 110. The spring 251 and the damper 250 may mitigate vibration, noise, and impact encountered by movement of the first tub 220.

Installation positions of the spring 251 and the damper 250 are not limited to the upper end of the side panel 231 and the bottom panel 232. If necessary, the spring 251 and the damper 250 may support the first tub 220 by connecting one surface of the first tub 220 to some parts of the first housing 230.

The first washing portion 110 may include a first driver 240 that is disposed at a rear of the first tub 220 to rotate the first washing tub 210. The first driver 240 may be implemented using, for example, a motor. Although the motor may be implemented using at least one of a DC motor, an AC motor, a DC/AC motor, and a BLDC motor, the scope or spirit of the present disclosure is not limited thereto. The first driver 240 may be directly or indirectly coupled to the first drive shaft 241, and may supply driving force to the first washing tub 210.

The first driver 240 may receive a control signal from a separate controller (400 of FIG. 31) using at least one of a circuit, a conductive line, and a wireless communication network, and may start driving, temporarily stop driving, or finish driving according to a received control signal.

A first drive shaft 241 may be disposed between the first washing tub 210 and the first driver 240. One end of the first drive shaft 241 may be connected to a back panel of the first washing tub 210, and the other end of the first drive shaft 241 may be connected to the first driver 240 by extending outside of a rear wall of the first tub 220. Therefore, driving power generated by the first driver 240 may be transferred to the first washing tub 210, and the first washing tub 210 may also operate in response to beginning of the first driver 240. If the first driver 240 starts operation in response to a received current, the first drive shaft 241 may start rotation in at least one direction in response to the beginning of operation of the first driver 240, and the first washing tub 210 connected to the first drive shaft 241 may rotate in at least one direction with respect to the first drive shaft 241.

In this case, the drive shaft 241 may be provided with a rotation shaft disposed to face in substantially all directions, such that the first washing tub 210 may rotate about an omnidirectional shaft.

In accordance with an embodiment, a conductive line or circuit connected to the first driver 240 may be provided with at least one of a voltage measurement portion (413 of FIG. 31) to measure voltage applied to the first driver 240 and a current measurement portion (414 of FIG. 31) to measure current applied to the first driver 240. At least one of the voltage measurement portion 423 and the current measurement portion 424 may measure at least one of voltage and current using a feedback current.

In accordance with an embodiment, the first washing tub 210 may include a vibration sensor (411 of FIG. 31) to detect vibration of the first washing tub 210. For example, the vibration sensor 411 may be installed on a side surface of the first washing tub 210, and may be installed on at least one of an inner side and an outer side of the first washing tub 210. The vibration sensor 411 may be implemented using a MEMS sensor. The MEMS sensor may include piezoresistive sensor or a capacitive sensor.

Figure 31:
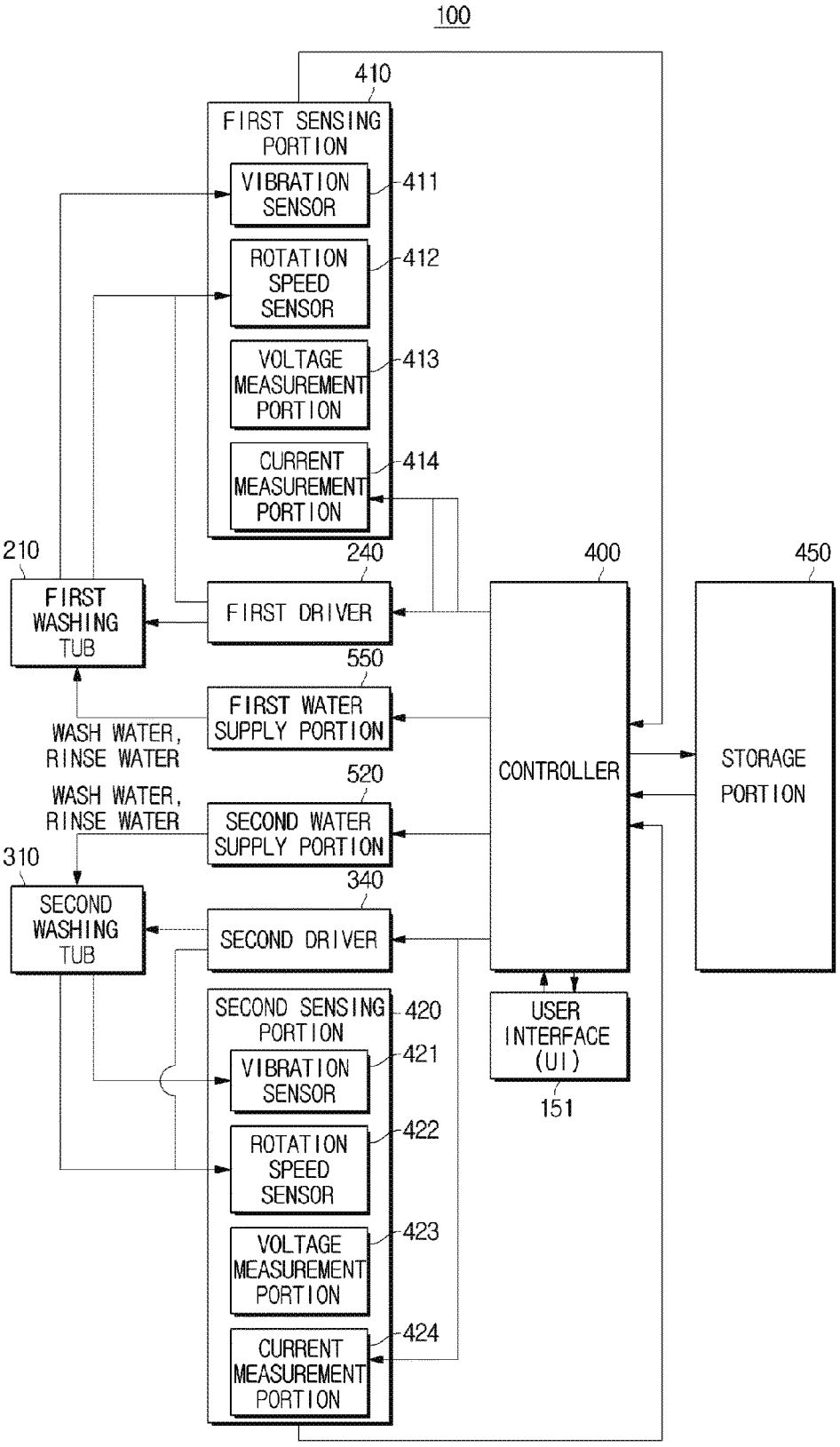
FIG. 31 is a control block diagram illustrating a washing machine according to an embodiment of the present disclosure.

In accordance with an embodiment, a rotation speed of the first washing tub 210 and a rotation speed of at least one of the first drive shafts 241 of the first driver 240 may be detected by a rotation speed sensor (412 of FIG. 31). A rotation speed sensor 412 may be installed around, for example, the first driver 240 or the first washing tub 210.

The rotation speed sensor 413 may be implemented using, for example, a tachometer, an encoder, a toothed-wheel sensor, etc. The tachometer may include, for example, an electrical tachometer and/or a photoelectric tachometer. The encoder may include, for example, an optical incremental encoder, an optical absolute encoder, a magnetic encoder, and/or a resolver.

In accordance with an embodiment, a rear wall of the first tub 220 is provided with a bearing housing 242 to rotatably support the first drive shaft 241. The bearing housing 242 may be formed of an aluminum alloy, and may be inserted into the rear wall of the first tub 220 during injection molding of the first tub 220. At least one bearing 243 to support the first drive shaft 241 may be installed between the bearing housing 242 and the first drive shaft 241 so that the first drive shaft 241 is smoothly rotated.

The first washing portion 110 may be provided with a heater 280 configured to heat wash water or rinse water stored in the first tub 220. For example, the heater 280 may be disposed at a bottom or side surface of the first tub 220. Wash water or rinse water is heated by the heater 280, such that the first washing portion 110 may perform the washing process or the rinsing process with hot water.

The first washing portion 110 may further include a second water supply portion (550 of FIG. 31) to supply wash water and/or rinse water to the first tub 220. The first water supply portion 550 may be disposed in the first housing 230. For example, the first water supply portion 550 may be disposed at a rear upper end of the first tub 220. However, the scope or spirit of the present disclosure is not limited thereto, and the first water supply portion 550 may also be installed at a predetermined position considerable by the designer. The first water supply portion 550 may be connected to an external water supply device, such that the first water supply portion 550 may provide water supplied from the external water supply device to the inside of the first tub 220 and/or may store water therein until a command requesting water is received. Wash water and/or rinse water supplied from the first water supply portion 550 may be introduced into the first tub 220 through a discharge portion (e.g., a plurality of drain holes (not shown)) formed around the first tub 220.

In accordance with an embodiment, the first washing portion 110 may include a drain device to discharge water stored in the first tub 220 to the outside of the washing machine. The drain device may include a first drain pump 270, a first connection hose 271, a circulation hose 274, and a first drain hose 272. The first drain pump 270 is provided at a lower portion of the first tub 220 to discharge water in the first tub 220 to the outside of the washing machine 100. The first connection hose 271 connects a first drain hole 273 of the first tub 220 to the first drain pump 270 such that water in the first tub 220 is introduced into the first drain pump 270. The circulation hose 274 connects the first drain pump 270 to the first tub 220 such that water introduced into the first drain pump 270 may circulate in the first tub 220. The first drain hose 272 may guide water pumped by the first drain pump 270 to the outside of the washing machine 100.

The washing machine 100 may include a front housing 140 having a first inlet 141 through which laundry is introduced into a first washing space 215. The front housing 140 may be coupled to or fixed to one pair of first side panels 231 forming a side surface of the first housing 230. The first housing 140 may be coupled to a first door 260 configured to open or close a first inlet 141.

The first door 260 may be formed at a position corresponding to the first inlet 141, and may be configured to relatively pivot with respect to the front housing 140. The first door 260 may include a first door frame 261, a first door cover 262, and a door glass 263.

The first door frame 261 may be formed in a predetermined shape according to selection of the designer. For example, although the first door frame 261 is formed in a substantially ring shape as shown in FIG. 1, the first door frame 261 may also be formed in a substantially triangular or rectangular shape without departing from the scope or spirit of the present disclosure. The first door cover 262 and the door glass 263 may be formed of transparent material such that a user who is located outside the washing machine 100 may view an inner space of the first washing tub 210 even when the first door 260 closes the first inlet 141. The door glass 263 may be provided to convexly protrude from the first door frame 261 toward the interior of the first washing tub 210. Through the above structure, when the first door 260 is closed, the door glass 263 may be inserted into the first inlet 141.

A first hinge (not shown) is provided in the vicinity of the first inlet 141 to allow the first door 260 to pivot with respect to the front housing 140, and is rotatably coupled to a first hinge coupling portion (not shown) formed at one side of the first door frame 261.

A first hook 266 may be provided at the other side of the first door frame 261, and the front housing 140 may include a first hook container 142 formed at a position corresponding to the first hook 266, such that the first door 260 closes the first inlet 141 and is kept locked. If the first door 260 is kept closed, the first hook 266 is inserted into the first hook container 142 to prevent the first door 260 from being randomly opened.

The first door 260 may further include an auxiliary laundry inlet 267 such that, even when the first door 260 is closed, the user may put laundry into the first washing space 215. If necessary, the first door 260 may further include an auxiliary door 264 to open or close the auxiliary laundry inlet 267. In this case, the auxiliary door 264 may be hinged to or slidably coupled to the first door cover 262 such that the auxiliary door 264 may be pivotable or movable with respect to the first door 260.

In accordance with an embodiment, the door glass 263 may further include a glass through-hole 268. The glass through-hole 268 may provide a route through which laundry received through the auxiliary laundry inlet 267 is introduced into the first washing space 215. In order to connect the auxiliary laundry inlet 267 of the first door 260 to the glass through-hole 268 of the door glass 263, the first door 260 may include a connection guide portion 265. Both ends of the connection guide portion 265 may be opened, such that the connection guide portion 265 may be formed to have a hollow cylindrical pipe shape. In detail, one end of the connection guide portion 265 may be connected to the auxiliary laundry inlet 267, and the other end of the connection guide portion 265 may be connected to the glass through-hole 268. In this embodiment, the connection guide portion 265 may be tilted downward in a direction from the front side to the rear side of the washing machine. That is, one end of the connection guide portion 265 connected to the auxiliary laundry inlet 267 may be located at a higher position than the other end of the connection guide portion 265. Through the above structure, the user may easily put laundry into the first washing tub 210 through the auxiliary laundry inlet 267. If necessary, the connection guide portion may be omitted.

In accordance with another embodiment, an upper portion of the door glass 263 may include a collapsed or indented region (not shown) formed at a position corresponding to the auxiliary laundry inlet 267. By formation of the collapsed region, the door glass is not located at a rear of the auxiliary laundry inlet 267. Therefore, laundry received through the auxiliary laundry inlet 267 may be introduced into the first washing space 215 without intervention.

Although the above-mentioned embodiment has disclosed the first door 260 provided with the auxiliary door 264 for convenience of description and better understanding of the present disclosure, the installation position of the auxiliary door 264 is not limited thereto, and the auxiliary door 264 may also be installed at other positions other than the first door 260 as necessary.

The washing machine 100 may further include a diaphragm 221 disposed between the first inlet 141 of the front housing 140 and the inlet 223 (or opening) of the first tub 220. The diaphragm 221 may form a passage from the first inlet 141 to the inlet 214 of the first washing tub 210. During rotation of the first washing tub 210, the diaphragm 221 may reduce vibration delivered to the front housing 140. Some parts of the diaphragm 221 may be disposed between the first door 260 and the front housing 140 so as to prevent wash water of the first tub 220 from leaking outside the washing machine 100.

In accordance with an embodiment, the second washing portion 120 may include a second washing tub 310 having a second washing space 315 therein. At least one portion of one surface of the second washing tub 310 may be formed in a cylindrical shape, at least a part of one surface of which is opened. The open surface is arranged to face forward.

The second washing tub 310 may be disposed to be rotatable in the second tub 320.

A plurality of second through-holes 311 through which wash water passes may be formed at a side surface and a bottom surface of the second washing tub 310. A second balancer 312 may be mounted to an upper portion of the second washing tub 310 so that the second washing tub 310 may stably rotate at a high speed. A filter 316 may be attached to an inner side surface of the second washing tub 310 so that the filter 316 may filter out contaminants generated in a washing process. A bent portion 313 producing a water current may be formed at a bottom surface of the second washing tub 310. In accordance with an embodiment, the second washing tub 310 may further include a pulsator or rotary rod that is disposed in the second washing tub 310 to produce a water current.

The second washing portion 120 may include a second washing tub 310, and may further include a second tub 320 to store wash water to be used in a washing process or rinse water to be used in a rinsing process. The second tub 320 may be formed in a three-dimensional (3D) shape, at least a part of one surface of which is opened. For example, the second tub 320 may be formed in a cylindrical shape. In this case, the open surface of the second 320 may be arranged to face upward in the same manner as the open surface of the second washing tub 310. The second tub 320 may be supported by a lower frame 331 via a suspension device 350. For example, the second tub 320 may be supported while being suspended from the lower frame 331 by four suspension devices 350. A third inlet 314 may be provided to correspond to the second inlet 334 at a top surface of the second tub 320.

The second washing portion 120 may further include a third door 380 to open or close the third inlet 314. In this case, the third door 380 may include a third door frame 381, and may further include a third door cover 382. The third door cover 382 may be formed of a transparent material such that a user who is located outside the second tub 320 may view an inner space of the second washing tub 310 even when the third door 380 closes the third inlet 314.

A third hinge (not shown) may be provided in the vicinity of the third inlet 314 so as to pivot the third door 380 with respect to the second tub 320, and may be pivotably coupled to a third hinge coupling portion (not shown) formed at one side of the third door frame 381. A knob 383 capable of opening the third door 380 may be provided at the other side of the third door frame 381, and the knob 383 may include a second hook 384. The second tub 320 may include a second hook container formed at a position corresponding to the second hook 384. When the third door 380 closes the third inlet 314, the second hook 384 may be coupled to a second hook container. When the second hook 384 is coupled to the second hook container, the closed state in which the third door 380 closes the third inlet 314 may be stably maintained. If a user manipulates the knob 383, the second hook 384 is released from the second hook container so that the third door 380 is opened.

The second washing portion 120 may include a second housing 330 that includes the second washing tub 310 and the second tub 320. A lower portion of the second housing 330 is opened or closed. In detail, the second housing 330 may include a lower frame 331 supporting the second tub 320, a second inlet 334 through which laundry is introduced into a second washing space 315, and an upper frame 332 seated on the lower frame 331. An upper portion and a lower portion of the lower frame 331 may be opened. Further, the second housing 330 may include a side cover 333 forming the external appearance of a left side surface and a right-side surface of the second washing portion 120.

The second washing portion 120 may be disposed in the second housing 330, and may include a second door 360 to open or close the second inlet 334. The second door 360 may be provided to correspond to the second inlet 334, and may be pivotably movable with respect to the upper frame 332. The second door 360 may include a second door frame 361 and a second door cover 362. The second door cover 362 may be formed of a transparent material such that a user who is located outside the washing machine 100 may view inner spaces of the second tub 320 and the second washing tub 310 even when the second door 360 closes the second inlet 334.

A second hinge is provided at right and left sides of the second door frame 361 to allow the second door 360 to pivot with respect to the upper frame 332, and is coupled to a second hinge coupling portion formed in the vicinity of the second inlet 334. A latch container 363 is provided at a front side of the second door frame 361, and the upper frame 332 is provided with a latch device formed at a position corresponding to the latch container 363 of the second door frame 361, such that the second door 360 closes the second inlet 334 and is kept locked during operation of the second washing portion 120.

In accordance with an embodiment, the second washing portion 120 may include a second driver 340 that is disposed outside a lower side of the second tub 320 and rotates the second washing tub 310. A second drive shaft 341 for carrying power of the second driver 340 may be connected to a bottom surface of the second washing tub 310. One end of the second drive shaft 341 may be connected to a bottom panel of the second washing tub 310, and the other end of the second drive shaft 341 may extend outside a lower sidewall of the second tub 320. When the second driver 340 drives the second drive shaft 341, the second washing tub 310 connected to the second drive shaft 341 may rotate about the second drive shaft 341. The second drive shaft 341 may be provided with a rotation shaft disposed to face in a substantially upward direction, such that the second washing tub 310 may rotate about the rotation shaft disposed in the substantially upward direction.

In accordance with an embodiment, a conductive line or circuit connected to the second driver 340 may be provided with at least one of a voltage measurement portion (423 of FIG. 31) to measure voltage applied to the second driver 340 and a current measurement portion (424 of FIG. 31) to measure current applied to the second driver 340. At least one of the voltage measurement portion 423 and the current measurement portion 424 may also be disposed close to the second driver 340 according to a system design of the designer. If necessary, another conductive line or circuit to which the current applied to the conductive line or circuit connected to the second driver 340 is fed back may be further installed in the vicinity of the conductive line or circuit connected to the second driver 340. At least one of the voltage measurement portion 423 and the current measurement portion 424 may also be disposed at a conductive line to which a current is fed back. In this case, at least one of the voltage measurement portion 423 and the current measurement portion 424 may measure at least one of voltage and current using a feedback current.

In accordance with an embodiment, when the pulsator is disposed at the bottom surface of the second washing tub 310, the washing machine may further include a power switching device that is capable of simultaneously or selectively transmitting drive power generated by the second driver 340 to the second washing tub 310 and/or the pulsator.

In accordance with an embodiment, the second washing tub 310 may further include a vibration sensor (421 of FIG. 31) to detect vibration of the second washing tub 310. For example, the vibration sensor 421 may be installed at an inner side surface or an outer side surface of the second washing tub 310. In more detail, the vibration sensor 421 may also be installed at an outer bottom surface of the second washing tub 310. The vibration sensor 421 may be implemented using, for example, a vibration sensor based on a piezoelectric acceleration scheme or a vibration sensor based on a cantilever vibration scheme. The vibration sensor 421 may also be implemented using a MEMS sensor as necessary.

In accordance with an embodiment, a rotation speed of the second washing tub 310 and a rotation speed of at least one of the second drive shafts 341 of the second driver 340 may be detected by a rotation speed sensor (422 of FIG. 31). A rotation speed sensor 423 may be installed around, for example, the second driver 340 or the second washing tub 310. The rotation speed sensor 423 may be implemented using, for example, a tachometer, an encoder, a toothed-wheel sensor, etc.

The second washing portion 120 may further include a second drain pump and a second drain hose 372. The second drain pump 370 for discharging water in the second tub 320 to the outside of the washing machine 100 may be disposed at a lower portion of the second tub 320. The second drain hose 372 may guide water pumped by the second drain pump 370 to the outside of the washing machine 100. In detail, the second drain pump 370 may be mounted at an upper portion of the first housing 230.

A second drain hole 373 to discharge water in the second tub 320 may be formed at the bottom surface of the second tub 320. The second drain hole 373 may be connected to the second drain pump 370 by a second connection hose 371 so as to allow water in the second tub 320 to be introduced into the second drain pump 370.

The second washing portion 120 may further include a second water supply portion (520 of FIG. 31) to supply wash water and/or rinse water to the second tub 320. The second water supply portion 520 may be disposed in the second housing 330. For example, the second water supply portion 520 may be disposed in the upper frame 332. However, the scope or spirit of the present disclosure is not limited thereto, and the second water supply portion 520 may also be disposed at the rear of the second inlet 334. The second water supply portion 520 may be connected to an external water supply device, such that the second water supply portion 520 may provide water supplied from the external water supply device to the second tub 320 and/or may store water therein until receiving a command requesting water. Wash water and/or rinse water supplied from the second water supply portion 520 may be introduced into the second tub 320 through a discharge portion (e.g., a plurality of drain holes 509) formed around the second tub 320.

The first water supply portion 510 and the second water supply portion 520 may also be integrated into one body. In this case, the integrated water supply portion may receive water from a water supply device, and may selectively supply wash water and/or rinse water to at least one of the first tub 220 and the second tub 320 as necessary. In order to supply wash water and/or rinse water to at least one of the first tub 220 and the second tub 320, the integrated water supply portion may also include a plurality of valves formed in pipes through which the water supply portion is connected to each of the first tub 220 and the second tub 320.

In accordance with an embodiment, the washing machine 100 may include a detergent supply device 600 configured to supply detergent to the first tub 220. The detergent supply device 600 may be disposed in at least one of the first housing 230 and the second housing 330. For example, the detergent supply device 600 may be disposed in the upper frame 332 of the second housing 330. Preferably, the detergent supply device 600 may also be disposed at a front of the second inlet 334 provided in the second housing 330.

In accordance with an embodiment, the washing machine 100 may include a fixed bracket 130 through which the first housing 230 and the second housing 330 are coupled to each other so that the first housing 230 is not separated from the second housing 330. For example, the fixed bracket 130 may be coupled to a front part of the first housing 230 and a front part of the second housing 330. The fixed bracket 130 may be coupled to a side part of the first housing 230 and a side part of the second housing 330 according to selection of the designer, or may also be coupled to a rear part of the first housing 230 and a rear part of the second housing 330.

The washing machine 100 may further include a control panel 150. The control panel 150 may be disposed at, for example, an upper portion of the front housing 140 of the washing machine 100 such that the user may easily manipulate and confirm necessary information through the control panel 150. However, the installation position of the control panel 150 is not limited thereto. In detail, the control panel 150 may be installed at various positions considerable by the designer, for example, at one surface of the upper frame 332 or at a top surface of the detergent supply device 600.

The control panel 150 may include a UI (151 of FIG. 1, FIG. 11 or FIG. 24) to receive various commands related to various operations of the washing machine 100 as well as to visually and/or audibly provide the user with information related to the washing machine 100.

The UI 151 may include at least one input device and/or at least one output device. Here, the input device may be implemented using, for example, at least one of a physical button, a touchpad, a touchscreen, a knob, a stick-type manipulator, a trackball, and a track pad. The input device may also be implemented using various devices considerable by the designer. The output device may include at least one of a display device configured to visually output information and a sound output device configured to audibly output information.

The display device may be implemented using a cathode ray tube (CRT) or various display panels, for example, a liquid crystal display (LCD) panel, a light emitting diode (LED) panel, an organic LED (OLED) panel, a quantum dot (QD) display panel, etc. The sound output device may be implemented using a speaker device or the like.

In accordance with an embodiment, the UI 151 may be installed not only at the control panel 150, but also at various positions considerable by the designer. A substrate having circuit(s) and at least one semiconductor chip mounted to the substrate may be disposed and installed in the control panel 150. The at least one semiconductor chip and the substrate may be provided to perform operations of the controller 400 to be described later.

The coupling state between the first housing 230 and the second housing 330 will hereinafter be described with reference to the attached drawings.

Figure 28:
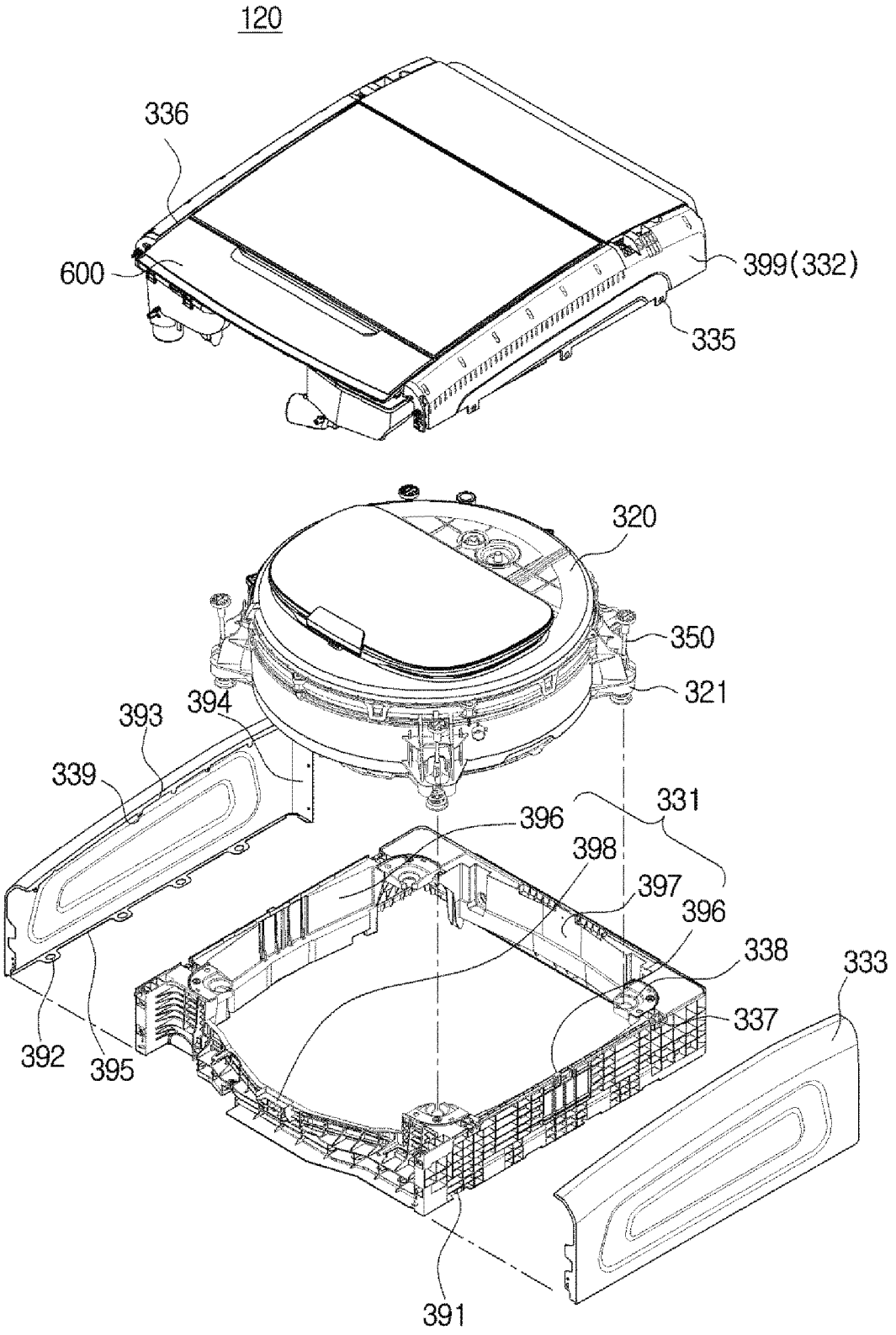
FIG. 28 is an exploded perspective view illustrating the second housing according to an embodiment of the present disclosure.

FIG. 28 is an exploded perspective view illustrating the second housing according to an embodiment of the present disclosure.

Figure 29:
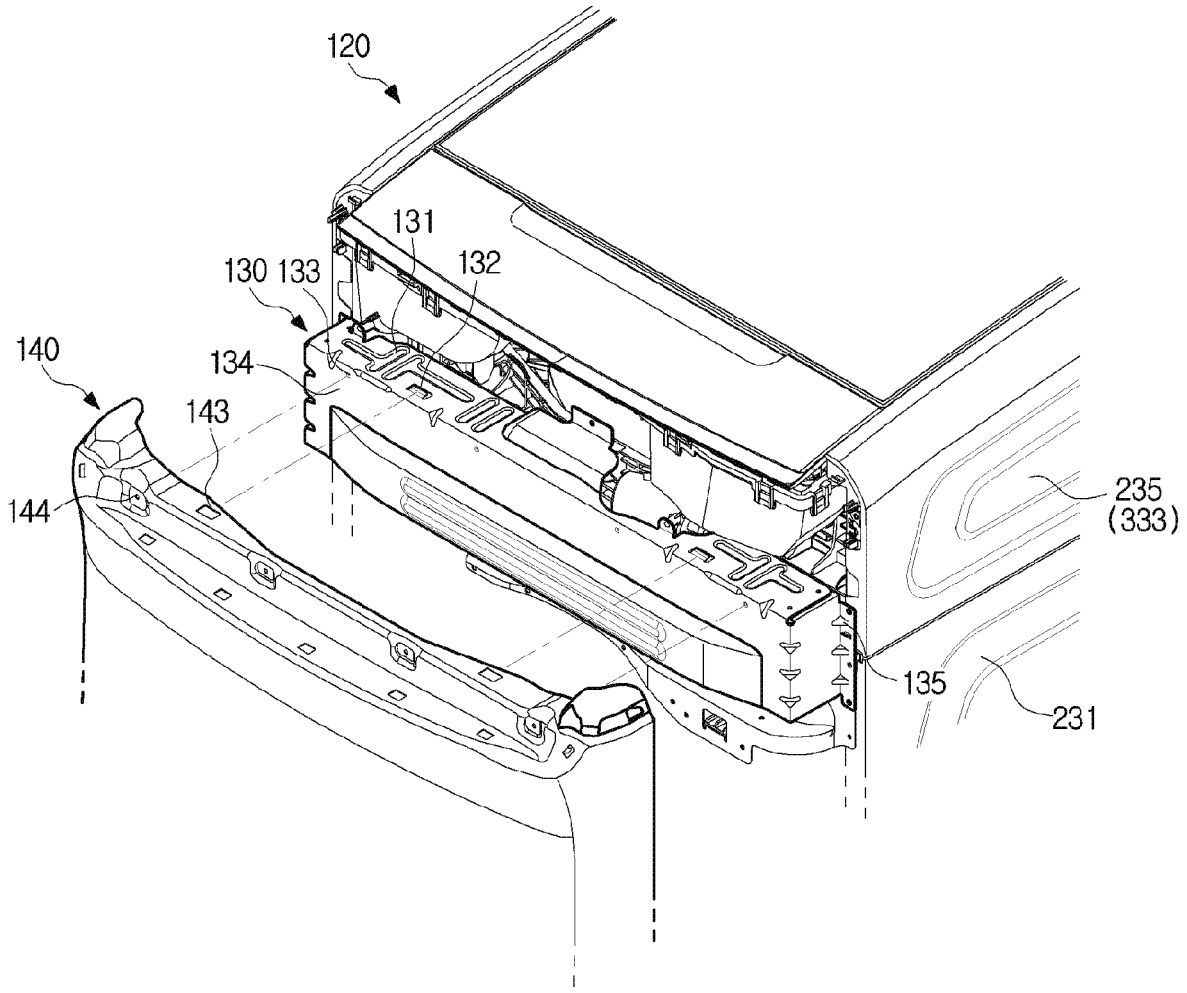
FIG. 29 is a view illustrating a fixed bracket and some parts of a front housing of the washing machine according to an embodiment of the present disclosure.

FIG. 29 is a view illustrating a fixed bracket and some parts of a front housing of the washing machine according to an embodiment of the present disclosure.

Figure 30:
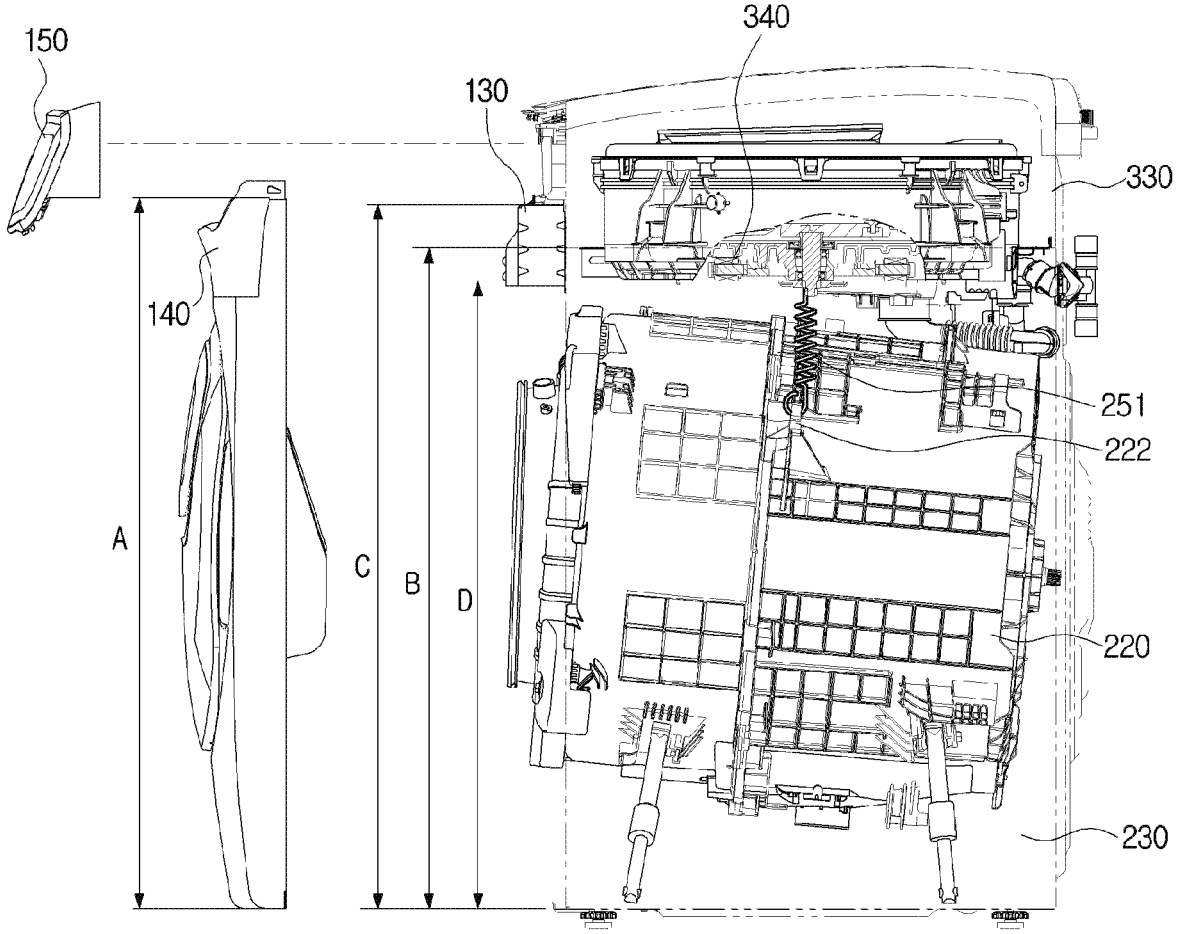
FIG. 30 is a side view illustrating a coupling position between the fixed frame and the front housing of the washing machine according to an embodiment of the present disclosure.

FIG. 30 is a side view illustrating a coupling position between the fixed frame and the front housing of the washing machine according to an embodiment of the present disclosure.

Referring to FIG. 28, the lower frame 331 of the second housing 330 may include a first support portion 338 coupled to the suspension device 350. The second tub 320 may be provided with a second support portion 321 located at a lower part of an outer side surface thereof such that the second support portion 321 is connected to the suspension device 350. The suspension device 350 may be configured to connect the first support portion 338 of the lower frame 331 to the second support portion 321 of the second tub 320.

The lower frame 331 may be formed in a manner that a front wall 398, a rear wall 397, and one pair of sidewalls 396 are connected to one another so as to surround a front part, a rear part, and side parts of the second tub 320. The first support portion 338 may be provided at an upper end of each corner of the lower frame 331. As a result, the lower frame 331 may have sufficient rigidity to support the second tub 320 via four suspension devices 350.

The upper frame 332 may include a first coupling portion 335 capable of being coupled to the lower frame 331. The first coupling portion 335 may be disposed at lower ends of right and left sides of the upper frame 332. The lower frame 331 may include a second coupling portion 337 capable of being coupled to the upper frame 332. The second coupling portion 337 may be disposed at a position corresponding to the first coupling portion 335 of the upper frame 332 located at an upper end of the lower frame 331.

A side cover 333 may be connected to the upper frame 332 and the lower frame 331 to cover a side surface of the upper frame 332 and a side surface of the lower frame 331. The side cover 333 may include an upper flange 393 capable of being coupled to the upper frame 332, and the upper frame 332 may include a coupling groove 336 into which the upper flange 393 of the side cover 333 is inserted. The upper flange 393 of the side cover 333 may be provided with a fastening portion 339 that is capable of being coupled to the upper frame 332 in the coupling groove 336 of the upper frame 332. The fastening portion 339 may be coupled to the upper frame 332 by a fastening member such as a screw.

The side cover 333 may be provided with a lower flange 395 formed at a lower end thereof such that the bottom surface of the lower frame 331 is partially surrounded by the lower flange 395. A rear flange 394 may be provided at a rear end of the side cover 333 so that the rear flange 394 may partially surround back surfaces of the upper frame 332 and the lower frame 331.

After the lower frame 331 is coupled to the upper frame 332, the upper flange 393 of the side cover 333 is inserted into the coupling groove 336 of the upper frame 332, and the side cover 333 is rotated and coupled to the lower frame 331 in a manner that the lower flange 395 of the side cover 333 is located at the bottom surface of the lower frame 331.

After the side cover 333 is coupled to the lower frame 331, the rear flange 394 of the side cover 333 may be fixed to back surfaces of the upper frame 332 and the lower frame 331 through a fastening member such as a screw.

Vibration may occur in the lower frame 331 by the second tub 320 supported by the lower frame 331. By coupling the lower frame 331 to the upper frame 332, vibration of the lower frame 331 may be transmitted to the upper frame 332.

When the lower frame 331 and the upper frame 332 are about to be separated from each other by vibration or the like, the side cover 333 may prevent the lower frame 331 and the upper frame 332 from being released from each other, thereby guaranteeing user safety. The side cover 333 may allow a left surface and a right side surface of the lower frame 331 and the upper frame 332 to be covered with a single member, such that a side surface of the second housing 330 is simplified. When the second housing 330 is coupled to the first housing 230, the side cover 333 may allow the first housing 230 and the second housing 330 to look like a single unified body so that the first housing 230 and the second housing 330 may have an aesthetically pleasing appearance.

The second housing 330 of the washing machine 100 may include one pair of second side panels 235 forming a side surface of the second housing 330. That is, the second side panels 235 of the second housing 330 may include sidewalls 396 of the lower frame 331, sidewalls 399 of the upper frame 332, and at least one portion of the side cover 333.

Referring to FIG. 26, the washing machine 100 may further include a first guide protrusion 390 that is disposed at an upper end of the first housing 230 and guides a seating position of the second housing 330. In detail, the first guide protrusion 390 may protrude upward from one pair of the side panels 231. The first guide protrusion 390 may be formed of an additional member, may be coupled to the first side panel 231, and may be integrated with the first side panel 231 as one body.

Referring to FIG. 28, the washing machine 100 may include a guide protrusion insertion portion disposed at a lower portion of one pair of the second side panels 235 of the second housing 330, such that the first guide protrusion 390 is inserted into the guide protrusion insertion portion. In detail, the lower flange 395 of the side cover 333 forming the second side panels 235 may be provided with a through-hole 392 through which the first guide protrusion 390 passes, and a guide protrusion container 391 capable of containing the first guide protrusion 390 may be provided at the bottom surface of the sidewall 396 of the lower frame 331 forming the second side panels 235.

Four first guide protrusions 390 may be disposed at an upper end of a left side of the first side panel 231 of the first housing 230, and four first guide protrusions 390 may be disposed at an upper end of a right side of the first side panel 231 of the first housing 230. By the first guide protrusions 390, the side surface of the first housing 230 and the side surface of the second housing 330 may be arranged without any operation difference therebetween.

Although not shown in the drawings, the guide protrusions for guiding the seating position of the second housing 330 may protrude downward from one pair of the second side panels 235 of the second housing 330. The guide protrusion insertion portions into which the guide protrusions are inserted may be formed at upper portions of one pair of the first side panels 231 of the first housing 230.

Referring to FIGS. 29 and 30, the front housing 140 may be provided to cover at least one portion of the front surface of the first housing 230 and at least one portion of the front surface of the second housing 330. Although the front housing 140 formed to cover the entirety of the front surface of the first housing 230 is shown in FIGS. 29 and 30, the scope or spirit of the present disclosure is not limited thereto, and the front housing 140 may be provided to cover at least one portion of the front surface of the first housing 230 and at least one portion of the front surface of the second housing 330.

The fixed bracket 130 may be disposed in the front housing 140 such that the fixed bracket 130 allows the first housing 230 to be fixed at the front of the first housing 230 and allows the second housing 330 to be fixed at the front of the second housing 330. In detail, the fixed bracket 130 may connect one pair of the first side panels 231 of the first housing 230 to one pair of the second side panels 235 of the second housing 330.

The fixed bracket 130 may have a length corresponding to a horizontal width of each of the first housing 230 and the second housing 330, and may include a rectangular parallelepiped shape that has a thickness corresponding to a thickness of the front housing 140. The fixed bracket 130 may have a front surface 134, a top surface 131, a left side surface and a right side surface, and a back surface and a bottom surface of the fixed bracket 130 may be open.

The fixed bracket 130 may include a coupling flange 135 capable of being coupled to the front of the first housing 230 and the front of the second housing 330. In detail, the coupling flange 135 of the fixed bracket 130 may be coupled to front ends of one pair of the first side panels 231 of the first housing 230 and front ends of one pair of the second side panels 235 of the second housing 330 by a fastening member such as a screw.

The fixed bracket 130 may include a second guide protrusion 132 that is provided at the top surface 131 of the fixed bracket 130 and guides the coupling position of the front housing 140. The front housing 140 may include a guide hole 143 that is provided at an upper side of the front housing 140 and is coupled to the second guide protrusion 132 of the fixed bracket 130.

The fixed bracket 130 may include a third coupling portion 133 that is be provided at the front surface 134 of the fixed bracket 130 and is connected to the front housing 140. The front housing 140 may include a fourth coupling portion 144 that is provided at an upper side of the front housing 140 and corresponds to the third coupling portion 133 of the fixed bracket 130.

In the assembly process of the front housing 140, after the front housing 140 is temporarily coupled to the fixed bracket 130 in a manner that the second guide protrusion 132 of the fixed bracket 130 passes through the guide hole 143 of the front housing 140, the third coupling portion 133 of the fixed bracket 130 may be coupled to the fourth coupling portion 144 of the front housing 140 through a fastening member such as a screw.

Referring to FIG. 26 and FIG. 30, the first tub 220 may be supported by the first housing 230 through the spring 251. In detail, one end of the spring 251 may be coupled to the first spring coupling portion 233 provided at an upper portion of the first side panel 231 of the first housing 230, and the other end of the spring 251 may be coupled to the second spring coupling portion 222 formed at an outer side surface of the first tub 220. Although the spring 251 reduces vibration and noise of the first tub 220, the vibration of the first tub 220 may be transmitted to the first housing 230 through the spring 251.

The front housing 140 may be disposed in a manner that a height A of an upper end of the front housing 140 is longer than a height B of an upper end of the first housing 230, such that the front housing may guarantee rigidity needed to support the front surface of the washing machine 100 and may effectively prevent forward transmission of vibration of the first housing 230 and the second housing 330. The front surface of the washing machine 100 is composed of only the front housing 140 and a control panel 150 disposed at an upper side of the front housing 140, resulting in better aesthetics.

Preferably, the fixed bracket 130 may be disposed in a manner that a height C of the upper end of the fixed bracket 130 is identical to or longer than a height D of the upper end of the second driver 340. The fixed bracket 130 may include a fire-resistant material such as metal, and may be disposed at a higher position than the second driver 340. As a result, when a fire breaks out due to overheating of the second driver 340, the fixed bracket 130 may prevent the fire from spreading to a front housing 140 or the control panel 150.

FIG. 31 is a control block diagram illustrating a washing machine according to an embodiment of the present disclosure.

Referring to FIG. 31, the washing machine 100 may include a UI 151, a first washing tub 210, a first driver 240, a first sensing portion 410, a second washing tub 310, a second driver 340, a second sensing portion 420, a controller 400, and a storage portion 450.

The first sensing portion 410 may detect an operation of at least one of the first washing tub 210 and the first driver 240, and may acquire information related to the detected operation. Likewise, the second sensing portion 420 may detect an operation of at least one of the second washing tub 310 and the second driver 340, and may acquire information related to the detected operation. Information acquired by at least one of the first sensing portion 410 and the second sensing portion 420 may be transmitted to the controller 400 through a conductive line, a circuit, or a wireless communication network. The controller 400 may generate a predetermined control signal on the basis of the information received from at least one of the first sensing portion 410 and the second sensing portion 420, and may transmit the generated control signal to an associated component, thereby controlling the operation of the washing machine 100.

The first sensing portion 410 may include a vibration sensor 411, a rotation speed sensor 412, a voltage measurement portion 413, and/or a current measurement portion 414 according to selection of the designer.

The vibration sensor 411 may detect vibration of the first washing tub 210 or associated peripheral components (e.g., the first tub 220) on the basis of rotation of the first washing tub 210, and may output an electrical signal corresponding to the detected vibration.

The rotation speed sensor 412 may be provided to detect a rotation speed of the first washing tub 210. In accordance with an embodiment, the rotation speed sensor 412 may detect a rotation speed of the first drive shaft 241 of the first driver 240, and may thus acquire information related to the rotation speed of the first washing tub 210.

The voltage measurement portion 413 may measure the magnitude of voltage applied to the first driver 240, and the current measurement portion 414 may measure the magnitude of current applied to the first driver 240. Voltage measured by the voltage measurement portion 413 or current measured by the current measurement portion 414 may be transmitted to the controller 400. In detail, if the controller 400 controls the first driver 240, a control signal of the controller 400 may be transmitted as an electrical signal to the first driver 240, and the electrical signal may then be transmitted to the first driver 240. The voltage measurement portion 413 may measure a voltage of the resultant electrical signal, and the current measurement portion 414 may measure a current of the resultant electrical signal.

The second sensing portion 420 may include a vibration sensor 421, a rotation speed sensor 422, a voltage measurement portion 423, and/or a current measurement portion 424 according to selection of the designer. The substantial functions, operations, or functions of vibration sensor 421, the rotation speed sensor 422, the voltage measurement portion 423, and the current measurement portion 424 are substantially identical to those of the vibration sensor 411, the rotation sensor 412, the voltage measurement portion 413, and the current measurement portion 414 of the first sensing portion 410, and as such a detailed description thereof will herein be omitted for convenience of description.

Although FIG. 31 illustrates that the first sensing portion 410 of the washing machine 100 includes the vibration sensor 411, the rotation speed sensor 412, the voltage measurement portion 413, and the current measurement portion 414, and the second sensing portion 420 of the washing machine 100 includes the voltage sensor 421, the rotation speed sensor 422, the voltage measurement portion 423, and the current measurement portion 424, the scope or spirit of the present disclosure is not limited thereto, and the first sensing portion 410 need not always include all the above-mentioned components 411, 412, 413, and 414 and the second sensing portion 420 need not always include all the above-mentioned components 421, 422, 423, and 424. At least one of the above-mentioned components will be omitted according to selection of the designer. For example, at least one of the first sensing portion 410 and the second sensing portion 420 may include only one of the above-mentioned components as necessary.

The controller 400 may communicate with various components (e.g., the UI 151, the first driver 240, the second driver 340, and the storage portion 450) located inside or outside the washing machine 100 through a circuit, a conductive line, and/or a wireless communication network, and may transmit control signals to the above-mentioned components such that the controller 400 controls overall operation of the washing machine 100.

For example, the controller 400 may transmit a control signal corresponding to at least one of the first driver 240 and the second driver 340, such that the at least one of the first driver 240 and the second driver 340 starts operation, performs a predefined operation, or stops operation in response to the control signal. In response to the operation of the first driver 240, the first washing tub 210 may rotate. In response to the operation of the second driver 340, the second washing tub 310 may rotate.

The controller 400 may include, for example, a CPU, a MCU, a Micom, an AP, an ECU, and/or other electronic devices capable of processing a variety of operations and generating various control signals. The controller 400 may be implemented using only one device or using a plurality of devices.

The controller 400 may perform predetermined operation, processing, and control operation by driving a program stored in a storage portion 450. Here, the program may be pre-written by a designer and then stored in the storage portion 450, or may be acquired or updated through an ESD network.

In accordance with an embodiment, the controller 400 may be provided to perform the operation of the controller 30 shown in FIGS. 1 to 10, or may also be provided to perform the operation of the controller 70 shown in FIGS. 11 to 24.

In other words, the controller 400 may adjust drive speeds of the washing portions 10 and 20 on the basis of the result of comparison between the first drive speed and the second drive speed, and/or may control the operation of the washing portions 50 and 60 using the second operation profile instead of the first operation profile, according to the presence or absence of unbalance. Since the above-mentioned components have already been disclosed above, a detailed description thereof will herein be omitted for convenience of description.

The storage portion 450 may store various kinds of information needed to operate the washing machine 100. For example, the storage portion 450 may store applications related to operation, processing, and control operation of the controller 400 or information needed for the aforementioned operation, processing, and control operation.

The storage portion 450 may be implemented using magnetic disk storage media, such as a hard disk or a floppy disk, may be implemented using optical media, such as a magnetic tape, a CD or a DVD, may be implemented using magneto-optical media such as a floptical disk, or may be implemented using semiconductor storage devices, such as a ROM, a RAM, a SD card, a flash memory, and a SSD.

The UI 151, the first washing tub 210, the first driver 240, the second washing tub 310, and the second driver 340 have already been disclosed and, as such, a detailed description thereof will herein be omitted for convenience of description.

Various embodiments of the method for controlling the washing machine will hereinafter be described with reference to FIGS. 32, 33, 34, 35, 36, 37, 38, 39, and 40.

Figure 32:
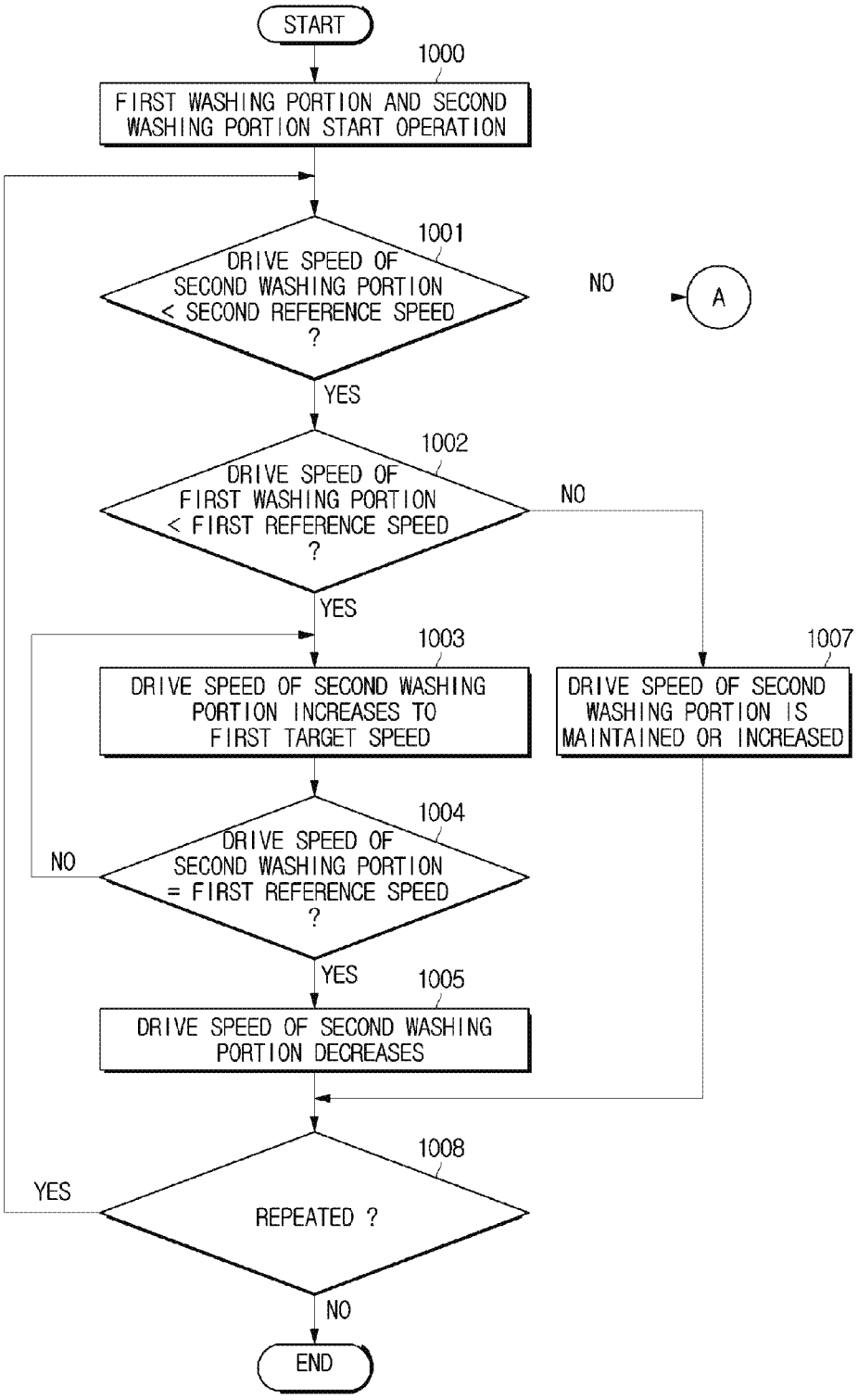
FIG. 32 is a flowchart illustrating a method for controlling a washing machine according to an embodiment of the present disclosure.

FIG. 32 is a flowchart illustrating a method for controlling a washing machine according to an embodiment of the present disclosure.

Referring to FIG. 32, the first washing portion and the second washing portion may simultaneously or sequentially start operation (1000). The operation of the first washing portion may include at least one of a washing process, a rinsing process, and a dehydration process. Likewise, the operation of the second washing portion may include at least one of the washing process, the rinsing process, and the dehydration process. The first washing portion and the second washing operation may also perform the same process. For example, the first washing portion and the second washing portion may perform the dehydration process.

Subsequently, the drive speed (i.e., the second drive speed) of the second washing portion may be compared with a predetermined reference speed, for example, a second reference speed (1001). In this case, the second reference speed may be arbitrarily defined according to selection of the user. For example, the second reference speed may be defined as a maximum drive speed executable by the first washing portion or an approximate value thereto. Although the second reference speed may be set to 800 rpm or an approximate value thereto, the scope or spirit of the present disclosure is not limited thereto. The operation (1001) of comparing the drive speed of the second washing portion with a predetermined reference speed may be omitted as necessary.

The drive speed (i.e., the first drive speed) of the first washing portion may be compared with a first reference speed (1002). The operation 1002 of comparing the drive speed (i.e., the first drive speed) of the first washing portion with the first reference speed may also be carried out when the drive speed of the second washing portion is identical to or higher than the first reference speed ('Yes' in 1001). In this case, the first reference speed may be arbitrarily defined according to selection of the designer or user. For example, the first reference speed may be set to 500 rpm or an approximate value thereto.

If the drive speed of the first washing portion is identical to or higher than the first reference speed ('Yes' in 1003), the drive speed of the second washing portion may increase to a first target speed (1003). The first target speed may be defined by the designer or user. In accordance with an embodiment, the first target speed may be identical to the second reference speed. The first target speed may include the highest drive speed executable by the first washing portion.

When the drive speed of the second washing portion reaches a first target speed ('Yes' in 1004), the drive speed of the second washing portion may be reduced in response to arrival at the first target speed (1005). Reduction of the second drive speed may be initiated as soon as the second drive speed reaches the first target speed, or may be initiated after lapse of a predetermined time from the time at which the second drive speed reaches the first target speed. Reduction of the second drive speed may be carried out when the second driver of the second washing portion is powered off, and/or may also be carried out using a separate braking system.

The second drive speed may be reduced to zero '0' or an approximate value thereto.

If the first drive speed of the first washing portion is less than the first reference speed ('No' in 1002), the drive speed of the second washing portion may be continuously maintained according to selection of the designer, or may be changed by increasing and/or decreasing according to a predefined pattern (1007).

The above-mentioned operations 1001 to 1007 may be periodically or aperiodically repeated according to selection of the designer or user ('Yes' in 1008). Of course, in accordance with an embodiment, each of the above-mentioned operations 1001 to 1007 may also be carried out only once.

Figure 33:
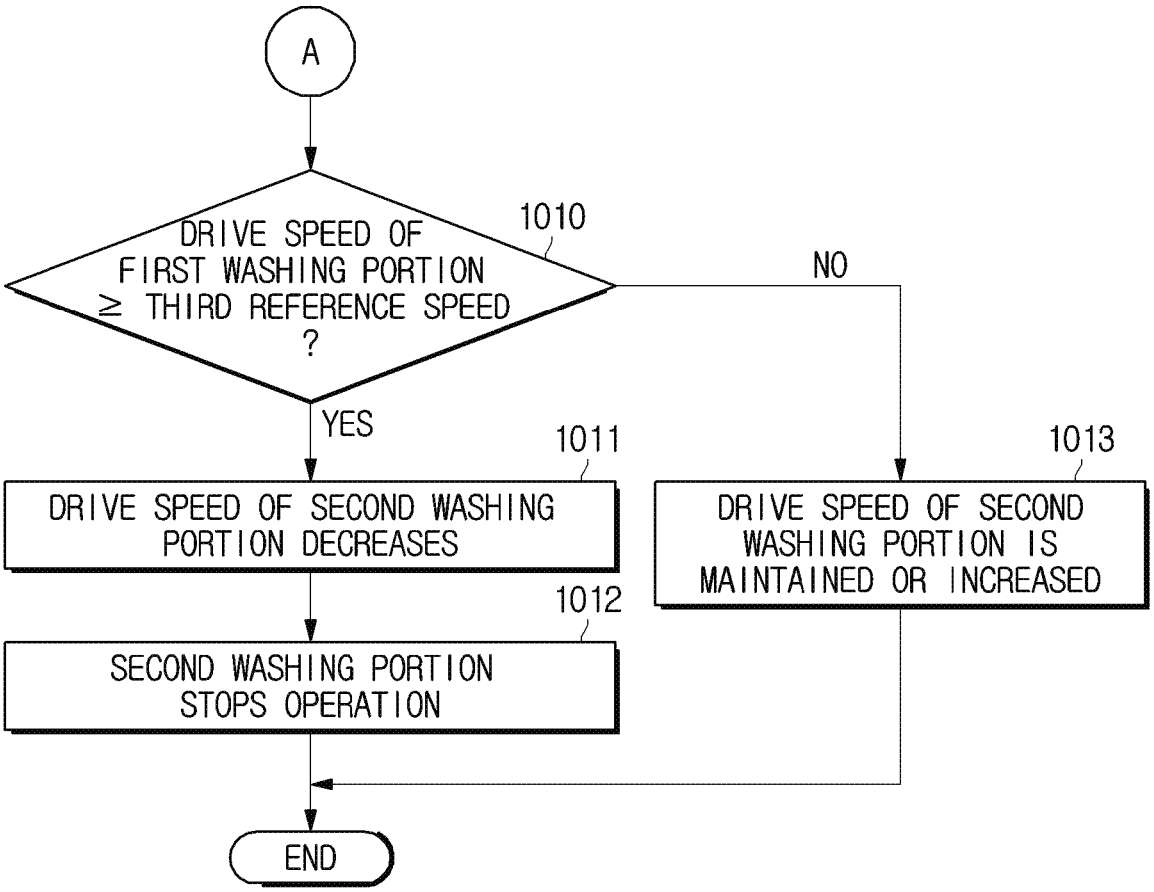
FIG. 33 is a flowchart illustrating a method for controlling a washing machine according to an embodiment of the present disclosure.

FIG. 33 is a flowchart illustrating a method for controlling the washing machine according to an embodiment of the present disclosure.

Referring to FIG. 33, when the drive speed of the second washing portion is equal to or higher than the second reference speed ('No' in 1010), for example, when the drive speed of the second washing portion is identical to the first target speed (1010), the drive speed of the first washing portion may be compared with a third reference speed. Here, the third reference speed may be arbitrarily defined by the designer or user. For example, the third reference speed may be set to 500 rpm or an approximate value thereto. The third reference speed may also be identical to the second reference speed of the operation 1002.

If the first drive speed is equal to or higher than the third reference speed, the second drive speed may be reduced to zero '0' or an approximate value thereto (1011), and the second washing portion may temporarily or non-temporarily stop operation (1012).

In contrast, if the first drive speed is less than the third reference speed, the second drive speed of the second washing portion may be maintained at a speed that is equal to or higher than the second reference speed, or may be changed by increasing and/or decreasing according to a predefined pattern (1013).

Figure 34:
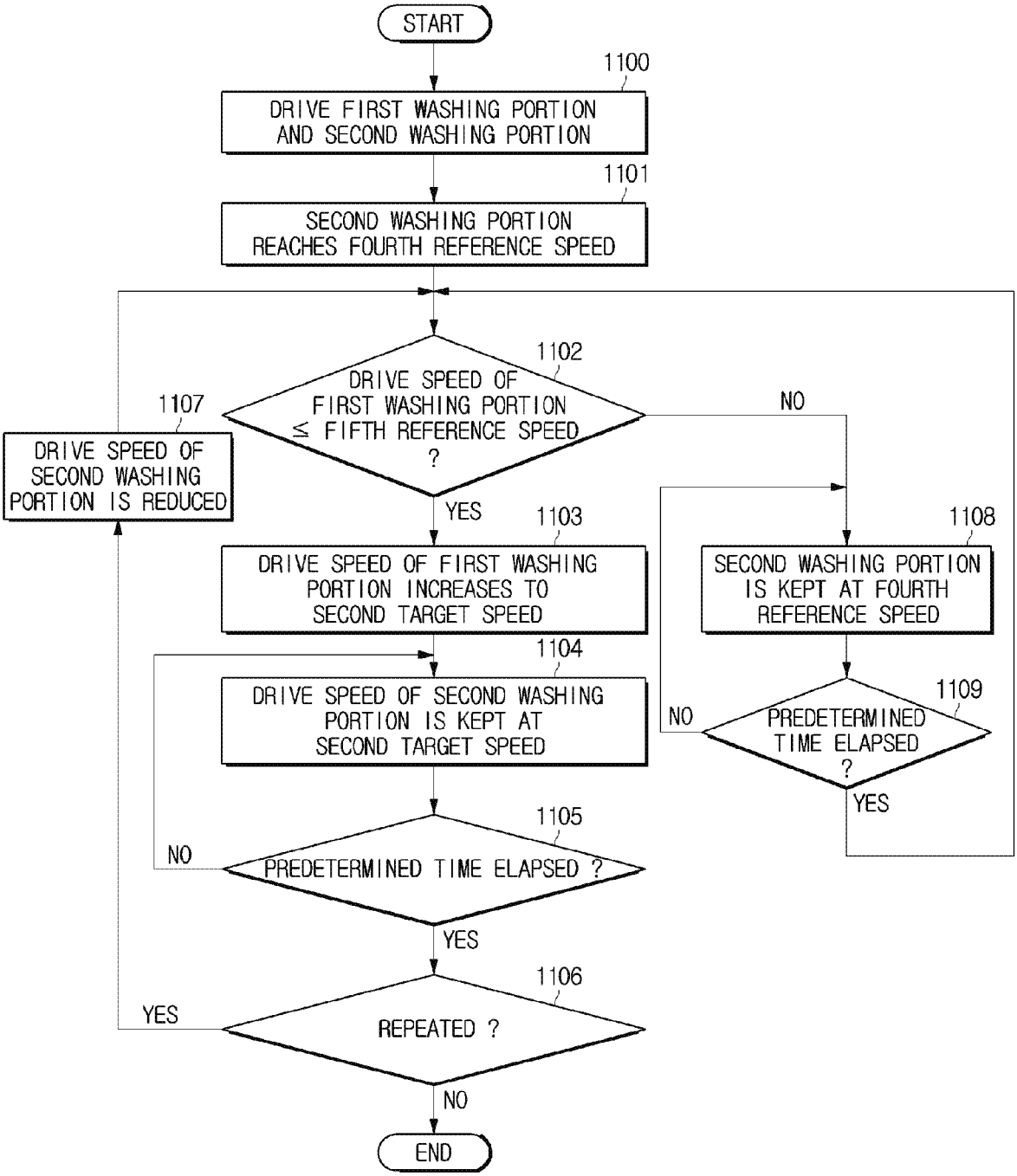
FIG. 34 is a flowchart illustrating a method for controlling a washing machine according to an embodiment of the present disclosure.

FIG. 34 is a flowchart illustrating a method for controlling the washing machine according to an embodiment of the present disclosure.

Referring to FIG. 34, the first washing portion and the second washing portion may start operation at the same time or at different times (1100). Each of the first washing portion and the second washing portion may perform one of the washing process, the rinsing process, and the dehydration process. In this case, the first washing portion and the second washing portion may perform the same process, for example, the dehydration process.

The second drive speed of the second washing portion is compared with a fourth reference speed. If the second drive speed reaches the fourth reference speed according to lapse of time (1101) (i.e., if the second drive speed is identical to the fourth reference speed), the first drive speed of the first washing portion is compared with a fifth reference speed of the first washing portion (1102). In this case, the fourth reference speed and the fifth reference speed may be arbitrarily defined by the designer or user. For example, the fourth reference speed may be set to 500 rpm or an approximate value thereto. The fifth reference speed may also be set to 500 rpm or an approximate value thereto in the same manner as in the fourth reference speed.

If the first drive speed of the first washing portion is identical to or less than the fifth reference speed ('Yes' in 1102), the second washing portion may be controlled until the second drive speed reaches a second target speed (1103). The second target speed may be arbitrarily defined by the designer or user. For example, the second target speed may be 800 rpm or an approximate value thereto.

If the second drive speed is equal or approximates to the second target speed according to the increasing result of the second drive speed, the second drive speed may be kept at the second target speed (1104).

It is determined whether a predefined period, for example, 1 minute, 2 minutes, or other arbitrary times, has sequentially elapsed (1105). If the predefined maintenance period has elapsed ('Yes' in 1105), the operation of maintaining the drive speed of the second washing portion at the second target speed may be ended. If the predefined period has elapsed ('Yes' in 1105), and if the above-mentioned operations 1102 to 1103 need to be repeated ('Yes' in 1106), the second drive speed of the second washing portion may be reduced to a predefined speed (e.g., a fourth reference speed) (1107), and the operation for comparing the first drive speed of the first washing portion with the fifth reference speed is carried out again (1102).

If the first drive speed of the first washing portion is higher than the fifth reference speed ('No' in 1102), the second drive speed of the second washing portion is kept at the fourth reference speed (1108). After lapse of the predefined period (i.e., the aforementioned decision pending period) ('Yes' in 1109), the operation of comparing the first speed of the first washing portion with the fifth reference speed of the first washing portion is performed (1102). Therefore, when the second drive speed is kept at the fourth reference speed, the operation 1102 of periodically or aperiodically comparing the first drive speed with the fifth reference speed may be carried out.

Figure 35:
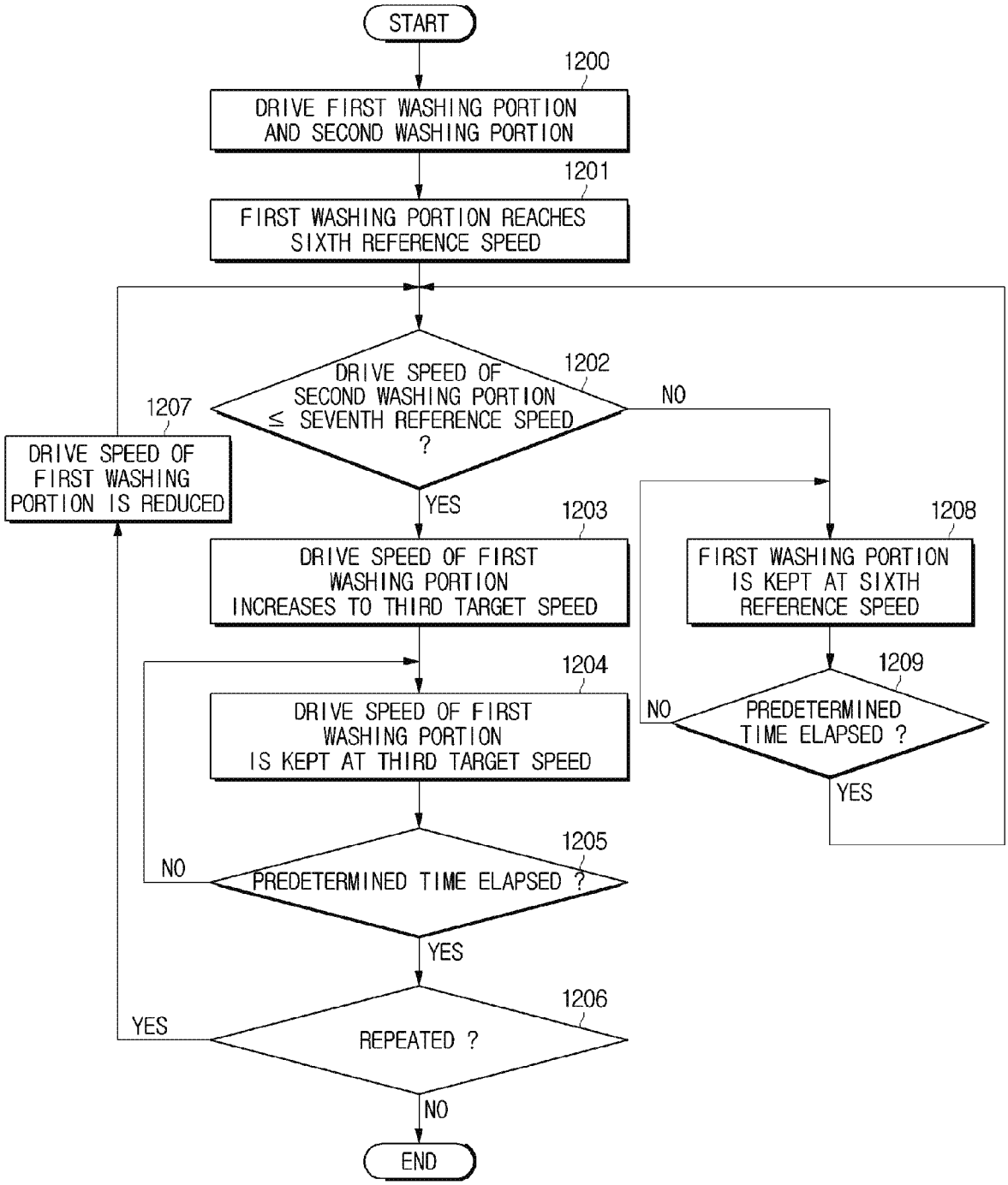
FIG. 35 is a flowchart illustrating a method for controlling a washing machine according to an embodiment of the present disclosure.

FIG. 35 is a flowchart illustrating a method for controlling the washing machine according to an embodiment of the present disclosure.

The control method of FIG. 34 may also be equally applied to a method for controlling the first drive speed of the second washing portion shown in FIG. 35, or the control method of FIG. 34 may be partially modified and then applied to the method for controlling the first drive speed of the second washing portion shown in FIG. 35.

Referring to FIG. 35, the first washing portion and the second washing portion may start operation at the same time or at different times (1200).

The first drive speed of the first washing portion is compared with the sixth reference speed (1201). As soon as the first drive speed is identical to the sixth reference speed, or after lapse of a predetermined time when the first drive speed is identical to the sixth reference speed, the second drive speed of the second washing portion is compared with the seventh reference speed (1202). In this case, the sixth reference speed and the seventh reference speed may be arbitrarily defined by the designer or user. For example, each of the sixth reference speed and the seventh reference speed may be set to 500 rpm or an approximate value thereto. However, the scope or spirit of the sixth reference speed and the seventh reference speed is not limited thereto.

If the second drive speed of the second washing portion is identical to or less than the seventh reference speed ('Yes' in 1202), the drive speed of the first washing portion may increase to the third target speed (1203), and is kept at the third target speed (1204). In this case, the third target speed may be arbitrarily defined by the user or designer. In accordance with an embodiment, the third target speed may also be identical to the second target speed.

After the first drive speed reaches the third target speed, information regarding expiration of a predefined maintenance period may be decided using a clock or the like (1205). If the predefined maintenance period has elapsed ('Yes' in 1205), maintenance of the first drive speed is interrupted.

If the above-mentioned operations 1202 to 1205 need to be repeated ('Yes' in 1206), the first drive speed may be reduced to a predefined speed, for example, the sixth reference speed (1207). As described above, the second drive speed of the second washing portion may be compared again with the seventh reference speed (1202).

In contrast, when the second drive speed of the second washing portion is higher than the seventh reference speed ('No' in 1202), the first drive speed of the first washing portion is kept at the existing sixth reference speed (1208). After lapse of the decision pending period ('Yes' in 1209), the operation of comparing the second drive speed of the second washing portion with the seventh reference speed may be performed again (1202). In accordance with the result of comparison, the first drive speed may increase (1203 to 1205) or may be maintained (1208 and 1209).

Figure 36:
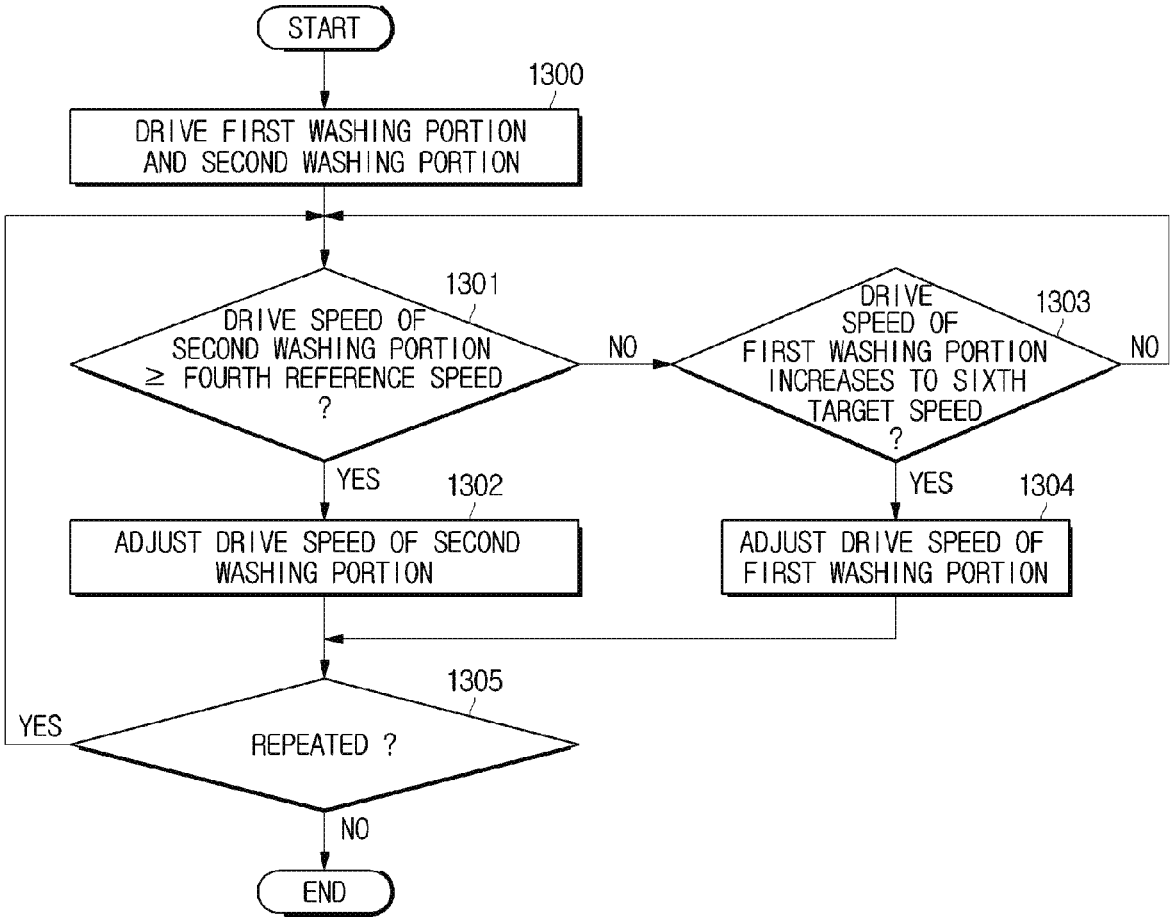
FIG. 36 is a flowchart illustrating a method for controlling a washing machine according to an embodiment of the present disclosure.

FIG. 36 is a flowchart illustrating a method for controlling the washing machine according to an embodiment of the present disclosure.

The washing machine control methods shown in FIGS. 34 and 35 may be combined with each other as shown in FIG. 36, and then carried out.

Referring to FIG. 36, the first washing portion and the second washing portion may start operation at the same time or at different times (1300). When a predetermined process is performed, it is determined whether the second drive speed of the second washing portion reaches the fourth reference speed (1301).

If the second drive speed of the second washing portion reaches the fourth reference speed ('Yes' in 1301), i.e., if the second drive speed of the second washing portion is equal to or higher than the fourth reference speed, the second drive speed of the second washing portion is adjusted as shown in FIG. 34 (1302). In other words, if the second drive speed of the second washing portion reaches the fourth reference speed ('Yes' in 1301), the above-mentioned operations 1102 to 1109 may be carried out by the washing machine.

In contrast, if the second drive speed of the second washing portion does not reach the fourth reference speed ('No' in 1301), it is determined whether the first drive speed of the first washing portion reaches the sixth reference speed (1302).

If the first drive speed of the first washing portion reaches the sixth reference speed ('Yes' in 1303), i.e., if the first drive speed is equal to or higher than the sixth reference speed, the first drive speed of the first washing portion may be adjusted as shown in FIG. 35 (1304). In other words, if the first drive speed of the first washing portion reaches the sixth reference speed ('Yes' in 1302), the above-mentioned operations 1202 to 1209 may be carried out by the washing machine.

If the second drive speed of the second washing portion does not reach the fourth reference speed, and if the first drive speed of the first washing portion does not reach the sixth reference speed ('No' in 1303), the operations 1102 to 1109 or the other operations 1202 to 1209 may not be carried out until one of the drive speeds reaches the predefined reference speed.

In other words, according to which one of the washing portions reaches a reference speed, one of the control method shown in FIG. 34 and the control method shown in FIG. 35 may be selectively carried out.

The above-mentioned operations 1300 to 1305 may be repeatedly carried out according to embodiments of the present disclosure (1305).

Figure 37:
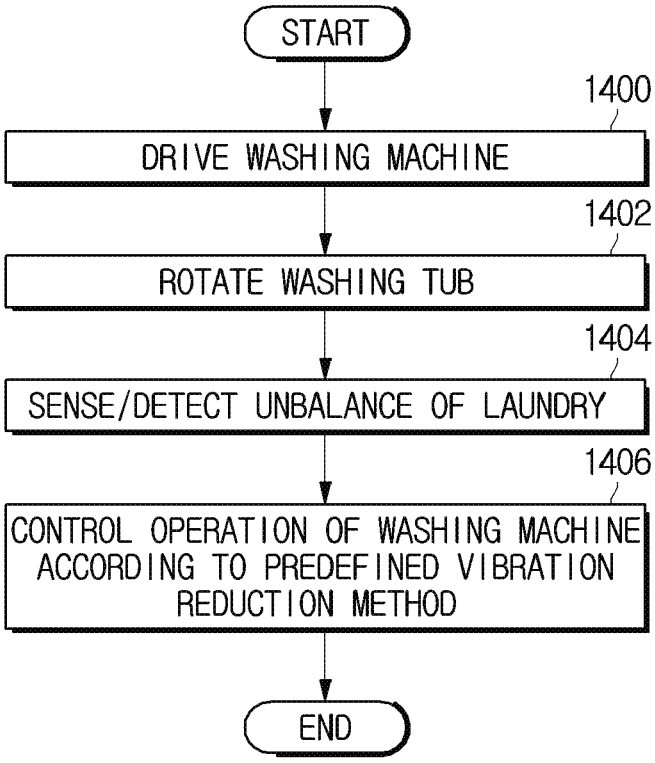
FIG. 37 is a flowchart illustrating a method for controlling a washing machine according to an embodiment of the present disclosure.

FIG. 37 is a flowchart illustrating a method for controlling the washing machine according to an embodiment of the present disclosure.

Referring to FIG. 37, laundry is introduced into the washing tub, and the washing machine starts driving according to user manipulation or predefined setting (1400). In this case, the washing machine may include only one washing tub or may include at least two washing tubs.

In response to beginning of the operation of the washing machine, a user-selected washing tub or a predefined washing tub may begin to rotate in at least one direction according to a predefined pattern (1402), after the driver starts operation. If the washing machine includes a plurality of washing tubs, one of the plurality of washing tubs may begin to rotate, or all or some of the plurality of washing tubs may begin to rotate.

During operation of the washing tub, laundry stored in the washing tub is concentrated at one region, such that unbalance may occur in the washing tub. Such unbalance may be detected by the operation sensing portion, and/or may be decided by the controller (1404). In accordance with an embodiment, the operation sensing portion may include a washing-tub operation sensing portion capable of detecting vibration of the washing tub, and/or may include a driver operation sensing portion that detects a rotation speed of the driver and measures voltage or current applied to the driver. If the driver operation sensing portion includes a voltage measurement device configured to measure a voltage, the driver operation sensing portion may also be installed at a DC link circuit.

If unbalance occurrence is detected and/or decided, the washing machine may be controlled according to a predefined series of operations (1406). For example, in order to reduce the number of vibrations of the washing tub caused by unbalance, the washing machine may operate using a predefined vibration reduction method. The predefined vibration reduction method may be defined to include a method for increasing a water level of water stored in the washing tub, a method for changing acceleration or deceleration of the driver, a method for changing an operation rate of the driver, a method for adjusting an operation period and a stopped period of the driver, and/or a combination of at least two of the above-mentioned methods.

The method for controlling operation of the washing machine according to unbalance may be carried out by the controller, or may also be carried out without using the controller. For example, signals output from the operation sensing portion may be transmitted to the driver, and the driver may perform the operation for removing unbalance on the basis of the output signals.

A method for controlling the washing machine will hereinafter be described with reference to FIG. 38.

Figure 38:
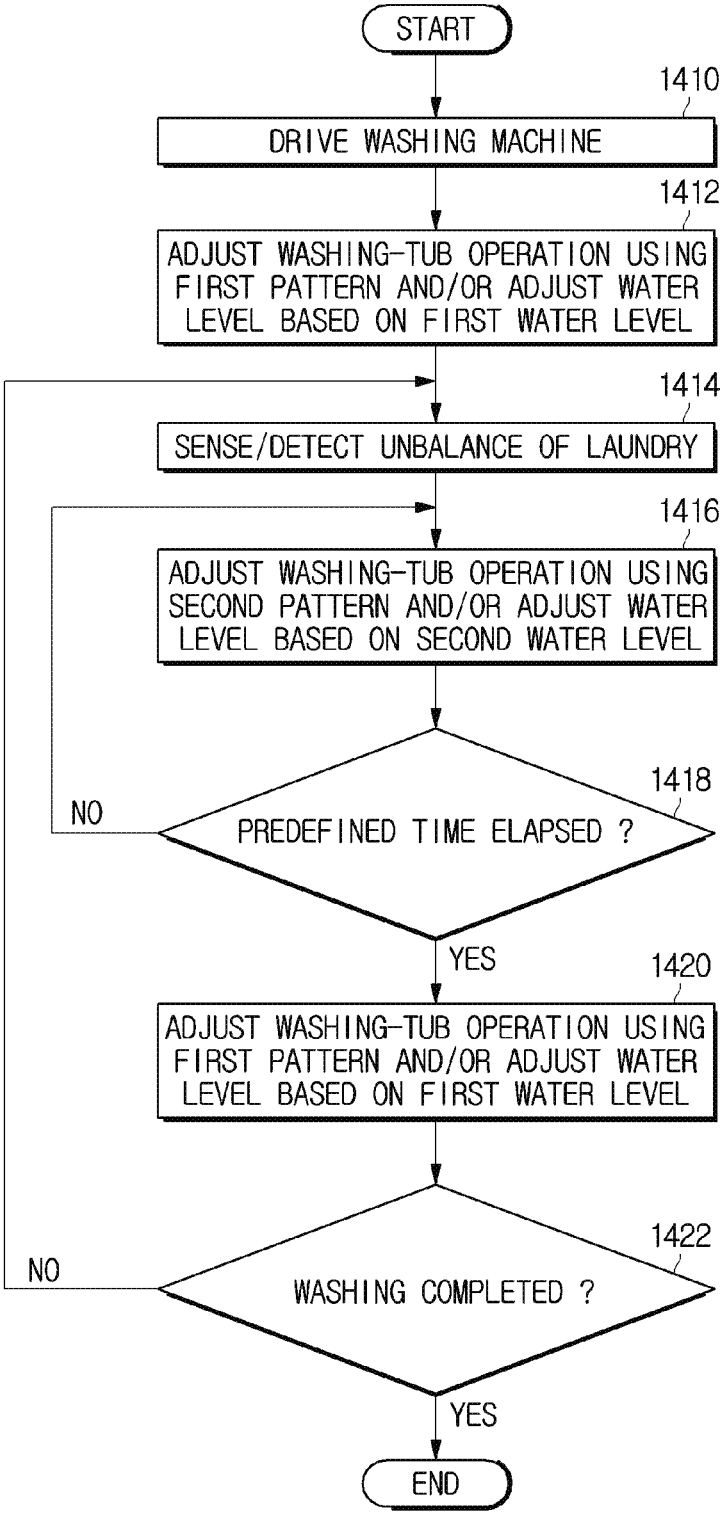
FIG. 38 is a flowchart illustrating a method for controlling a washing machine according to an embodiment of the present disclosure.

FIG. 38 is a flowchart illustrating a method for controlling the washing machine according to an embodiment of the present disclosure.

Referring to FIG. 38, if the washing machine starts driving (1410), at least one of the washing tubs contained in the washing machine may start operation according to a first operation profile (1412). The first operation profile may be defined to include at least one of information regarding a series of operation patterns (hereinafter referred to as a first pattern) of the washing tub, and information regarding a water level (hereinafter referred to as a first water level) of the washing tub.

During operation of the washing tub, the number of vibrations of the washing tub may be higher than a predetermined reference number of vibrations, a target rotation speed of the driver may be less than a reference target rotation speed, a voltage applied to the driver or the DC link circuit may be higher than a reference voltage, and/or a current applied to the driver may be higher than the reference voltage (1414). The above-mentioned operations may be caused by unbalance generated in the washing tub.

As described above, if the controller or the like detects or determines the presence of unbalance in the washing tub, the unbalanced washing tub may operate according to the second operation profile (1416). The second operation profile may include at least one of information regarding a series of washing-machine operation patterns different from the first pattern and information regarding a washing-tub water level (hereinafter referred to as a second water level) different from the first water level.

In accordance with an embodiment, the second operation profile may be defined to include, according to selection of the designer, at least one of a method for supplying wash water to the second water level higher than the first water level, a method for reducing a target rotation speed, a method for reducing an operation rate of the driver, a method for increasing rotation acceleration, a method for increasing rotation deceleration, and/or a method for reducing an operation period or a stopped period of the driver.

In accordance with an embodiment, the washing tub may also be continuously controlled on the basis of the second operation profile.

In accordance with another embodiment, as shown in FIG. 38, after the washing tub is controlled by the second operation profile, it is determined whether a predefined time has elapsed (1418). If the predefined time has not elapsed ('No' in 1418), the washing tub may be continuously controlled by the second operation profile. In contrast, if the predefined time has elapsed ('Yes' in 1418), the washing tub may be controlled by a new operation profile, for example, the first operation profile. For example, the washing tub may be controlled to re-operate according to the first pattern, and/or the drain device may be controlled in a manner that wash water stored in the washing tub is discharged outside until residual wash water reaches the first water level 1420.

In accordance with an embodiment, the operations 1414 to 1420 for determining the presence or absence of unbalance and changing the operation profile may be continuously repeated until washing of the laundry is completed (1422).

Figure 39:
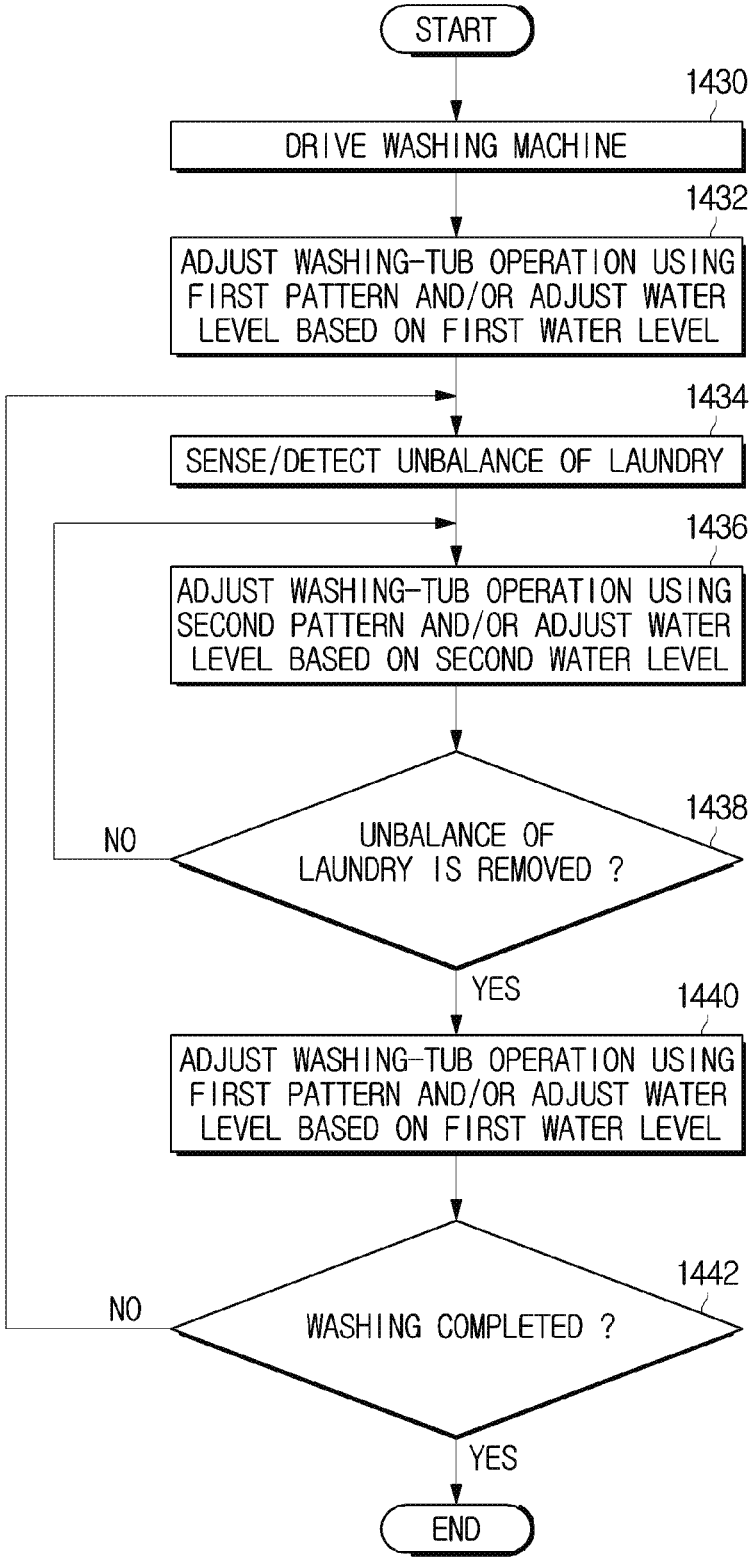
FIG. 39 is a flowchart illustrating a method for controlling a washing machine according to an embodiment of the present disclosure.

FIG. 39 is a flowchart illustrating a method for controlling the washing machine according to an embodiment of the present disclosure.

Referring to FIG. 39, the washing machine starts driving (1430), and at least one of the washing tubs contained in the washing machine may be controlled based on the first operation profile (1432).

During operation of the washing tub, due to unbalance generated in the washing tub, it is determined whether the number of vibrations of the washing tub is higher than a predetermined reference number of vibrations, it is determined whether a target rotation speed of the driver is less than a reference target rotation speed, it is determined whether a voltage applied to the driver or the DC link circuit is higher than a reference voltage, and/or it is determined whether a current applied to the driver is higher than the reference voltage (1434).

As described above, if the controller or the like detects or determines the presence of unbalance in the washing tub, the unbalanced washing tub may operate according to the second operation profile (1436). As described above, the second operation profile may be defined to include, according to selection of the designer, at least one of a method for supplying wash water to the second water level, which is higher than the first water level, a method for reducing a target rotation speed, a method for reducing an operation rate of the driver, a method for increasing rotation acceleration, a method for increasing rotation deceleration, and/or a method for reducing an operation period or a stopped period of the driver.

Information as to whether unbalance occurs in the washing tub may be continuously detected or decided (1438).

If the number of vibrations of the washing tub is higher than a predefined reference number of vibrations, if the target rotation speed of the driver is less than a reference target rotation speed, if voltage applied to the driver or the DC link circuit is higher than a reference voltage, and/or if current applied to the driver is higher than a reference current ('No' in 1438), the washing tub having unbalance may be continuously controlled according to the second operation profile (1434).

In contrast, If the number of vibrations of the washing tub is less than the predefined reference number of vibrations, if the target rotation speed of the driver is higher than the reference target rotation speed, if voltage applied to the driver or the DC link circuit is less than the reference voltage, and/or if current applied to the driver is higher than the reference current ('Yes' in 1438), it is determined that unbalance of laundry is removed in the washing tub. The washing tub having unbalance may be re-controlled based on a new operation profile, for example, the first operation profile. In more detail, for example, the washing tub may operate according to a first pattern, and/or constituent components of the washing machine may be controlled in a manner that wash water stored in the washing tub is reduced to the first water level.

In accordance with an embodiment, the operations 1434 to 1440 for determining the presence or absence of unbalance and changing the operation profile may be continuously repeated until the washing process, the rinsing process, and/or the dehydration process are/is completed (1442).

Figure 40:
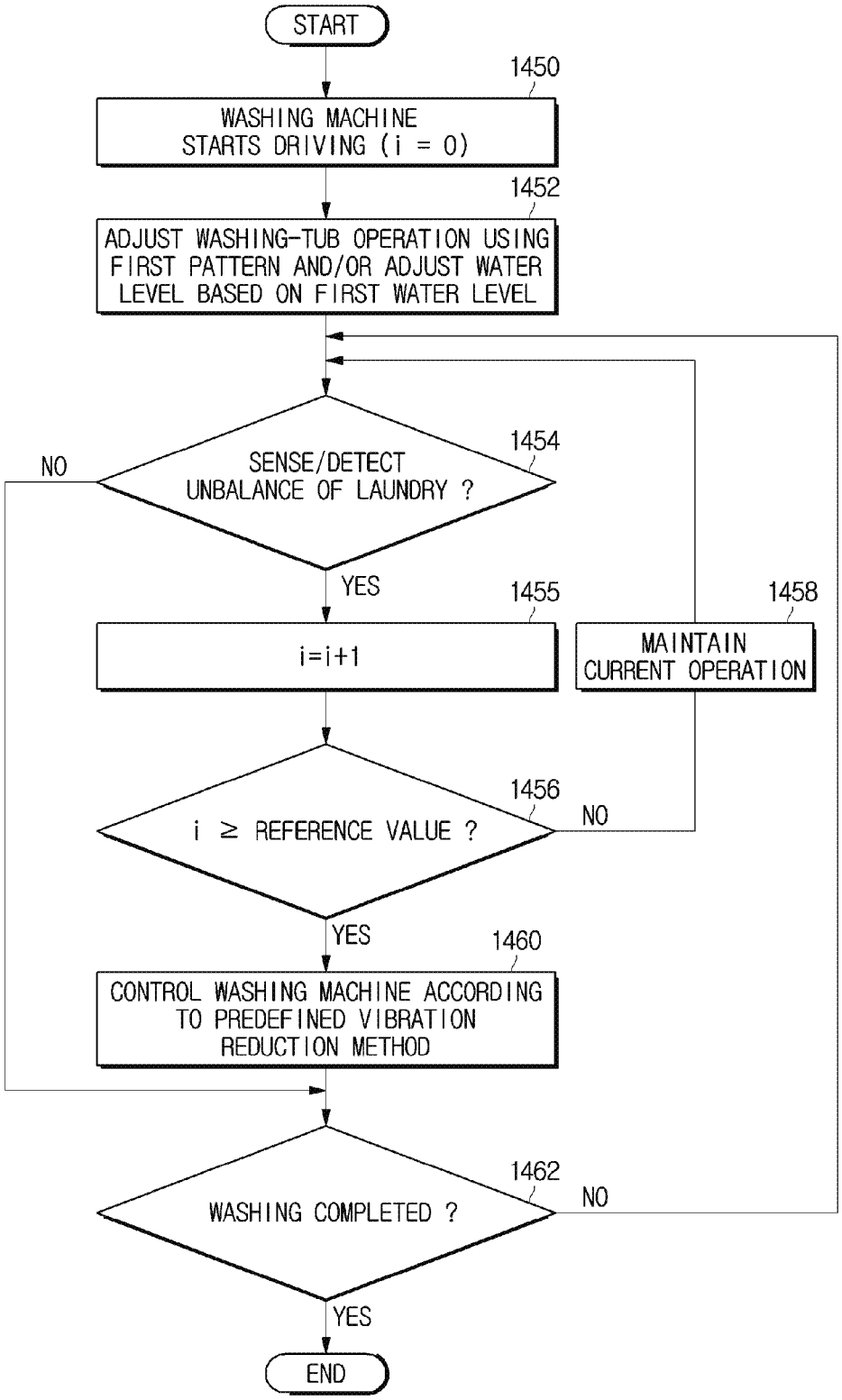
FIG. 40 is a flowchart illustrating a method for controlling a washing machine according to an embodiment of the present disclosure.

FIG. 40 is a flowchart illustrating a method for controlling the washing machine according to an embodiment of the present disclosure.

Referring to FIG. 40, the washing machine may start driving according to user manipulation or predefined setting (1450). In this case, a count variable (i) for counting the number of generated unbalances may be set to, for example, zero '0', without being limited thereto. The count variable (i) may also be set to '1' or other numbers according to selection of the designer.

If the washing machine starts driving, at least one of the washing tubs contained in the washing machine is controlled by the first operation profile, such that at least one of the washing process, the rinsing process, and/or the dehydration process is started (1452). In this case, the washing tub may operate based on the first pattern, and/or the water level of the washing tub may be adjusted to the first level.

As described above, during operation of the washing tub, due to unbalance generated in the washing tub, if the number of vibrations generated in the washing tub is higher than the predefined reference number of vibrations, if a target rotation speed of the driver is less than the reference target rotation speed, if voltage applied to the driver or the DC link circuit is higher than the reference voltage, and/or if current applied to the driver is higher than the reference current, information as to whether unbalance occurs in the washing tub may be detected or decided on the basis of the above-mentioned results (1454).

If no unbalance occurs in the washing tub ('No' in 1454), the washing tub may continuously operate according to the first operation profile. If no unbalance occurs in the washing tub until washing of laundry is completed ('Yes' in 1462), the washing tub may operate based on the first operation profile until washing of laundry is completed. In contrast, prior to completion of laundry washing ('No' in 1462), if unbalance occurs in the washing tub ('Yes' in 1454), the washing machine may operate as described later (1454 to 1460).

If the presence of unbalance of the washing tub is decided ('Yes' in 1454), a predetermined value (for example, a value of 1) may be added to the count variable (i) (1455), and the resultant count variable (i) to which the predetermined value is added may be compared with a predefined count reference value (1456). The count reference value may include, for example, a value of 3, without being limited thereto.

If the count variable (i) is equal to or higher than a count reference value ('Yes' in 1456), the washing machine may be controlled using a predefined method capable of removing unbalance of the washing tub (1460). For example, the washing tub may be controlled based on the second operation profile. In this case, according to an embodiment, the washing tub may be controlled by the second operation profile until washing of laundry is completed, may be controlled by the second operation profile only during a predefined time as shown in FIG. 38, or may be controlled by the second operation profile until the result of decision of indicating removal of unbalance is acquired as shown in FIG. 39.

If the count variable (i) is less than the count reference value, the washing machine may continuously perform a current operation process (1458). In other words, the washing tub from which unbalance information is acquired may operate according to the existing operation profile (i.e., the first operation profile).

The operations 1454 to 1460 for determining the presence or absence of unbalance and changing the operation profile may be continuously repeated until the washing process, the rinsing process, and/or the dehydration process are/is completed (1462).

The above-mentioned washing machine control method (s) disclosed in the embodiments of the present disclosure may be implemented in the form of programs executable by a variety of computer means. In this case, the program may include program commands, data files, data structures, etc. individually or in combination. Here, the program may include, for example, high-level language codes executable by a computer using an interpreter as well as machine language codes generated by a complier. In addition, the program may be particularly designed and configured to implement the above-mentioned washing machine control method, or may also be implemented using various functions or definitions well known to those skilled in the art related to computer software.

The program for implementing the above-mentioned washing machine control method according to embodiments of the present disclosure may be written in computer readable media. Examples of the computer readable media may include magnetic disk storage media, such as a hard disk or a floppy disk, and a magnetic tape, optical media, such as a CD and a DVD, magneto-optical media, such as a floptical disk, and hardware devices, such as semiconductor storage units (e.g., a ROM, a RAM, and a flash memory), which are particularly configured to store and execute specific programs executed by computers or the like.

Although the washing machine and the method for controlling the same according to embodiments of the present disclosure have been disclosed herein merely for illustrative purposes, the scope or spirit of the embodiments is not limited thereto, and those skilled in the art will appreciate that various modifications, additions and substitutions are possible, without departing from the scope and spirit of the disclosure as disclosed in the accompanying claims. For example, adequate effects of the present disclosure may be achieved even if the foregoing processes and methods may be carried out in different order than described above, and/or the aforementioned elements, such as systems, structures, devices, or circuits, may be combined or coupled in different forms and modes than as described above or be substituted or switched with other components or equivalents.

As is apparent from the above description, a washing machine including a plurality of washing tubs and a method for controlling the same according to the embodiments of the present disclosure may reduce or remove excessive vibration caused by simultaneous operation of the plurality of washing tubs, and a method for controlling the same.

In accordance with the above-mentioned washing machine and method for controlling the same, when one washing tub includes a plurality of washing tubs, the respective washing tubs may be controlled according to operations of different washing tubs, resulting in increased operation efficiency of each washing tub.

In accordance with the above-mentioned washing machine and method for controlling the same, in order to reduce or mitigate vibration encountered when one of the plurality of washing tubs operates at a high rotation frequency of a motor, at least another one of the plurality of washing tubs need not always stop operation.

In accordance with the above-mentioned washing machine and method for controlling the same, although one of the plurality of washing tubs operates, at least another one of the plurality of washing tubs need not always stop operation, such that a standby time of the at least one other washing tub may be minimized or removed, resulting in reduction of a consumption time needed for washing and dehydration processes.

In accordance with the above-mentioned washing machine and method for controlling the same, when unbalance occurs in the washing tub by eccentricity of laundry stored in the washing tub, the washing machine may untangle and disperse tangled laundry, such that unbalance in the washing tub is removed.

In accordance with the above-mentioned washing machine and method for controlling the same, since unbalance in the washing tub is removed, unnecessary vibration is prevented from being applied to the washing tub, resulting in prevention of wear and damage to the washing tub.

In accordance with the above-mentioned washing machine and method for controlling the same, since unbalance in the washing tub is removed, washing efficiency in at least one of a washing process, a rinsing process, and a dehydration process is more improved.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A washing machine comprising:

a first rotary tub;

a first driver configured to rotate the first rotary tub;

a second rotary tub;

a second driver configured to rotate the second rotary tub; and at least one processor configured to:

control the first driver to rotate the first rotary tub, and control the second driver to rotate the second rotary tub, and based on a rotation speed of the first rotary tub being equal to or higher than a first reference speed, control the second driver to increase a rotation speed of the second rotary tub to a target speed, and based on the second driver increasing the rotation speed of the second rotary tub to the target speed, control the second driver to decrease the rotation speed of the second rotary tub below the target speed.

2. The washing machine according to claim 1, wherein, based in the rotation speed of the first rotary tub being equal to or higher than the first reference speed and the rotation speed of the second rotary tub being equal to or higher than the target speed, the at least one processor is further configured to control the second driver to decrease the rotation speed of the second rotary tub.

3. The washing machine according to claim 1, wherein the at least one processor is further configured to shut off power applied to the second driver, based on the rotation speed of the second rotary tub reaching the target speed.

4. The washing machine according to claim 1, wherein, based on the washing machine being in a dehydration process, the at least one processor is further configured to control the rotation speed of the first rotary tub and the rotation speed of the second rotary tub at a rotation speed predetermined for the dehydration process.

5. The washing machine according to claim 1, wherein one of the first rotary tub or the second rotary tub rotates about a vertical axis, and wherein the other one of the first rotary tub or the second rotary tub rotates about a horizontal axis.

6. A method for controlling a washing machine, the method comprising:

measuring a rotation speed of a first rotary tub;

comparing a rotation speed of the first rotary tub with a first reference speed;

based on the rotation speed of the first rotary tub being equal to or higher than the first reference speed, controlling a second driver to increase a rotation speed of a second rotary tub to a target speed; and based on the second driver increasing the rotation speed of the second rotary tub to the target speed, control the second driver to decrease the rotation speed of the second rotary tub below the target speed.

7. The method according to claim 6, further comprising:

based on the rotation speed of the first rotary tub being equal to or higher than the first reference speed and the rotation speed of the second rotary tub is equal to or higher than the target speed, controlling the second driver to decrease the rotation speed of the second rotary tub.

8. The method according to claim 6, wherein the controlling of the second driver to increase the rotation peed of the second rotary tub to the target speed and then decrease the rotation speed comprises, based on the rotation speed of the second rotary tub reaching the target speed, shutting off power applied to the second driver.

9. The method according to claim 6, further comprising: based on the washing machine being in a dehydration process, controlling the rotation speed of the first rotary tub and the rotation speed of the second rotary tub at a rotation speed predetermined for the dehydration process.

10. The method according to claim 6, wherein one of the first rotary tub or the second rotary tub rotates about a vertical axis, and wherein the other one of the first rotary tub or the second rotary tub rotates about a horizontal axis.

11. A washing machine comprising:

a first rotary tub;

a first driver configured to rotate the first rotary tub;

a second rotary tub installed adjacent to the first rotary tub;

a second driver configured to rotate the second rotary tub;

an operation sensing portion configured to detect operation of at least one of the second rotary tub or the second driver; and at least one processor configured to:

determine whether unbalance occurs in the second rotary tub based on the detection result of the operation sensing portion, and based on the unbalance occurring in the second rotary tub in a washing process or a dehydration process, control the washing machine to increase an amount of wash water stored in the second rotary tub or change a rotation speed of the second driver to end the unbalance.

12. The washing machine according to claim 11, wherein the operation sensing portion includes at least one of:

a rotary-tub operation sensing portion configured to detect vibration of the second rotary tub; or a driver operation sensing portion configured to detect at least one of a rotation speed of the second driver, a voltage applied to the second driver, or a current applied to the second driver.

13. The washing machine according to claim 11, wherein the at least one processor is further configured to change an operation of the second driver by at least one of:

reducing a target rotation speed of the second driver, reducing an operation rate of the second driver, changing at least one of rotation acceleration or rotation deceleration of the second driver, or reducing at least one of an operation period or a stopped period of the second driver.

14. The washing machine according to claim 11, wherein, after the at least one processor controls the washing machine to increase the amount of wash water stored in the second rotary tub or change the operation of the second driver, based on elapse of a predetermined time, the at least one processor is further configured to:

reduce the amount of wash water stored in the second rotary tub, or control the second driver to re-execute a legacy operation.

15. The washing machine according to claim 11, wherein, based on unbalance occurring several times in the second rotary tub, the at least one processor is further configured to:

increase the amount of wash water stored in the second rotary tub, or change an operation profile of the second driver.

16. The washing machine according to claim 15, wherein the change in the operation profile of the second driver includes at least one of changing a rate of rotation deceleration or changing a rate of rotation acceleration.

17. The washing machine according to claim 15, wherein the change in the operation profile of the second driver includes starting operation and stopping operation more frequently.

18. The washing machine according to claim 15, wherein the change in the operation profile of the second driver includes reducing a period of operation.

19. The washing machine according to claim 15, wherein the change in the operation profile of the second driver includes reducing a stoppage period.

20. The washing machine according to claim 15, wherein the at least one processor is further configured to:

determine that an unbalance has been removed, and change the operation profile of the second driver to an operation profile predetermined to improve washer efficiency.

* * * * *